US009429902B2

(12) United States Patent
Kim et al.

(10) Patent No.: US 9,429,902 B2
(45) Date of Patent: Aug. 30, 2016

(54) DEVELOPING CARTRIDGE AND IMAGE FORMING APPARATUS EMPLOYING THE SAME

(71) Applicant: Samsung Electronics Co., Ltd., Suwon-si (KR)

(72) Inventors: Joon-hee Kim, Seoul (KR); Jin-hwa Hong, Suwon-si (KR); Seong-woong Yang, Suwon-si (KR); Yun-kyu Sim, Seoul (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/874,952

(22) Filed: Oct. 5, 2015

(65) Prior Publication Data

US 2016/0179051 A1 Jun. 23, 2016

(30) Foreign Application Priority Data

Dec. 18, 2014 (KR) ..... 10-2014-0183300

(51) Int. Cl.
*G03G 21/16* (2006.01)

(52) U.S. Cl.
CPC ..... *G03G 21/1676* (2013.01)

(58) Field of Classification Search
None
See application file for complete search history.

(56) References Cited

U.S. PATENT DOCUMENTS

| | | | | |
|---|---|---|---|---|
| 5,471,286 | A | 11/1995 | Tanaka | |
| 7,542,701 | B2 | 6/2009 | Kweon | |
| 7,643,774 | B2 | 1/2010 | Choi | |
| 7,660,550 | B2 | 2/2010 | Mori et al. | |
| 2005/0053394 | A1* | 3/2005 | Ishii | G03G 21/1821 399/111 |
| 2007/0098438 | A1 | 5/2007 | Yamaguchi | |
| 2012/0269543 | A1 | 10/2012 | Hashimoto | |
| 2013/0107282 | A1 | 5/2013 | Kim | |
| 2013/0164028 | A1 | 6/2013 | Morioka et al. | |
| 2015/0370220 | A1 | 12/2015 | Hashimoto | |

FOREIGN PATENT DOCUMENTS

| | | |
|---|---|---|
| JP | 6-167874 | 6/1994 |
| JP | 2012-230136 | 11/2012 |
| KR | 10-2007-0037888 | 4/2007 |
| KR | 10-0729626 | 6/2007 |

* cited by examiner

OTHER PUBLICATIONS

International Search Report and Written Opinion of the International Searching Authority mailed Jan. 25, 2016 in International Patent Application No. PCT/KR2015/010615.

*Primary Examiner* — David Gray
*Assistant Examiner* — Jas Sanghera
(74) *Attorney, Agent, or Firm* — Staas & Halsey LLP

(57) ABSTRACT

Provided is a developing cartridge including a photosensitive unit and a developing unit connected to each other to rotate to a developing location and a non-developing location. An elastic member applies an elastic force to the developing unit and the photosensitive unit in a direction of rotating to the developing location. The developing cartridge includes a nip separating portion switched to a nip forming location where the developing unit is located at the developing location and to a nip separating location where the developing unit is located at the non-developing location, a manipulation portion for switching the nip separating portion to the nip forming location and to the nip separating location by a manual manipulation, and a nip forming unit for switching the nip separating portion from the nip separating location to the nip forming location as the photosensitive unit and the developing unit start to operate.

25 Claims, 41 Drawing Sheets

DEVELOPING CARTRIDGE AND IMAGE FORMING APPARATUS EMPLOYING THE SAME

CROSS-REFERENCE TO RELATED APPLICATIONS

This application claims the priority benefit of Korean Patent Application No. 10-2014-0183300, filed on Dec. 18, 2014, in the Korean Intellectual Property Office, the disclosure of which is incorporated herein in its entirety by reference.

BACKGROUND

1. Field

The present disclosure relates to developing cartridges and image forming apparatuses adopting the developing cartridges for printing images on a recording medium by using an electrophotographic method.

2. Description of the Related Art

An electrophographic image forming apparatus prints images on a recording medium by forming a visible toner image on a photosensitive body by supplying toner to an electrostatic latent image formed on the photosensitive body, transferring the toner image onto the recording medium, and fusing the toner image onto the recording medium.

A developing cartridge is an assembly including components for forming a visible toner image, and may be attached to/detached from a main body of an image forming apparatus. In addition, the developing cartridge is an expendable item that may be replaced when a lifespan thereof expires. In a developing cartridge that adopts a contact developing method, a developing roller and a photosensitive material contact each other to form a developing nip.

A developing cartridge may be distributed in a state of being attached to a main body of an image forming apparatus or in a state of being separately packaged from the image forming apparatus. Also, a developing cartridge may be in a standby state for a long time while in a state of being attached to the main body of the image forming apparatus, while the image forming apparatus is being used.

As described above, if a long time has elapsed in a state since a developing nip has been formed, a developing roller may be deformed or a photosensitive body may be damaged. The deformation of the developing roller and the damage to the photosensitive body may cause deformation of the developing nip, thereby adversely affecting image quality.

SUMMARY

Provided are developing cartridges and image forming apparatuses capable of separating/forming a developing nip by a manual manipulation and switching a developing nip from an isolation state to a formed state by an operation of the image forming apparatus.

According to an aspect of an exemplary embodiment, a developing cartridge includes: a photosensitive unit including a photosensitive drum; a developing unit including a developing roller, and being connected to the photosensitive unit to rotate to a developing location, where the photosensitive drum and the developing roller contact each other to form a developing nip, and to rotate to a non-developing location, where the developing roller and the photosensitive drum are separate from each other to remove the developing nip; an elastic member configured to apply an elastic force to the developing unit and the photosensitive unit in a direction of rotating toward the developing location; and a nip control unit including a nip separating portion switched to a nip forming location where the developing unit is located at the developing location and to a nip separating location where the developing unit is located at the non-developing location, a manipulation portion configured to switch the nip separating portion to the nip forming location and to the nip separating location by a manual manipulation, and a nip forming unit configured to switch the nip separating portion from the nip separating location to the nip forming location as the photosensitive unit and the developing unit start to operate.

The manipulation portion may be exposed to outside of the developing cartridge when the nip separation unit is located on the nip forming location.

The nip forming unit may switch the nip separating portion from the nip separating location to the nip forming location as the developing roller rotates.

The nip separating portion may interfere with the photosensitive unit when switched from the nip forming location to the nip separating location so that the developing unit rotates with respect to the photosensitive unit in a direction opposite to the direction in which the elastic force is applied.

The nip forming location may include a first nip forming location and a second nip forming location, the manipulation portion may switch the nip separating portion to the first nip forming location, and the second nip forming location, and the nip separating location, and the nip forming unit may switch the nip separating portion from the nip separating location to the second nip forming location.

The developing cartridge may further include a nip separation member including the nip separating portion and the manipulation portion, and being provided on the developing unit to be switched to the first nip forming location and second nip forming location and the nip separating location, wherein the nip forming unit may include: a gear to rotate with the developing roller; and a nip forming member including a cam gear portion to engage with the gear at the nip separating location and to separate from the gear at the first nip forming location and the second nip forming location, and the nip forming member being connected to the nip separation member.

The nip separation member and the nip forming member may be provided in the developing unit so as to rotate about a rotary shaft. The nip forming member may include a protrusion and the nip separation member may include an insertion portion into which the protrusion is inserted. The nip separation member and the nip forming member may be rotated with each other by using the protrusion of the nip forming member and the insertion portion of the nip separation member into which the protrusion is inserted.

The nip separating portion may interfere with the developing unit while switching from the nip forming location to the nip separation location to rotate the developing unit with respect to the photosensitive unit in an opposite direction to a direction in which the elastic force is applied.

The developing cartridge may further include: a nip control member including the nip separating portion and the nip control member the manipulation portion and being provided on the photosensitive unit to move to the nip forming location and the nip separating location; a lock unit configured to lock the nip control member at the nip separating location; and a return spring configured to apply an elastic force to the nip control member in a direction of locating at the nip forming location, wherein the nip forming unit may include: a gear to rotate with the developing roller and the gear including a releasing cam; and a releasing portion configured to interfere with the releasing cam when the gear rotates in a state where the nip control member is located at the nip separating location to unlock the nip control member.

The lock unit may include a first hook arranged on the photosensitive unit and a second hook arranged on the nip control member to be hooked by the first hook when the nip control member is located at the nip separating location.

The second hook and the nip separation unit may be arranged at an elastic arm extending from a body of the nip control member, and the releasing cam may interfere with the nip separating portion to push the elastic arm so that the second hook unhooks from the first hook.

The photosensitive unit may include a manual manipulation recess configured to push the elastic arm so that the second hook unhooks from the first hook when the nip control member is located at the nip separating location.

The nip separating portion may interfere with the photosensitive drum while switching from the nip forming location to the nip separating location so that the developing unit rotates with respect to the photosensitive unit in an opposite direction to the direction in which the elastic force is applied.

The nip forming unit may switch the nip separating portion from the nip separating location to the nip forming location as the photosensitive drum rotates.

The nip forming location may include a first nip forming location and a second nip forming location, the manipulation portion may switch the nip separating portion to the first and second nip forming locations and the nip separating location, and the nip forming unit may switch the nip separating portion from the nip separating location to the second nip forming location.

The developing cartridge may further include a nip control member including the manipulation portion and the nip separating portion, and the nip control member being provided on the developing unit to rotate to the nip separating location and to the nip forming location.

According to an aspect of an exemplary embodiment, an image forming apparatus includes: a main body; and the developing cartridge described above, attachable to and detachable from the main body.

The image forming apparatus may further include a first switching unit arranged in the main body and configured to interfere with the manipulation portion while the developing cartridge is installed in the main body so as to switch the nip separating portion from the nip forming location to the nip separating location.

The image forming apparatus may further include: a door configured to open and close an opening formed in the main body in order to attach the developing cartridge to the main body and detach the developing cartridge from the main body; and a first switching unit formed in the main body and configured to interfere with the manipulation portion in association with a closing operation of the door in order to switch the nip separating portion from the nip forming location to the nip separating location.

The nip forming location may include a first nip forming location and a second nip forming location, the nip forming unit may switch the nip separating portion from the nip separating location to the second nip forming location, and the main body may include a second switching unit for switching the nip separating portion from the second nip forming location to the nip separating location.

The main body may include a detection unit configured to detect a location of the nip separating portion.

According to an aspect of an exemplary embodiment, a developing cartridge includes a photosensitive unit comprising a photosensitive drum; a developing unit comprising a developing roller, where the photosensitive drum and the developing roller contact each other to form a developing nip, and separate from each other to remove the developing nip; an elastic member configured to apply an elastic force to the developing unit and the photosensitive unit in a direction of rotating toward contacting each other; and a nip control unit including: a nip separation member including a nip separating portion and a manipulation portion configured to move the nip separating portion to a nip forming location to form the developing nip and to a nip separating location to remove the developing nip by a manual manipulation, and a nip forming unit configured to move the nip separating portion from the nip separating location to the nip forming location as the photosensitive unit and the developing unit start to operate, wherein the nip forming unit including: a gear to rotate with the developing roller; and a nip forming member comprising a cam gear portion to engage with the gear at the nip separating location and to separate from the gear at the nip forming location, wherein the nip forming member is connected to the nip separation member.

According to an aspect of an exemplary embodiment, a developing cartridge includes a photosensitive unit comprising a photosensitive drum; a developing unit including a developing roller, where the photosensitive drum and the developing roller contact each other to form a developing nip, and separate from each other to remove the developing nip; an elastic member configured to apply an elastic force to the developing unit and the photosensitive unit in a direction of rotating toward contacting each other; and a nip control unit including: a nip control member including a body supported by the developing unit to be rotatable, nip separating portion protruding from the body, and a manipulation portion extending from the body to an outer portion of the development cartridge, wherein the nip control member is manually rotatable to a first nip forming location to form the developing nip and is manually rotatable to a nip separating location to remove the developing nip, and wherein the nip control unit is configured to rotate the nip control member from the nip separating location to a second nip forming location when the photosensitive unit and the developing unit start to operate.

BRIEF DESCRIPTION OF THE DRAWINGS

These and/or other aspects will become apparent and more readily appreciated from the following description of exemplary embodiments, taken in conjunction with the accompanying drawings in which.

DETAILED DESCRIPTION

Figure 1:
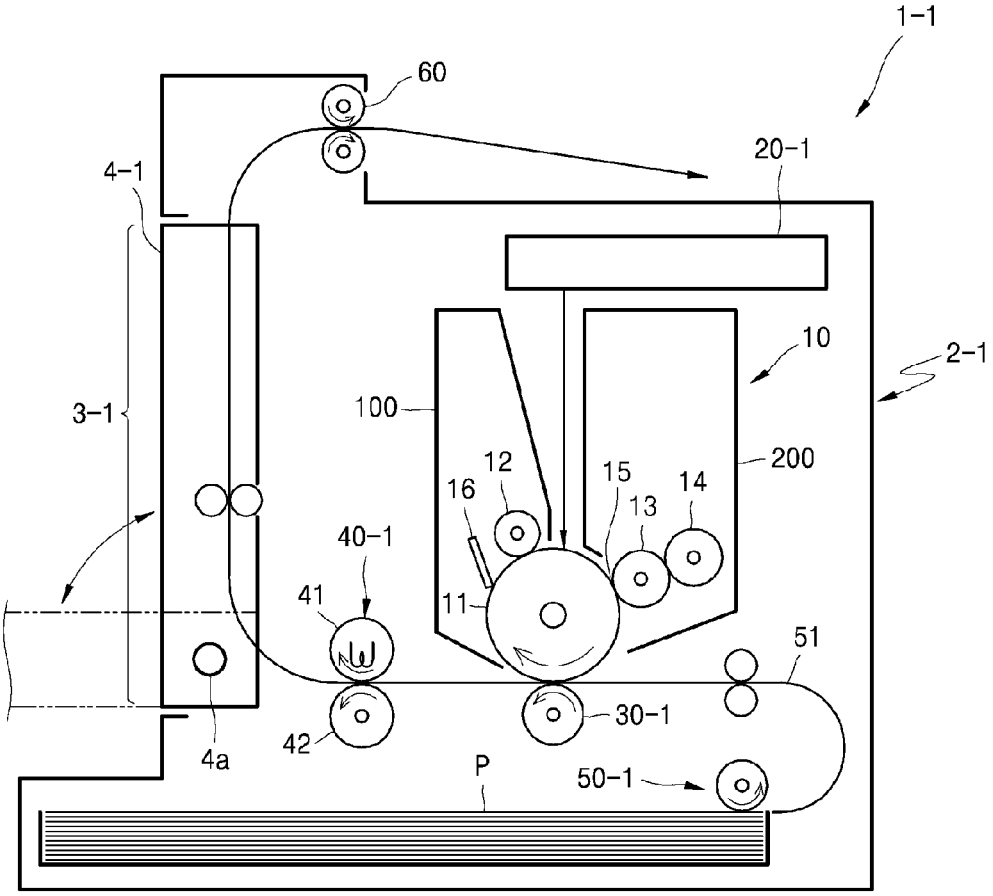
FIG. 1 is a schematic diagram of an image forming apparatus according to an exemplary embodiment.

Reference will now be made in detail to exemplary embodiments, examples of which are illustrated in the accompanying drawings, wherein like reference numerals refer to like elements throughout. In this regard, an exemplary embodiments may have different forms and should not be construed as being limited to the descriptions set forth herein. Accordingly, exemplary embodiments are merely described below, by referring to the figures, to explain aspects of exemplary embodiments. As used herein, the term "and/or" includes any and all combinations of one or more of the associated listed items. Expressions such as "at least one of," when preceding a list of elements, modify the entire list of elements and do not modify the individual elements of the list.

(Image Forming Apparatus)

FIG. 1 is a schematic diagram of an image forming apparatus 1-1. The image forming apparatus 1-1 according to an exemplary embodiment prints an image in a single color, e.g., black, on a recording medium P by using an electrophotographic method.

Referring to FIG. 1, the image forming apparatus 1-1 may include a developing device 10, an exposure unit 20-1, a transfer unit 30-1, a fuser 40-1, and a feed unit 50-1.

The developing device 10 includes a photosensitive drum 11. The photosensitive drum 11 according to an exemplary embodiment is formed as a cylinder having a surface on which a photosensitive layer is formed, but is not limited thereto. A charging roller 12 charges the photosensitive drum 11 to have a uniform surface potential. A charging brush or a corona charger may be used instead of the charging roller 12. A developing roller 13 supplies toner in the developing device 10 onto the photosensitive drum 11.

The developing device 10 may further include a charging roller cleaner (not shown) for removing a developing agent or dust from the charging roller 12, a cleaning member 16 for removing a developing agent remaining on the photosensitive drum 11 after a transfer process that will be described later, and a regulating member (not shown) for regulating an amount of the toner supplied to a developing region, in which the photosensitive drum 11 and the developing roller 13 face each other, the toner being supplied by the developing roller 13.

In a case of employing a two-component developing method, the toner and a magnetic carrier are accommodated in the developing device 10, and the developing roller 13 is spaced away from the photosensitive drum 11 by a distance of tens to hundreds of microns. Although not illustrated, the developing roller 13 may be a magnetic roller, in which a magnetic roller is disposed in a developing sleeve. The toner is attached to a surface of the magnetic carrier. The magnetic carrier is attached to a surface of the developing roller 13 and transported to the developing area in which the photosensitive drum 11 and the developing roller 13 face each other. Only the toner is supplied to the photosensitive drum 11 due to a developing bias voltage applied between the developing roller 13 and the photosensitive drum 11 so that an electrostatic latent image formed on the surface of the photosensitive drum 11 may be developed into a visible toner image. The developing roller 13 may rotate away from the photosensitive drum 11 by a distance of tens to hundreds of microns. In the case of employing the two-component developing method, the developing device 10 may further include an agitating/transporting member for mixing and agitating the toner with the carrier in the developing device 10 and transporting the mixed and agitated toner and the carrier to the developing roller 13.

In a case of employing a mono-component developing method in which the magnetic carrier is not used, the toner is accommodated in the developing device 10, and the developing roller 13 may be spaced away from the photosensitive drum 11 by a distance of tens to hundreds microns (mono-component non-contact developing method) or may contact the photosensitive drum 11 (mono-component contact developing method). In an exemplary embodiment, the mono-component contact developing method is used.

Figure 2:
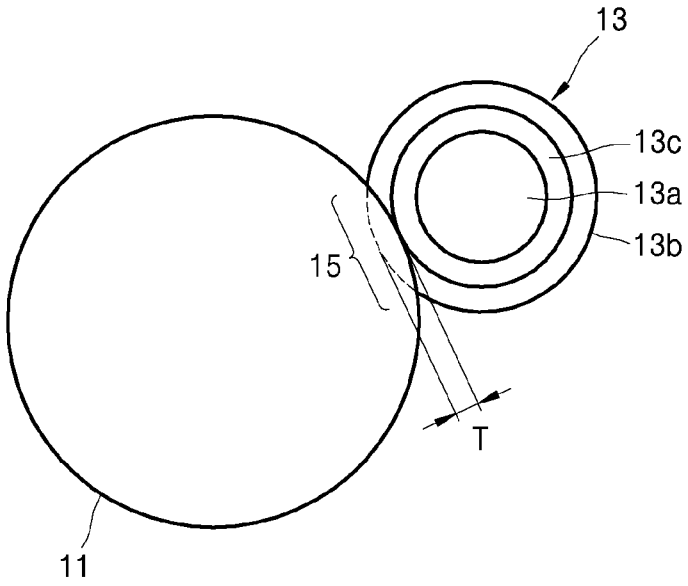
FIG. 2 is a diagram showing an arrangement of a photosensitive drum and a developing roller in a contact developing method.

FIG. 2 is a diagram showing arrangements of the photosensitive drum 11 and the developing roller 13 in the contact developing method. Referring to FIG. 2, the developing roller 13 contacts the photosensitive drum 11 to form a developing nip 15. The developing roller 13 may include a rotary shaft 13*a*, and an elastic layer 13*b* formed around the rotary shaft 13*a*. The elastic layer 13*b* is elastically deformed when contacting the photosensitive drum 11, thereby forming the developing nip 15. In order to regulate a contact amount T between the developing roller 13 and the photosensitive drum 11, gap maintenance members 13*c* having a diameter that is less than that of the developing roller 13 may be provided at opposite ends of the rotary shaft 13*a*. The gap maintenance members 13*c* contact the surface of the photosensitive drum 11 to regulate the contact amount T of the developing roller 13 with respect to the photosensitive drum 11. The developing device 10 may further include a supply roller 14 for attaching toner to the surface of the developing roller 13. A supply bias voltage may be applied to the supply roller 14. The developing device 10 may further include an agitator (not shown) that agitates the toner to supply the toner toward the developing roller 13. The agitator may agitate and triboelectrically charge the toner. The toner is attached to the surface of the developing roller 13 by an electrostatic force and transported to the developing nip 15 where the photosensitive drum 11 and the developing roller 13 face each other. The toner is supplied to the photosensitive drum 11 by a developing bias voltage applied between the developing roller 13 and the photosensitive drum 11, and then develops an electrostatic latent image formed on the surface of the photosensitive drum 11 into a visible toner image.

The exposure unit 20-1 emits light that is modulated in correspondence with image information, to the photosensitive drum 11 to form an electrostatic latent image on the photosensitive drum 11. A laser scanning unit (LSU) that uses a laser diode as a light source or an exposure unit that uses a light emitting diode (LED) as a light source may be used as the exposure unit 20-1.

The transfer unit 30-1 transfers the toner image developed on the photosensitive drum 11 onto the recording medium P. A transfer roller that is disposed to face the photosensitive drum 11 may be used as the transfer unit 30-1. A transfer bias voltage is applied to the transfer roller. A transfer device such as a corona transfer device or a pin scorotron type transfer device may be used, instead of the transfer roller.

The fuser 40-1 applies heat and pressure to the toner image transferred to the recording medium P to fix the toner image to the recording medium P. The fuser 40-1 may include a heating member 41 and a compressing member 42. Referring to FIG. 1, the heating member 41 and the compressing member 42 are roller type members that compress and contact each other to form a fusing nip. The shape of the fuser 40-1 is not limited to the example shown in FIG. 1. When the recording medium P passes through the fusing nip, the toner image is fused and fixed to the recording medium P due to the heat and pressure.

When a printing command is transmitted from a host (not shown), a controller (not shown) charges the surface of the photosensitive drum 11 to a constant potential by using the charging roller 12. The exposure unit 20-1 irradiates a light beam that is modulated corresponding to image information to be printed to the photosensitive drum 11 so as to form an electrostatic latent image on the photosensitive drum 11. The developing roller 13 supplies the toner to the photosensitive drum 11 to develop the electrostatic latent image into a visible toner image. The feed unit 50-1 transports the recording medium P to the transfer nip formed by the transfer roller and the photosensitive drum 11 along with a paper feeding path 51. The toner image on the photosensitive drum 11 is transferred onto the recording medium P due to the transfer bias voltage applied to the transfer roller. When the recording medium P passes through the fuser 40-1, the toner image is fixed on the recording medium P due to heat and pressure. The recording medium P on which the toner image has fixed is discharged to outside by a discharge roller 60.

The developing device 10 is replaced when all the toner contained therein is consumed. The image forming apparatus 1-1 includes a main body 2-1 including an opening 3-1, and a door 4-1 for opening and closing the opening 3-1. The door 4-1 may pivot about, for example, a hinge 4*a*, to open and close the opening 3-1. The developing device 10 may be attached to or detached from the main body 2-1 via the opening 3-1. Hereinafter, the developing device 10 that may be replaceable is referred to as a developing cartridge 10.

In the contact developing method, image quality is largely dependent on a variation of the developing nip 15. When the image forming apparatus 1-1 is provided to a user, the developing cartridge 10 may be provided in a state where the photosensitive drum 11 and the developing roller 13 contact each other. It may take a long time from when manufacturing of the image forming apparatus 1-1 has been completed for a user to purchase the image forming apparatus 1-1 and install the developing cartridge 10 in the main body 2-1 of the image forming apparatus 1-1. During the above time period, the developing roller 13 may be deformed and the developing nip 15 may be deformed. Also, the photosensitive layer of the photosensitive drum 11 may be damaged. In addition, the toner existing on the developing nip 15 may be fixed on the developing roller 13 or the photosensitive drum 11.

To address the above issues, the developing cartridge 10 may be separately packaged from the main body 2-1 of the image forming apparatus 1-1 to be provided to the user in a state where the developing roller 13 is spaced away from the photosensitive drum 11, and the developing roller 13 and the photosensitive drum 11 may contact each other to form the developing nip 15 when the user installs the developing cartridge 10 in the main body 2-1. However, in this case, the main body 2-1 and the developing cartridge 10 may be separately packaged and distributed, and thus, logistics costs may increase. Also, the user has to manipulate the developing cartridge 10 to form the developing nip 15 before installing the developing cartridge 10 in the main body 2-1, and thus, the user may feel inconvenience when using the image forming apparatus 1-1. Also, if the user installs the developing cartridge 15 in the main body 2-1 without forming the developing nip 15, it is impossible to print images. Therefore, a process that the user checks whether the developing nip 15 is formed or whether the manipulation for forming the developing nip 15 is performed and a process of letting the user perform the manipulation for forming the developing nip 15 by isolating the developing cartridge 10 from the main body 2-1 if the developing nip 15 is not formed are necessary in control processes of the image forming apparatus 1-1, and thus, the processes of controlling the image forming apparatus 1-1 may be complicated. Also, if the user who is not accustomed to the image forming apparatus 1-1 does not understand the processes of checking the developing nip 15 and forming the developing nip 15 according to the processes of controlling the image forming apparatus 1-1, the user may think that the image forming apparatus 1-1 is broken.

(Developing Cartridge)

The developing cartridge 10 includes a nip control unit capable of isolating and forming the developing nip 15. According to the nip control unit of an exemplary embodiment, the developing nip 15 may be separated according to a manual manipulation of the user, and when the developing cartridge 10 is installed in the main body 2-1 and the image forming apparatus 1-1 is driven, the developing nip 15 may be formed.

Figure 3:
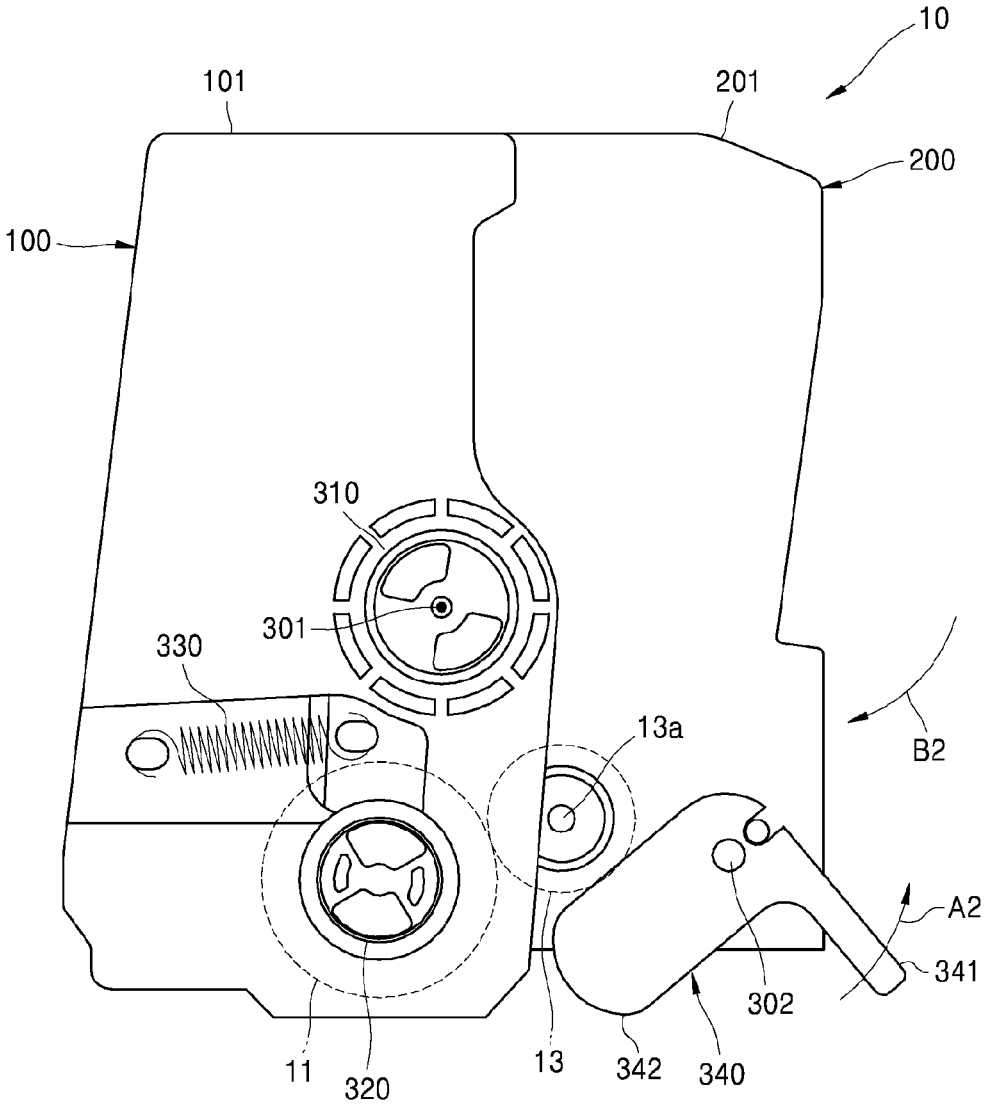
FIG. 3 is a side view of a developing cartridge according to an exemplary embodiment.

FIG. 3 is a side view of the developing cartridge 10 according to an exemplary embodiment. Referring to FIGS. 1 and 3, the developing cartridge 10 includes a photosensitive unit 100 and a developing unit 200. The photosensitive unit 100 includes a first housing 101, and the photosensitive drum 11 supported by the first housing 101. The developing unit 200 includes a second housing 201, and the developing roller 13 supported by the second housing 201. The photosensitive unit 100 and the developing unit 200 may be connected to each other so as to rotate between a developing location (FIG. 3) where the photosensitive drum 11 and the developing roller 13 contact each other to form the developing nip 15, and a non-developing location (FIG. 4) where the photosensitive drum 11 and the developing roller 13 are separate from each other so that the developing nip 15 is removed. For example, the photosensitive unit 100 and the developing unit 200 may be connected to rotate between the developing location and the non-developing location about a hinge shaft 301. In the image forming apparatus 1-1, the photosensitive drum 11 is related to a location of the transfer roller 30-1, and thus, when the developing cartridge 10 is installed in the main body 2-1, the location of the photosensitive drum 11 is fixed. Therefore, the developing unit 200 is coupled to the photosensitive unit 100 to rotate about the hinge shaft 301. However, one or more exemplary embodiments are not limited thereto, that is, the developing unit 200 may be located at a fixed location in the main body 2-1 and the photosensitive unit 100 may be coupled to the developing unit 200 to be rotatable about the hinge shaft 301.

An elastic member 330 provides an elastic force to the developing unit 200 and the photosensitive unit 100 so that the developing unit 200 and the photosensitive unit 100 rotate in a direction of forming the developing nip 15, that is, in a direction toward the developing location. The developing unit 200 rotates about the hinge shaft 301 due to the elastic force of the elastic member 330 so that the developing roller 13 contacts the photosensitive drum 11, and accordingly, the developing nip 15 is formed as shown in FIG. 2. FIG. 3 shows a tensile coil spring having an end portion and the other end portion that are respectively supported by the photosensitive unit 200 and the developing unit 100 as an example of the elastic member 330, but the elastic member 330 is not limited thereto. For example, members of various shapes such as a torsion coil spring, a plate spring, etc., may be used as the elastic member 330.

Driving elements of the developing cartridge 10, e.g., the photosensitive drum 11, the charging roller 12, the developing roller 13, the supply roller 14, and the agitator (not shown) may be driven in association with a driving connection portion (not shown) that is disposed in the main body 2-1 when the developing cartridge 10 is installed in the main body 2-1. For example, the developing cartridge 10 may include a coupler 310 that is connected to the driving connection portion (not shown) that is disposed in the main body 2-1 when the developing cartridge 10 is installed in the main body 2-1. The driving elements may be connected to the coupler 310 via a power connection unit that is not shown, e.g., a gear. The developing cartridge 10 may further include a coupler 320 that is connected to the driving connection portion (not shown) disposed in the main body 2-1 when the developing cartridge 10 is installed in the main body 2-1. In this case, the driving elements of the developing unit 200, e.g., the developing roller 13, the supply roller 14, the agitator (not shown), etc., may be driven in association with the coupler 310, and the driving elements of the photosensitive unit 100, e.g., the photosensitive drum 11 and the charging roller 12 may be driven in association with the coupler 320. The coupler 320 may be coaxially located with, for example, the rotational axis of the photosensitive drum 11. Although not illustrated in the drawings, the coupler 310 may be omitted, and the developing roller 13, the supply roller 14, and the agitator (not shown) may be connected to the coupler 320.

The hinge shaft 301 may be coaxial with, for example, the rotational axis of the coupler 310, but is not limited thereto. The hinge shaft 301 may be located at any location that the photosensitive unit 100 and the developing unit 200 rotate to separate/form the developing nip 15.

The nip control unit may include a nip separating portion switching between a nip forming location and a nip separating location, where the developing unit 200 are respectively located on the developing location and the non-developing location, a manipulation portion for switching the nip separating portion to the nip forming location and the nip separating location by a manual manipulation, and a nip forming unit for switching the nip separating portion from the nip separating location to the nip forming location when the photosensitive unit 100 and the developing unit 200 operate.

Figure 4:
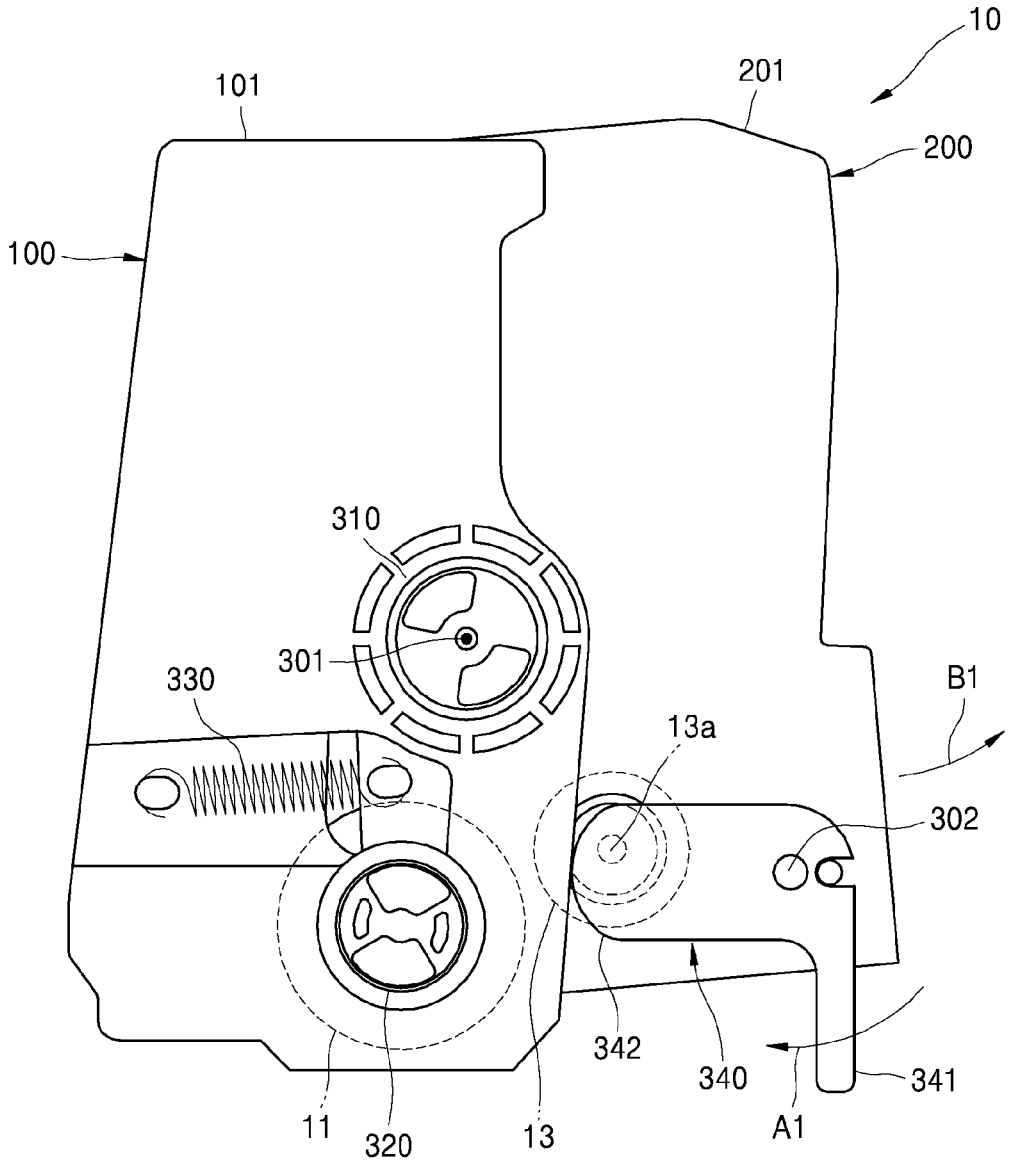
FIG. 4 is a diagram showing a state in which a nip separation member is located at a second position.

The developing nip 15 may be formed or removed by rotating the developing unit 200 about the hinge shaft 301. Referring to FIG. 3, the nip control unit includes a nip separation member 340 for removing the developing nip 15. The nip separation member 340 may be at a first location for forming the developing nip 15 and a second location for removing the developing nip 15. FIG. 3 shows a state where the nip separation member 340 is located at the first location. FIG. 4 shows a state where the separation member 340 is located at the second location. The nip separation member 340 may be provided on, for example, the second housing 201. The nip separation member 340 may be provided on the second housing 201 so as to rotate about the rotary shaft 302. The nip separation member 340 includes a manipulation portion 341 for providing a grip for a manual manipulation, and a nip separating portion 342 that is interfered with the photosensitive unit 100, e.g., the first housing 101, so as to push the photosensitive unit 100 when switching from the first location to the second location. The manipulation portion 341 is exposed to outside of the developing cartridge 10 when the nip separation member 340 is located at least on the first location, that is, when the nip separating portion 342 is located at the nip forming location (first nip forming location). As such, the user may easily access the manipulation portion 341.

By rotating the nip separation member 340 from the first location to the second location or from the second location to the first location, the nip separating portion 342 may be switched from the nip forming location (first nip forming location: FIG. 3) to the nip separating location (FIG. 4) or from the nip separating location to the nip forming location (first nip forming location) to control the developing nip 15. For example, when the nip separation member 340 located at the first location is rotated in a first direction (A1) to the second location as shown in FIG. 4, the nip separating portion 342 is switched from the nip forming location (first nip forming location) to the nip separating location and then pushes the first housing 101 so that the developing unit 200 is rotates about the hinge shaft 301 in a B1 direction, that is, a direction opposite to the direction in which the elastic force of the elastic member 330 is applied. Then, the developing roller 13 is separate from the photosensitive drum 11, and the developing nip 15 is removed. On the contrary, when the nip separation member 340 located at the second location is rotated in a second direction (A2) that is opposite to the first direction A1 to be switched to the first location shown in FIG. 3, the nip separating portion 342 is switched from the nip separating location to the nip forming location (first nip forming location) and is separate from the first housing 101 so that the developing unit 200 is rotated about the hinge shaft 301 in a B2 direction due to the elastic force of the elastic member 330. Then, the developing roller 13 contacts the photosensitive drum 11 to form the developing nip 15.

According to the above configuration, the developing nip 15 may be formed or removed by the manual manipulation of the user.

Figure 5:
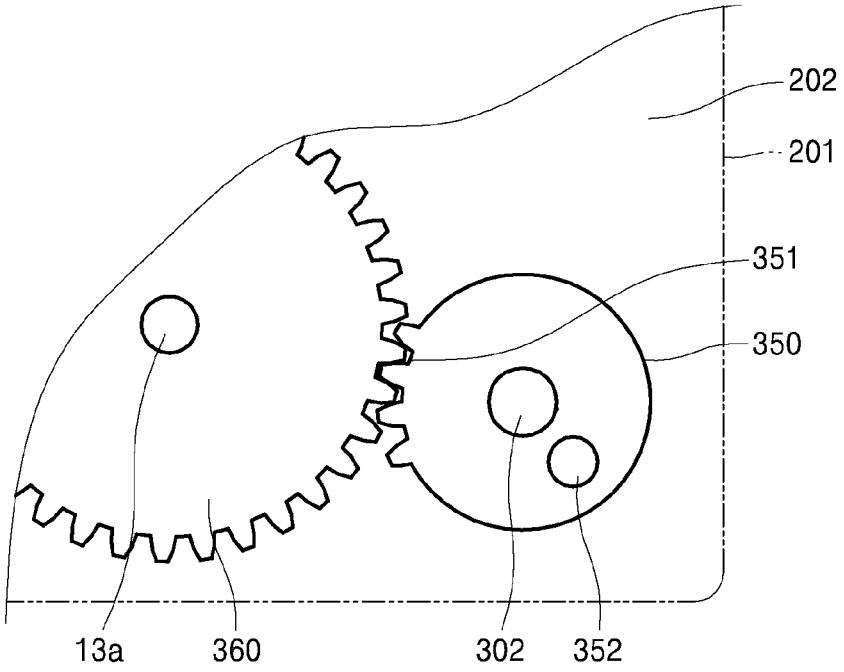
FIG. 5 is a partial side view of a developing cartridge according to an exemplary embodiment.

FIG. 5 is a partial side view of the developing cartridge 100. In FIG. 5, the nip separation member 340 is omitted. The nip control unit includes the nip forming member 350 that forms the developing nip 15 according to the operation of the image forming apparatus 1-1. The nip forming member 350 of an exemplary embodiment forms the developing nip 15 by rotating the nip separation member 340 from the second location to another location (third location), for example, a location rotated further in the first direction A1. Accordingly, the nip separating portion 342 is switched to the second nip forming location that is different from the first nip forming location.

The nip forming member 350 according to an exemplary embodiment may be located at inside of a side wall 202 of the second housing 201. The nip forming member 350 is provided to be rotated about, for example, the rotary shaft 302. The nip forming member 350 includes a cam gear portion 351. The cam gear portion 351 is a partial gear formed on a part of an outer circumference of the nip forming member 350. For example, a gear 360 is coupled to a rotary shaft 13*a* of the developing roller 13 to rotate the developing roller 13, and the cam gear portion 351 may be connected to the gear 360. When the developing cartridge 10 is installed in the main body 2-1, the driving connection portion (not shown) disposed in the main body 2-1 is connected to the coupler 310, and accordingly, the developing roller 13, the gear 360, and the nip forming member 350 may be rotated. The nip forming unit according to an exemplary embodiment for switching the nip separating portion 342 from the nip separating location to the second nip forming location may be implemented by using the gear 360 and the cam gear portion 351.

Figure 6:
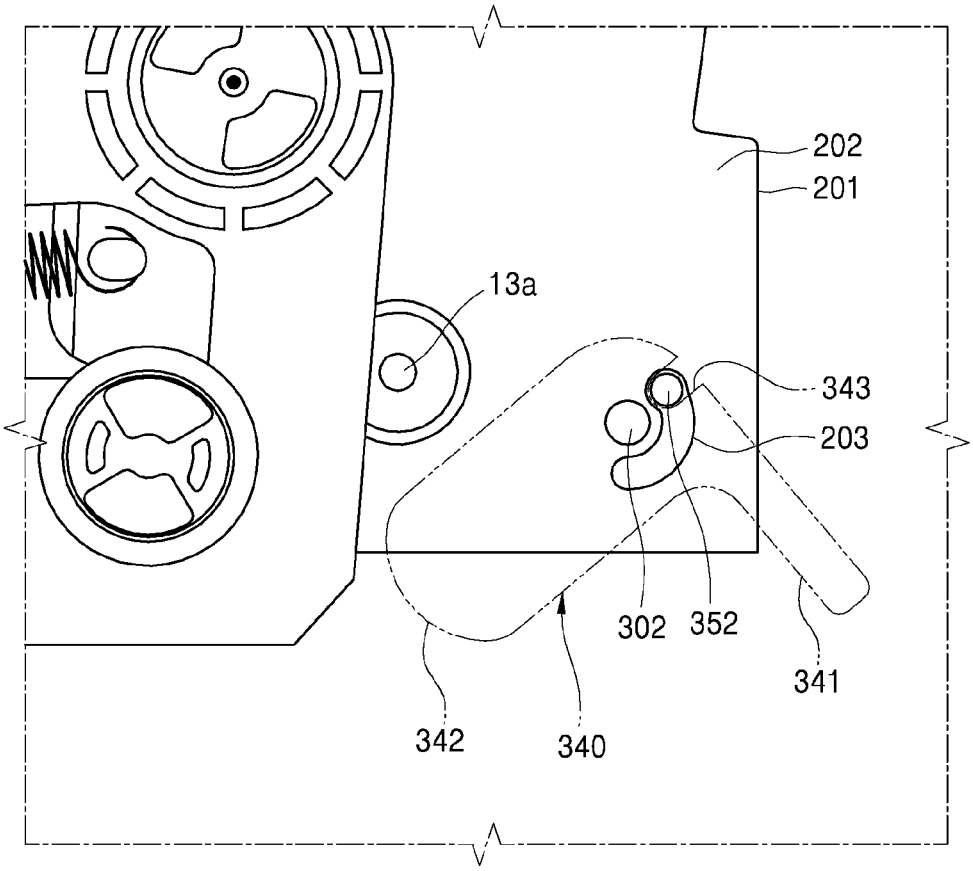
FIG. 6 is a side view of the developing cartridge of FIG. 5, showing a connecting relation between a nip forming member and a nip separation member.

The nip forming member 350 is connected to the nip separation member 340 and then may be rotated with the nip separation member 340 about the rotary shaft 302. FIG. 6 is a side view of the developing cartridge 10 of FIG. 5, and shows an example of the connection relation between the nip forming member 350 and the nip separation member 340. Referring to FIGS. 5 and 6, the nip forming member 350 includes a protrusion portion (first connection portion) 352 that protrudes to outer portion of the side wall 202 via a slot 203 formed in the side wall 202. The nip separation member 340 includes an insertion portion (second connection portion) 343 to which the protrusion portion 352 protruding through the slot 203 is inserted. The slot 203 may be formed while taking a rotating trace of the protrusion portion 352 when the nip forming member 350 is rotated into account. According to the above configuration, the nip forming member 350 and the nip separation member 340 may be rotated together with each other about the same rotary shaft, e.g., the rotary shaft 302. Otherwise, the protrusion portion 352 may be formed on the nip separation member 340 and the insertion portion 343 may be formed in the nip forming member 350.

Figure 7A:
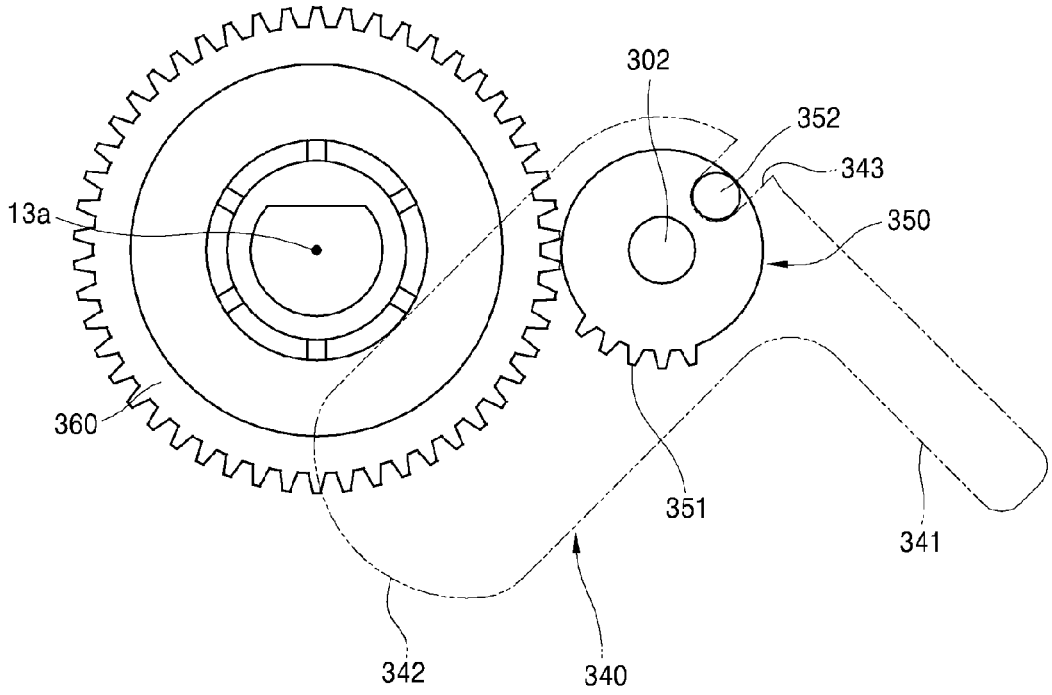
FIG. 7A is a diagram showing a state in which a nip separation member is located at a first position and a nip separating portion is located on a first nip forming location.
Figure 7B:
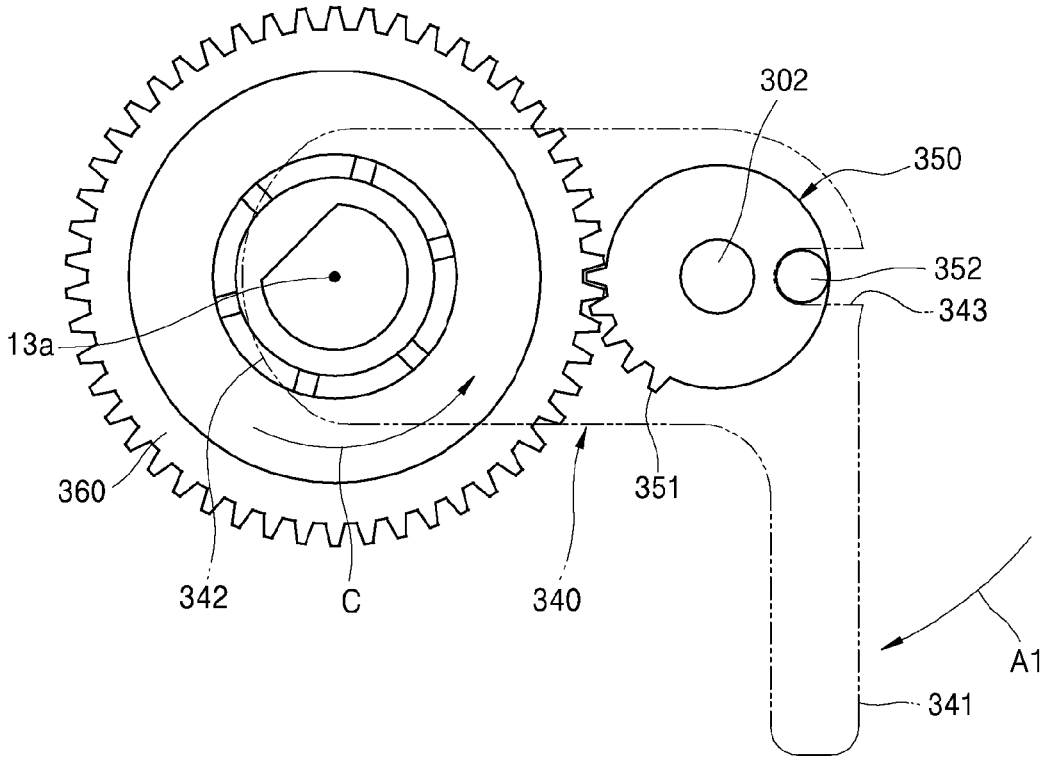
FIG. 7B is a diagram showing a state in which a nip separation member is located at a second position and a nip separating portion is located at a nip separating location.
Figure 7C:
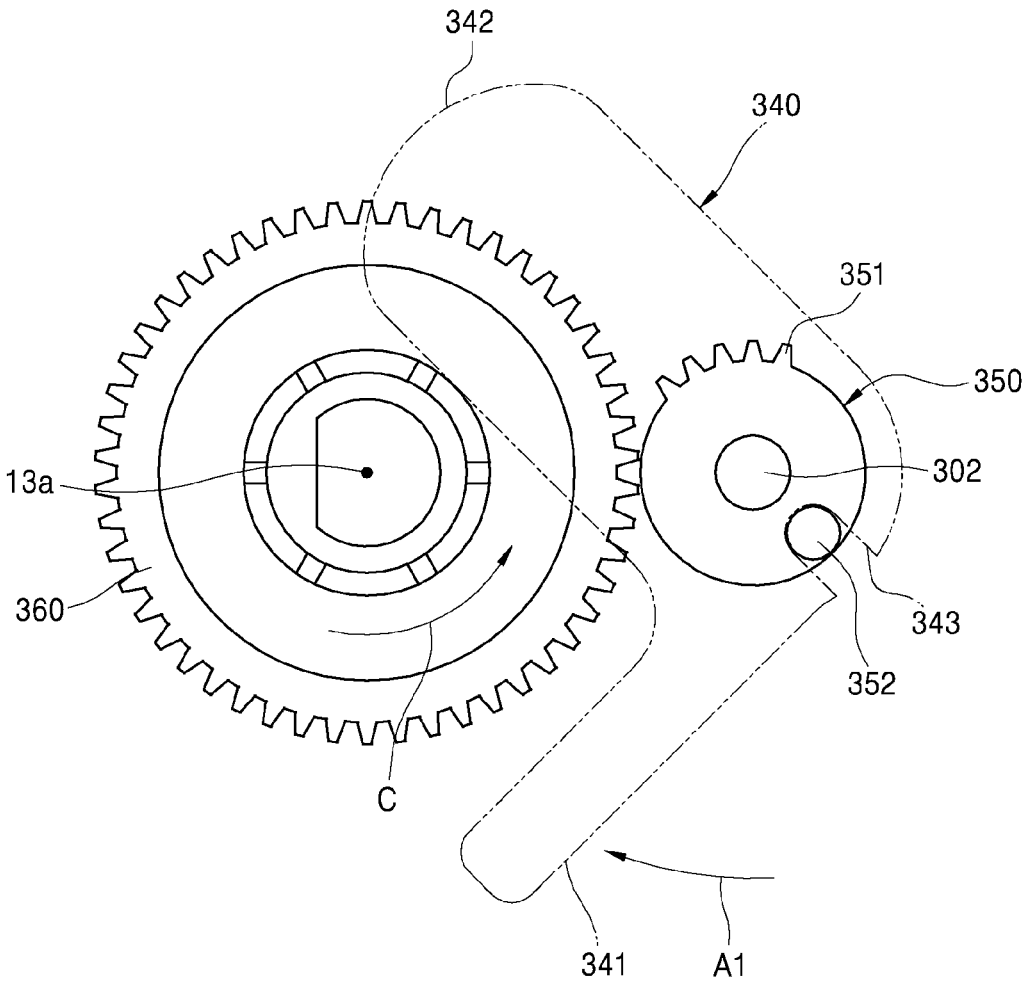
FIG. 7C is a diagram showing a state in which a nip separation member is located at a third position and a nip separating portion is located at a second nip forming location.

FIGS. 7A, 7B, and 7C are diagrams showing relations between locations of the nip forming member 350 and the nip separation member 340, and a state of the developing nip 15. FIG. 7A shows a state where the nip separation member 340 is located at the first location and the nip separating portion 342 is located at the first nip forming location, FIG. 7B shows a state where the nip separation member 340 is located at the second location and the nip separating portion 342 is located at the nip separating location, and FIG. 7C shows a state where the nip separation member 340 is located at the third location and the nip separating portion 342 is located at the second nip forming location.

Referring to FIG. 7A, the nip separation member 340 is located at the first location and the nip separating portion 342 is located at the first nip forming location. Here, the cam gear portion 351 of the nip forming member 350 is disconnected from the gear 360 and located at a releasing location. Even when the developing cartridge 10 is installed in the main body 2-1 and the developing roller 13 is rotated in the above state, the cam gear portion 351 and the gear 360 are disconnected from each other, and thus, a driving force of the main body 2-1 is not transferred to the nip forming member 350. Therefore, the nip forming member 350 and the nip separation member 340 are not rotated. As described above, the developing roller 13 contacts the photosensitive drum 11 and the forming state of the developing nip 15 is maintained.

When the nip separation member 340 is rotated in the first direction A1 to be located at the second location through the manual manipulation as shown in FIG. 7B, the nip separating portion 342 is located at the nip separating location, but the nip separation member 340 and the nip forming member 350 are connected to each other by the insertion portion 343 and the protrusion portion 352. Thus, when the nip separation member 340 is rotated in the first direction A1, the nip forming member 350 is also rotated in the first direction A1 with the nip separation member 340. When the nip separation member 340 reaches the second location, the cam gear portion 351 of the nip forming member 350 is located at a connection location where the cam gear portion 351 is connected to the gear 360. As described above, the developing roller 13 is separate from the photosensitive drum 11 by the nip separating portion 342, and the developing nip 15 is removed.

In a state shown in FIG. 7B, when the developing cartridge 10 is installed in the main body 2-1 and the developing roller 13 is rotated in a processing direction C, the nip forming member 350 is rotated in an opposite direction to the processing direction C, that is, the first direction A1, because the gear 360 and the cam gear portion 351 are connected to each other. Since the nip separation member 340 and the nip forming member 350 are connected to each other via the insertion portion 343 and the protrusion portion 352, when the nip forming member 350 is rotated in the first direction A, the nip separation member 340 is rotated in the first direction A1 beyond the second location. Accordingly, the nip separating portion 342 is gradually separate from the first housing 101, and the developing unit 200 is rotated in the B2 direction, that is, a direction in which the developing roller 13 approaches to the photosensitive drum 11, about the hinge shaft 301 by the elastic force of the elastic member 330.

As shown in FIG. 7C, when the cam gear portion 351 is located at a second releasing location on which the engagement between the cam gear portion 351 and the gear 360 is finished, the nip separating portion 342 is located at the second nip forming location. Even when the developing roller 13 rotates, the nip forming member 350 does not rotate further, and the nip separation member 340 also stops rotating and reaches the third location. The developing roller 13 contacts the photosensitive drum 11 to form the developing nip 15.

According to the above described nip control unit, the nip separation member 340 may be switched to the first location and to the second location by using the manipulation portion 341 to form and separate the developing nip 15 via the manual manipulation. Also, in a state where the nip separation member 340 is located at the second location to remove the developing nip 15, when the developing cartridge 10 is installed in the main body 2-1 and the image forming apparatus 1-1 is driven, the nip forming member 350 is rotated in association with the rotation of the developing roller 13 to make the nip separation member 340 rotate to the third location and to form the developing nip 15. Therefore, the developing cartridge 10 may be installed in the main body 2-1 and packaged in a state where the developing nip 15 is not formed, and thus, packaging costs and logistics costs may be reduced. Also, since the developing nip 15 is formed when driving the image forming apparatus 1-1, the user who has purchased the image forming apparatus 1-1 does not need to perform all the processes of separating the developing cartridge 10 from the main body 2-1, manipulating the nip separation member 340 to form the developing nip 15, and installing the developing cartridge 10 in the main body 2-1 again. Therefore, the user's convenience may be improved.

(First Switching Unit)

Figure 8:
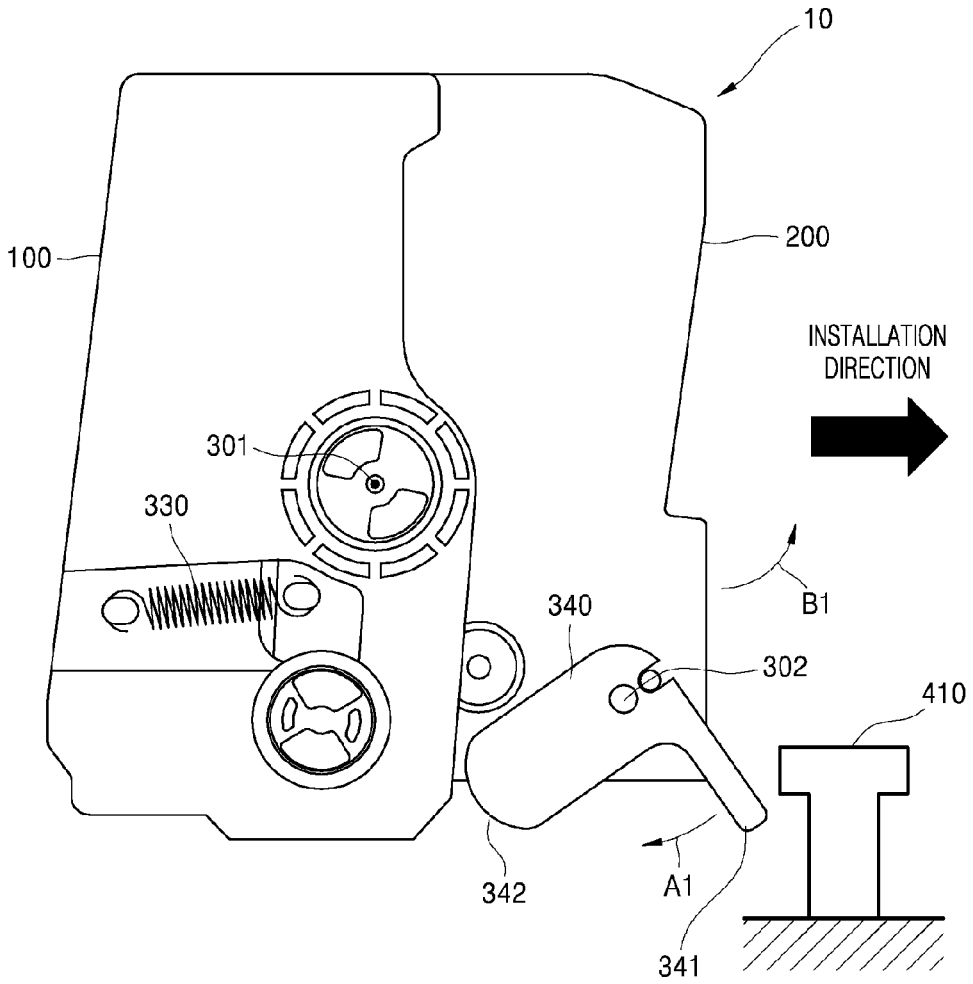
FIGS. 8 and 9 are diagrams showing examples of a first switching unit that operates a nip separation member when a developing cartridge is attached to a main body to release a developing nip.
Figure 9:
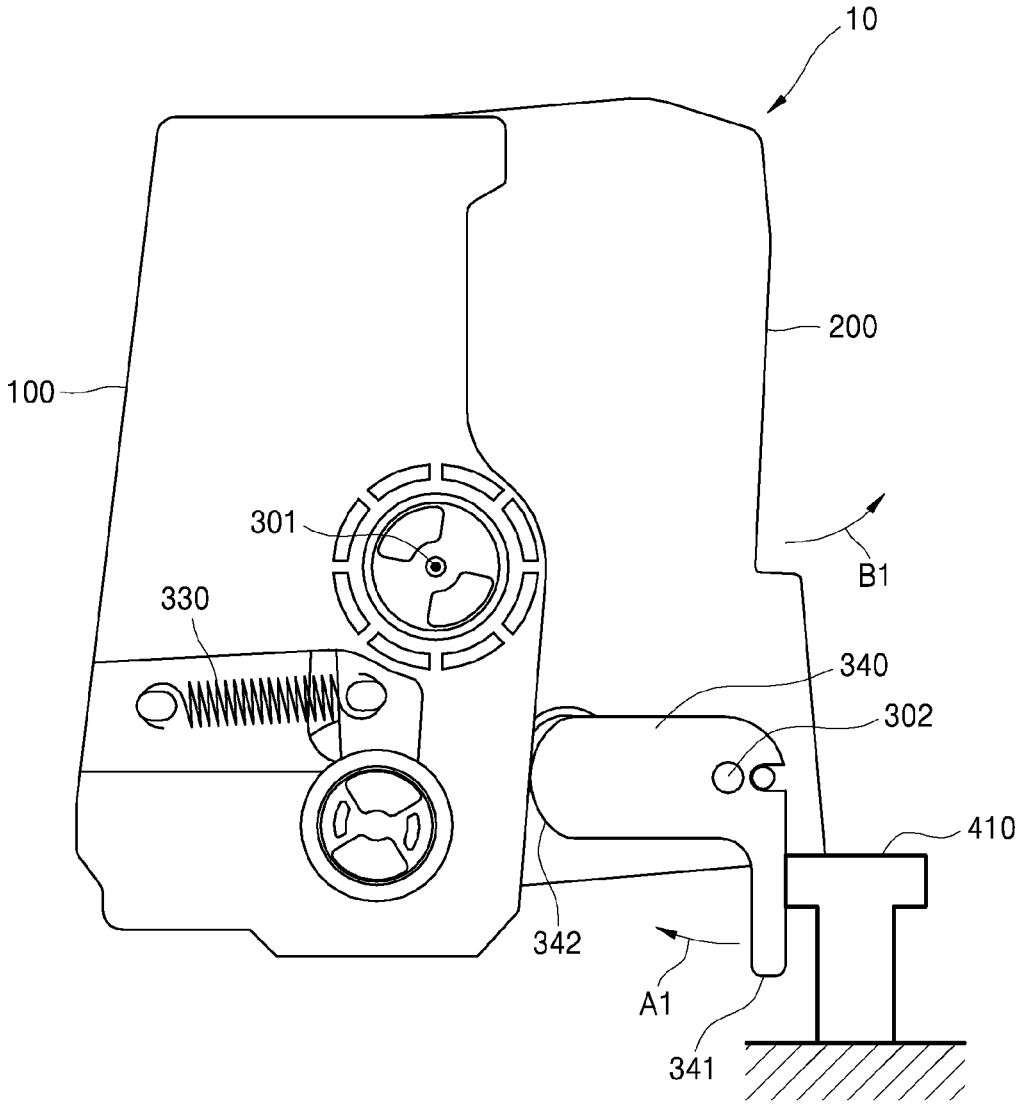

While the developing cartridge 10 in which the developing nip 15 is formed is installed in the main body 2-1, the developing nip 15 may be removed. For example, when the developing cartridge 10 is installed in the main body 2-1, the nip separation member 340 located at the first location may be switched to the second location. As such, the nip separating portion 342 may be switched from the first nip forming location to the nip separating location, and then, the developing nip 15 may be removed. FIGS. 8 and 9 are diagrams showing a first switching unit that operates the nip separation member 340 when the developing cartridge 10 is installed in the main body 2-1 to remove the developing nip 15, according to an exemplary embodiment.

Referring to FIG. 8, the first switching unit includes a switching member 410 disposed in the main body 2-1. When the developing cartridge 10 is installed in the main body 2-1, the nip separation member 340 located at the first location is interfered with the switching member 410. For example, the manipulation portion 341 of the nip separation member 340 is interfered with the switching member 410. Since the switching member 410 is fixed at a location, the nip separation member 340 is pushed by the switching member 410 to be rotated in the first direction A1 as the developing cartridge 10 is inserted to the main body 2-1 in an installation direction denoted in FIG. 8. The nip separating portion 342 pushes the photosensitive unit 100, and accordingly, the developing unit 200 is rotated in the B1 direction and the developing roller 13 starts to be separate from the photosensitive drum 11.

As shown in FIG. 9, when the installation of the developing cartridge 10 in the main body 2-1 is finished, the nip separation member 340 reaches the second location and the developing roller 13 is completely separate from the photosensitive drum 11 as shown in FIG. 4 to remove the developing nip 15.

The developing nip 15 may be removed by operations of installing the developing cartridge 10 in the main body 2-1 and closing the door 4-1. That is, the first switching unit may switch the nip separation member 340 that has been located at the first location to the second location through a closing operation of the door 4-1.

Figure 10:
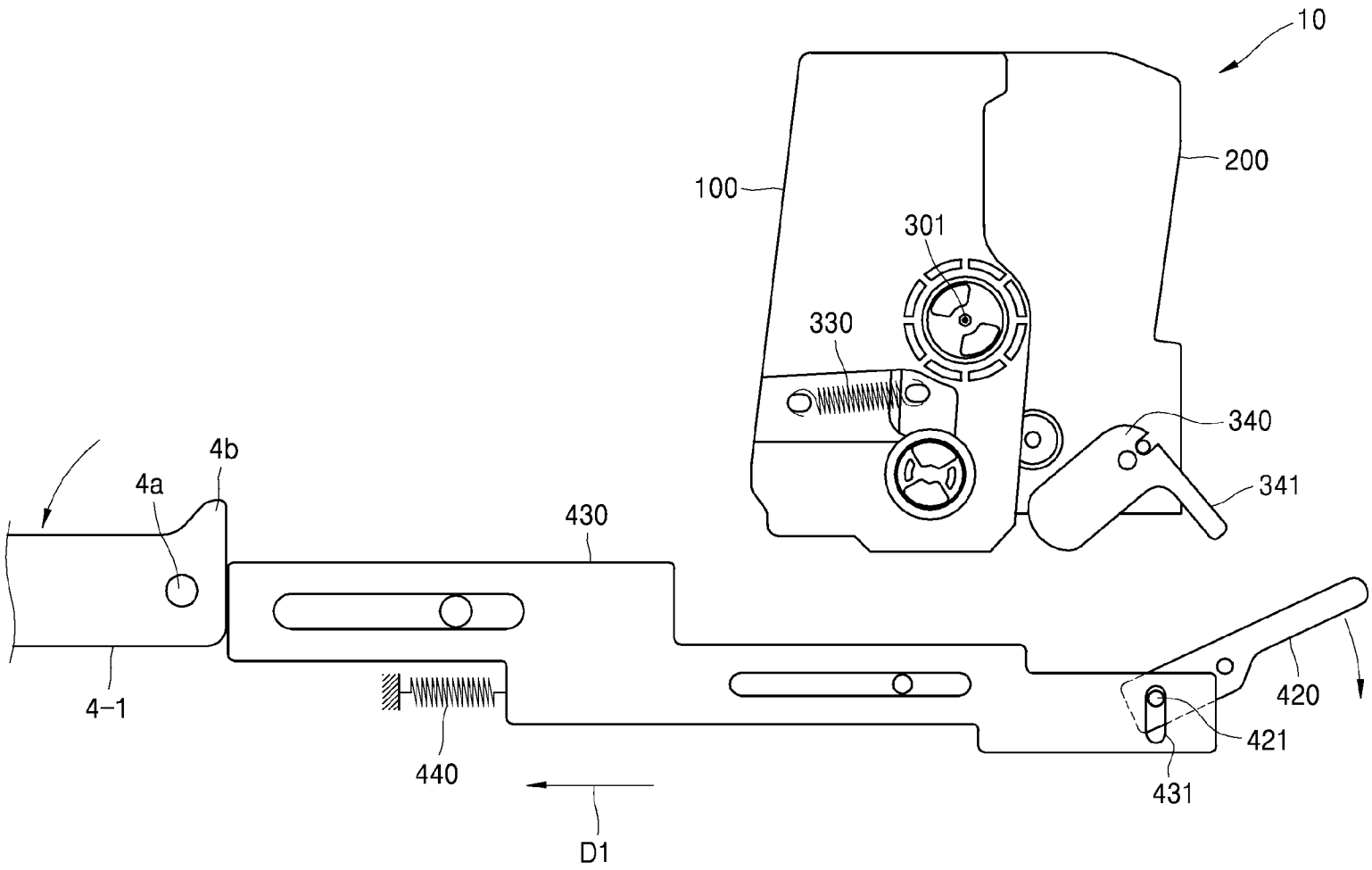
FIGS. 10 and 11 are diagrams showing an example of a first switching unit for switching a nip separation member from a first position to a second position in association with a closing operation of a door.
Figure 11:
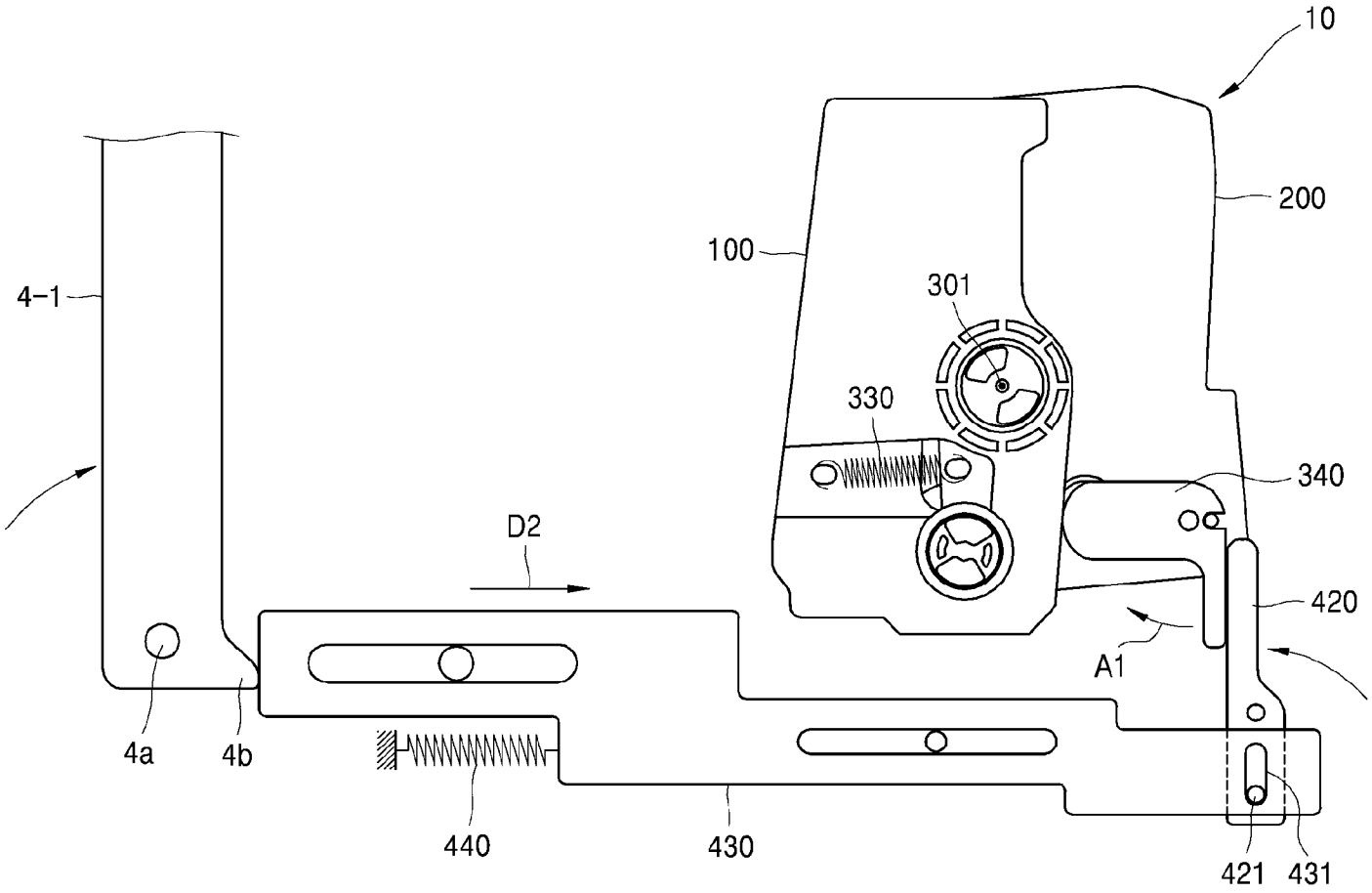

FIGS. 10 and 11 are diagrams showing a first switching unit for switching the nip separation member 340 from the first location to the second location in association with the closing operation of the door, according to an exemplary embodiment. FIG. 10 shows a state where the nip separation member 340 is located at the first location, and FIG. 11 shows a state where the nip separation member 340 is located at the second location. Referring to FIGS. 10 and 11, the first switching unit includes a switching member 420 that moves to an escape location where the switching member 420 is not interfered with by the nip separation member 340 and to a switching location where the switching member 420 switches the nip separation member 340 from the first location to the second location, in association with an opening operation and a closing operation of the door 4-1. For example, the switching member 420 may be provided on the main body 2-1 to be rotated between the escape location and the switching location. The door 4-1 and the switching member 420 may be connected to each other via a connection member 430. The connection member 430 may be provided on the main body 2-1 to be slidable. A slot 431 is formed in an end portion of the connection member 430, and a pin 421 that is formed on the switching member 420 is inserted to the slot 431. When the connection member 430 slides in a direction D1 shown in FIG. 10, the switching member 420 is rotated to the escape location. When the connection member 430 slides in a direction D2 shown in FIG. 11, the switching member 420 is rotated to the switching location. A cam portion 4*b* is formed on the door 4-1 for pushing the connection member 430 toward the direction D2 when the door 4-1 is closed. A spring 440 applies an elastic force to the connection member 430 to be slid in a direction for rotating the switching member 420 to the escape location.

When the door 4-1 is opened, the connection member 430 slides in the direction D1 due to the elastic force of the spring 440, and the switching member 420 is rotated to the escape location as shown in FIG. 10. The switching member 420 is not interfered with the nip separation member 340 while the nip separation member 340 inserts the developing cartridge 10 located at the first location into the main body 2-1. When the developing cartridge 10 is completely inserted to the main body 2-1 and the door 4-1 is closed, the connection member 430 slides in the direction D2 due to the cam portion 4*b*. Then, the switching member 420 makes the nip separation member 340 rotate in the first direction A1 while rotating to the switching location. For example, the switching member 420 rotates the nip separation member 340 to the second location while rotating in contact with the manipulation portion 341. When the door 4-1 is completely closed, the switching member 420 is located at the switching location as shown in FIG. 11, and the developing roller 13 is separated from the photosensitive drum 11 by the nip separation member 340 to remove the developing nip 15.

While the nip separation member 340 is switched from the first location to the second location in association with the operation of closing the door 4-1, the nip forming member 350 is switched from the releasing location to the connecting location as shown in FIGS. 7A and 7B.

As described above, the developing nip 15 is removed during the process of installing the developing cartridge 10 in the main body 2-1. Therefore, during the manufacturing processes, it is not necessary for checking whether the developing nip 15 is formed before installing the developing cartridge 10 in the main body 2-1 after performing tests before release, and thus, manufacturing costs may be reduced. Also, since the developing nip 15 is in an unformed state, even if the developing cartridge 10 is installed in the main body 2-1 for a long time after being released to the market until being sold, the developing roller 13 and the photosensitive drum 11 may not be deformed or damaged.

During the process of switching the nip separation member 340 from the first location to the second location in association with the operation of installing the developing cartridge 10 in the main body 2-1 or the operation of closing the door 4-1, the cam gear portion 351 is switched from the releasing location to the connecting location as shown in FIGS. 7A and 7B. Therefore, when the image forming apparatus 1-1 starts to operate, the nip separation member 340 is switched to the third location as shown in FIG. 7C by the nip forming unit, that is, the gear 360 and the cam gear portion 351, and thereby forming the developing nip 15.

(Second Switching Unit)

While the image forming apparatus 1-1 operates, the developing roller 13 may be separate from the photosensitive drum 11 if there is no need to perform the developing operation. For example, during a time period from a time when an end portion of the toner image has passed through a region where the developing roller 13 and the photosensitive drum 11 face each other to a time when the recording medium P on which the toner image has been transferred is completely discharged out of the main body 2-1 by the discharge roller 60, the developing roller 13 does not need to contact the photosensitive drum 11. Also, after finishing a printing operation, the developing roller 13 does not need to contact the photosensitive drum 11. In this case, when the developing roller 13 is separate from the photosensitive drum 11 to remove the developing nip 15, deformation or damage to the developing roller 13 and the photosensitive drum 11 may be prevented, and thus, printing images of stabilized quality may be achieved during the lifespan of the developing cartridge 10.

Figure 12:
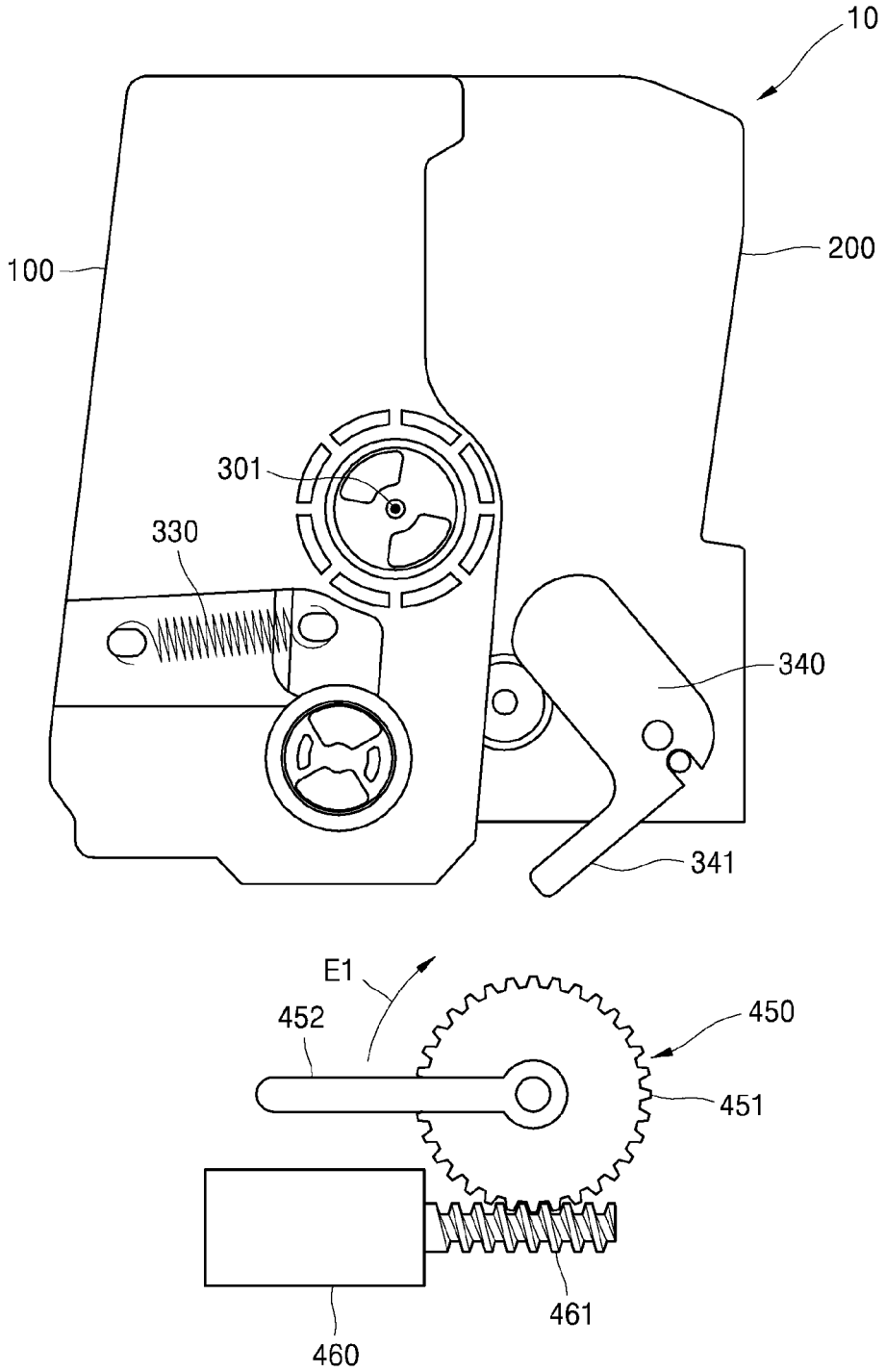
FIGS. 12, 13, and 14 are diagrams of a second switching unit for switching a nip separation member from a second nip forming location to a nip separating location according to an exemplary embodiment.
Figure 13:
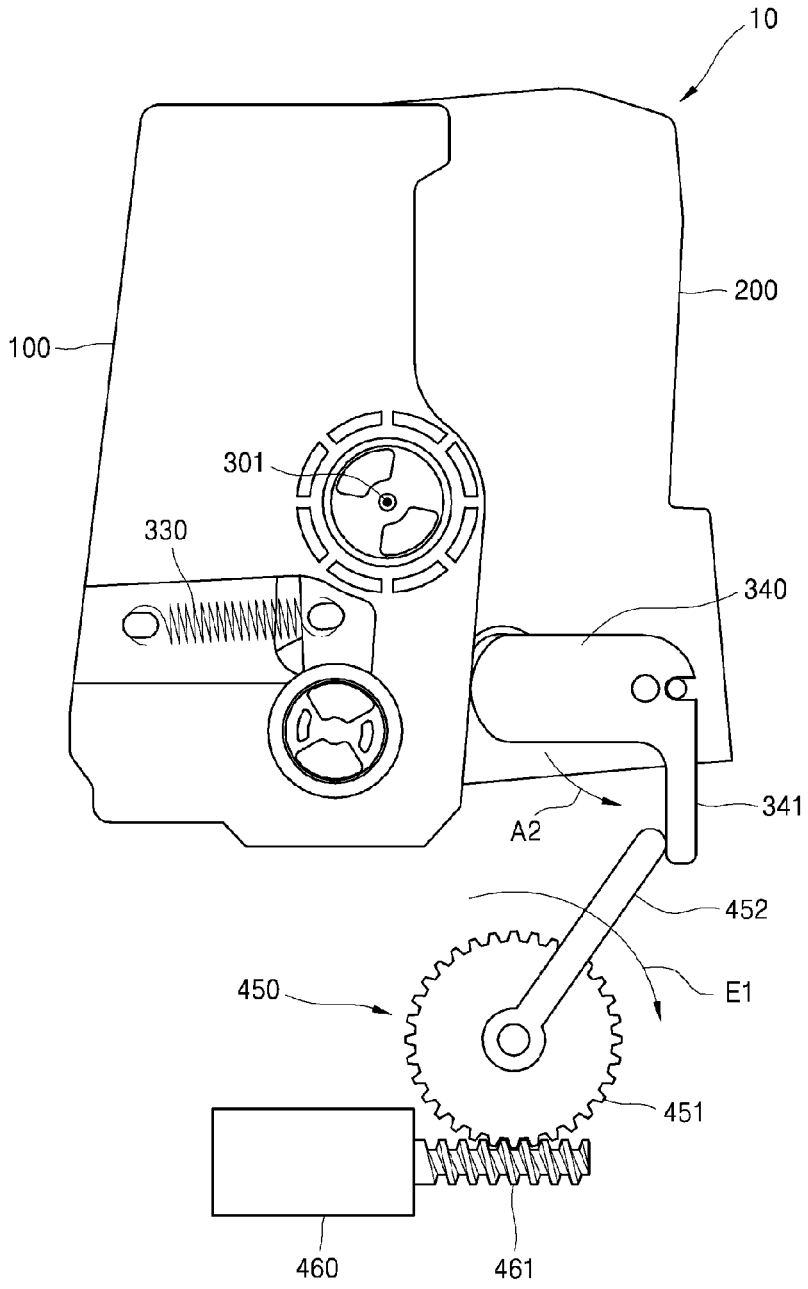
Figure 14:
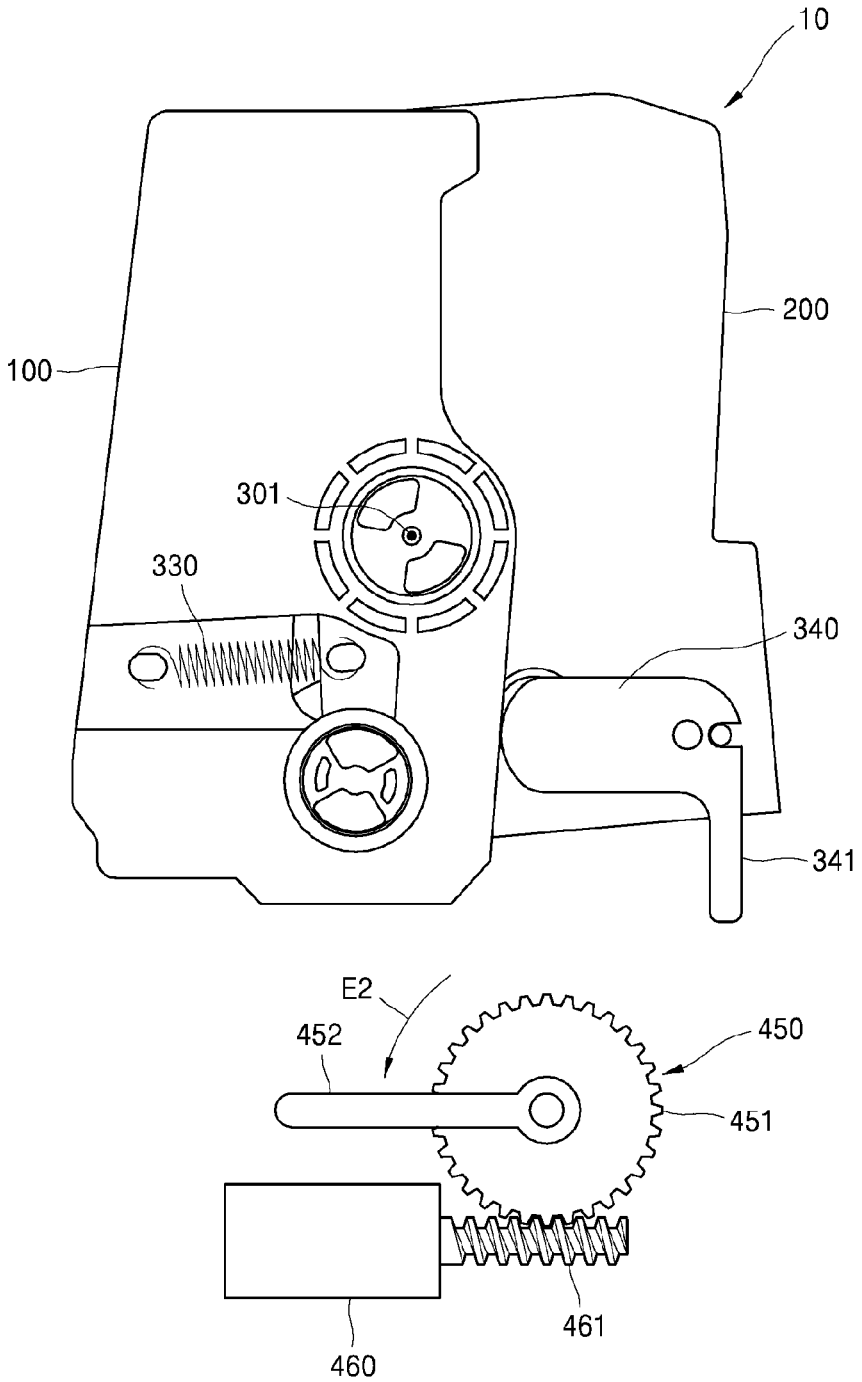

In order to remove the developing nip 15, the nip separating portion 342 may be switched from the second nip forming location to the nip separating location by switching the nip separation member 340 from the third location to the second location. FIGS. 12, 13, and 14 are diagrams of a second switching unit for switching the nip separating portion 342 from the second nip forming location to the nip separating location, according to an exemplary embodiment. Referring to FIGS. 12 to 14, the second switching unit includes a switching lever 452 that is provided on the main body 2-1 to move between a retreat location where the switching lever 452 is not interfered with the nip separation member 340 and an interference location for rotating the nip separation member 340. For example, the switching lever 452 may be provided on the main body 2-1 to be rotated between the retreat location and the interference location.

Various structures may be adopted to rotate the switching lever 452. For example, the switching lever 452 may be connected to a rotary gear 451 that is rotated by an actuator 460. The switching lever 452 and the rotary gear 451 may be formed integrally with each other as a second switching member 450. As an example, the actuator 460 may be connected to the rotary gear 451 by a worm gear 461 provided on a rotary shaft thereof. Although not illustrated in the drawings, the switching lever 452 may be driven by a driving unit (not shown) that drives the developing cartridge 10. In this case, an alternative driving power connecting structure for applying a driving power alternatively, e.g., a clutch structure, may be disposed between the driving unit (not shown) and the switching lever 452.

Referring to FIG. 12, the switching lever 452 is located at the retreat location where the switching lever 452 is not interfered with the nip separation member 340. In this state, even if the developing cartridge 10 is attached to/detached from the main body 2-1, the nip separation member 340 and the switching lever 452 do not interfere with each other. Also, even when the nip separation member 340 is switched from the first location to the second location by the first switching unit while the developing cartridge 10 is installed in the main body 2-1 or even when the nip separation member 340 is switched from the second location to the third location by the nip forming member 350 in a state where the developing cartridge 10 is installed in the main body 2-1, the nip separation member 340 does not interfere with the switching lever 452 that is located at the retreat location.

In FIG. 12, the nip separation member 340 is switched from the second location to the third location by the nip forming member 350. The developing nip 15 may be removed when the printing operation has finished, between printing operations (e.g., between pages), or when an end portion of the toner image has passed through the developing nip 15. To do this, the actuator 460 may rotate the switching lever 452 in a direction E1. Then, the nip separation member 340 is pushed by the switching lever 452 to be rotated in the second direction A2. For example, the switching lever 452 pushes the manipulation portion 341 of the nip separation member 340 to rotate the nip separation member 340 in the second direction A2.

As shown in FIG. 13, when the switching lever 452 reaches the interference location, the nip separation member 340 is located at the second location and the operation of the actuator 460 is terminated. After that, the actuator 460 rotates the switching lever 452 in a direction E2 that is opposite to the direction E1 so that the switching lever 452 returns to the retreat location as shown in FIG. 14.

According to the above configuration, the developing nip 15 may be removed at necessary times during operating the image forming apparatus 1-1 and when the operation of the image forming apparatus 1-1 has finished.

When the nip separation member 340 is switched from the third location to the second location by the second switching unit, the cam gear portion 351 of the nip forming member 350 is switched from the second releasing location shown in FIG. 7C to the connecting location shown in FIG. 7B. In the state shown in FIG. 14, when the developing cartridge 10 is detached from the main body 2-1, the nip separation member 340 does not interfere with the switching lever 452. Also, in the state shown in FIG. 14, when the image forming apparatus 1-1 starts to operate and the developing roller 13 rotates, the cam gear portion 351 of the nip forming member 350 is switched from the connecting location shown in FIG. 7B to the second releasing location shown in FIG. 7C since the cam gear portion 351 of the nip forming member 350 is connected to the gear 360. Moreover, the nip separation member 340 is switched from the second location to the third location and the nip separating portion 342 is switched from the nip separating location to the second nip forming location. Therefore, the developing nip 15 is formed again, and the printing operation may be performed.

(Location Detection)

Figure 15:
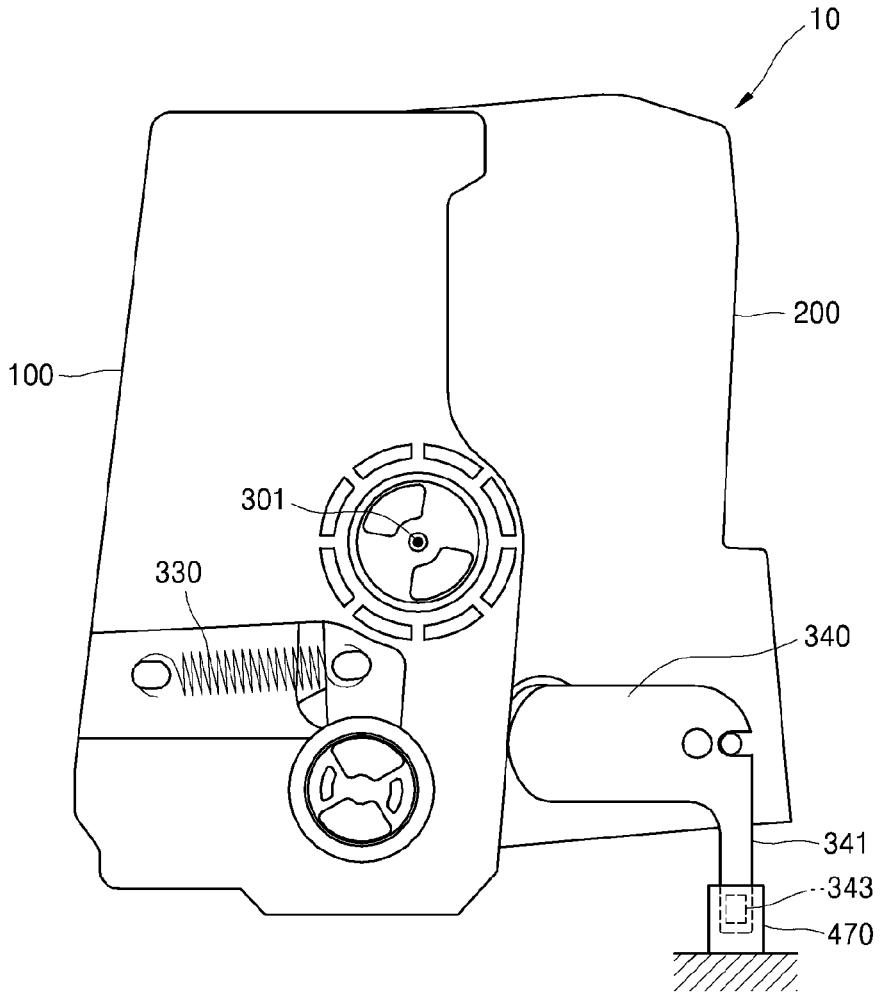
FIG. 15 is a diagram of a detection unit according to an exemplary embodiment.

The image forming apparatus 1-1 may further include a detection unit for detecting whether the developing nip 15 is in a removed state. For example, the detection unit may detect the nip separation member 340 located at the second location. FIG. 15 is a diagram of the detection unit according to an exemplary embodiment. FIG. 15 shows that the developing cartridge 10 is installed in the main body 2-1. The nip separation member 340 is located at the second location where the developing nip 15 is removed. The main body 2-1 includes a detection sensor 470. The detection sensor 470 may detect the manipulation portion 341 of the nip separation member 340 located at the second location.

The detection sensor 470 may be, for example, a reflective optical sensor. In this case, an element denoted by the reference numeral 343 on the manipulation portion 341 may denote a reflective plate for reflecting light. The detection sensor 470 may be, for example, a photointerruptor. Otherwise, various kinds of sensors may be used as the detection sensor 470.

According to the above configuration, whether the developing nip 15 is formed or removed may be determined according to whether the nip separation sensor 340 is detected by the detection sensor 470.

The nip control unit may be disposed at a side portion of the developing roller 13 in a lengthwise direction. Also, the nip control unit may be respectively formed on opposite side portions of the developing roller 13 in the lengthwise direction, and in this case, the first and second switching units may be disposed at the opposite side portions of the developing roller 13 in the lengthwise direction.

(Image Forming Apparatus)

Figure 16:
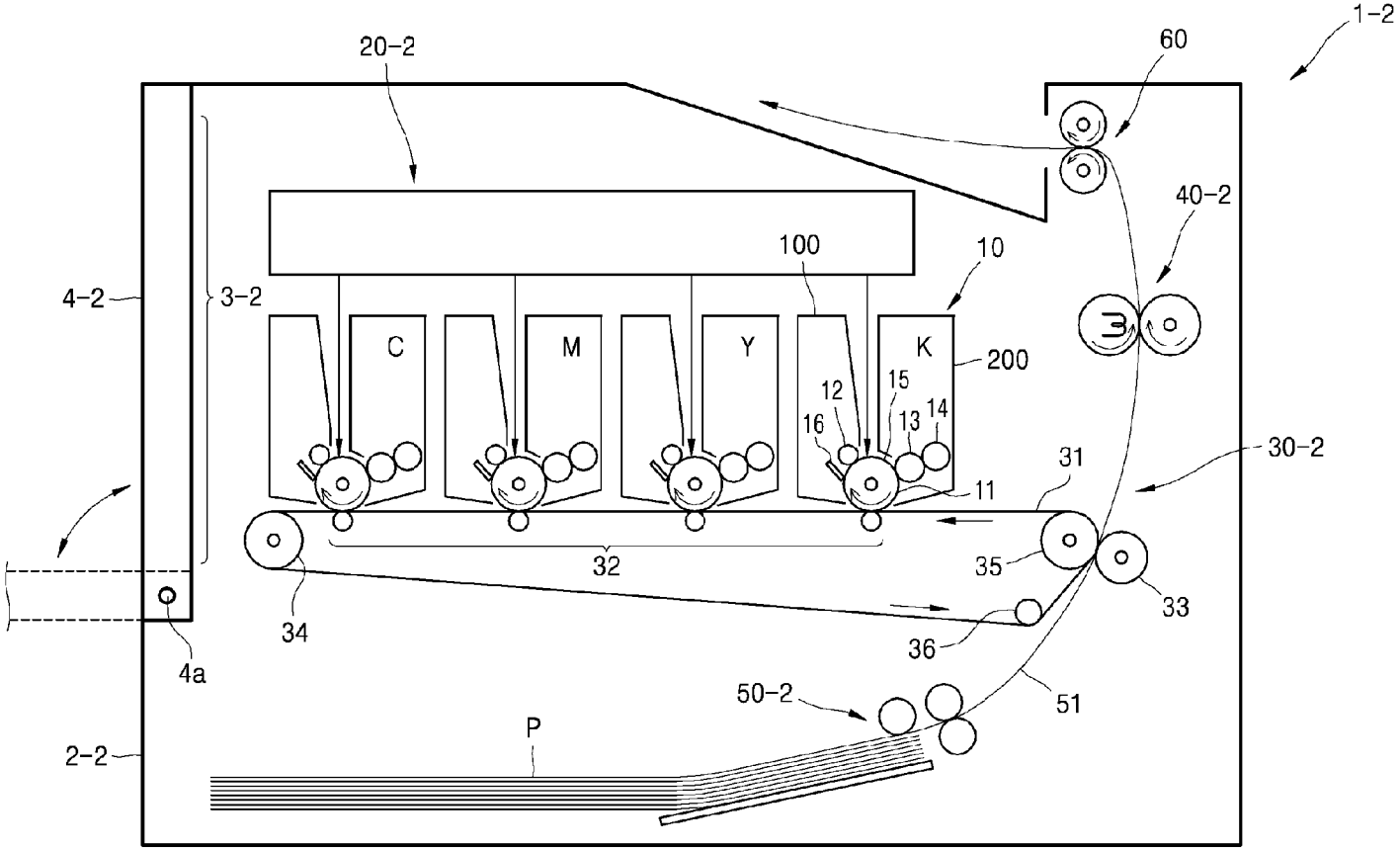
FIG. 16 is a schematic diagram of an image forming apparatus according to an exemplary embodiment.

FIG. 16 is a schematic block diagram of an image forming apparatus 1-2 according to an exemplary embodiment. The image forming apparatus 1-2 of an exemplary embodiment prints color images on a recording medium P by using an electrophotographic method. Referring to FIG. 16, the image forming apparatus 1-2 may include a plurality of developing units 10, an exposure device 20-2, a transfer device 30-2, a fuser 40-2, and a feed unit 50-2.

For color printing, the plurality of developing units 10 may include, for example, four developing units 10 for developing cyan (C) images, magenta (M) images, yellow (Y) images, and black (K) images. The four developing units 10 may respectively contain C, M, Y, and K toners. Although not shown in the drawings, the C, M, Y, and K toners are contained respectively in four toner supplying containers, and may be supplied from the four toner supplying containers to the four developing units 10, respectively. The image forming apparatus 1-2 may further include developing units 10 for accommodating toners of various colors, e.g., light magenta and white. Hereinafter, the image forming apparatus 1-2 including the four developing units 10 will be described. Unless otherwise specified, references with C, M, Y, and K refer to elements for printing an image by using the C, M, Y, and K toners.

The developing device 10 includes the photosensitive drum 11. The photosensitive drum 11 according to an exemplary embodiment has a cylindrical shape on which a photosensitive layer is formed, but is not limited thereto. The charging roller 12 charges the photosensitive drum 11 to have a uniform surface potential. A charging brush or a corona charger may be used, instead of the charging roller 12. The developing roller 13 supplies a developing agent in the developing device 10 to the photosensitive drum 11.

The developing device 10 may further include a charging roller cleaner (not shown) for removing impurities such as the developing agent or dust attached to the charging roller 12, a cleaning member 16 for removing the developing agent remaining on the photosensitive drum 11 after a transfer process that will be described later, and a regulating member (not shown) for regulating an amount of the toner supplied to the developing area where the photosensitive drum 11 and the developing roller 13 face each other by the developing roller 13.

The present exemplary embodiment adopts a mono-component contact type developing method. The developing device 10 adopting the mono-components contact type developing method is described above with reference to FIGS. 1 and 2, and thus, descriptions about detailed structure of the developing device 10 are omitted. The toner is attached to the surface of the developing roller 13 by an electrostatic force to be supplied to the developing nip 15 where the photosensitive drum 11 and the developing roller 13 face each other. The toner is supplied to the photosensitive drum 11 by a developing bias voltage applied between the developing roller 13 and the photosensitive drum 11 to develop an electrostatic latent image formed on the surface of the photosensitive drum 11 to a visible toner image.

The exposure device 20-2 emits light that has been modulated in correspondence to image information to the photosensitive drum 11 that will be described later to form the electrostatic latent image on the photosensitive drum 11. An example of the exposure device 20-2 may be an LSU using a laser diode as a light source or an exposing device using an LED as a light source.

The transfer device 30-2 may include an intermediate transfer belt 31, primary transfer rollers 32, and a secondary transfer roller 33. The toner image developed on the photosensitive drum 11 in each of the developing devices 10C, 10M, 10Y, and 10K is temporarily transferred to the intermediate transfer belt 31. The intermediate transfer belt 31 circulates while being supported by support rollers 34, 35, and 36. Four primary transfer rollers 32 are disposed at locations facing the photosensitive drums 11 in the developing devices 10C, 10M, 10Y, and 10K while the intermediate transfer belt 31 is interposed between the primary transfer rollers 32 and the photosensitive drums 11. A primary transfer bias voltage is applied to the four primary transfer rollers 32 for primary transferring the images developed on the photosensitive drums 11 onto the intermediate transfer belt 31. A corona transfer device or a pin scorotron type transfer device may be adopted, instead of the primary transfer roller 32.

The secondary transfer roller 33 is located to face the intermediate transfer belt 31. A secondary bias voltage is applied to the secondary transfer roller 33 in order to transfer the toner image that is primarily transferred on the intermediate transfer belt 31 to the recording medium P.

In an exemplary embodiment, the toner image developed on the photosensitive drum 11 is primarily transferred to the intermediate transfer belt 31, and then, secondarily transferred to the recording medium P that passes through the intermediate transfer belt 31 and the secondary transfer roller 33, but one or more exemplary embodiments are not limited thereto. That is, the recording medium P may directly pass through between the intermediate transfer belt 31 and the photosensitive drum 11 so that the toner image that is developed on the photosensitive drum 11 may be directly transferred on the recording medium P. In this case, the secondary transfer roller 33 is not adopted.

The fuser 40-2 applies heat and pressure to the image transferred on the recording medium P to fuse the image on the recording medium P. The fuser 40-2 may have the same structure as that of the fuser 40-1 shown in FIG. 1. However, the shape of the fuser 40-2 is not limited thereto. When the recording medium P passes through the fusing nip, the toner image is melted and fixed on the recording medium P due to the heat and pressure applied thereto.

When receiving a printing command from a host (not shown), a controller (not shown) makes the surface of the photosensitive drum 11 charged to a uniform potential by using the charging roller 12. The exposure device 20-2 emits four light beams that are modulated in correspondence with image information of each color to the photosensitive drums 11 in the four developing devices 10C, 10M, 10Y, and 10K to form electrostatic latent images on the photosensitive drums 11. The developing rollers 13 in the developing devices 100, 10M, 10Y, and 10K supply the C, M, Y, and K toners respectively to the photosensitive drums 11 to develop the electrostatic latent images into visible toner images. The toner images are primarily transferred to the intermediate transfer belt 31. The feed unit 50 transports the recording medium P to the transfer nip formed by the secondary transfer roller 33 and the intermediate transfer belt 31 along with a feeding path 51. The toner images that have been primarily transferred on the intermediate transfer belt 31 are secondarily transferred to the recording medium P by the secondary transfer bias voltage applied to the secondary transfer roller 33. When the recording medium P has passed through the fuser 40-2, the toner images are fused on the recording medium P due to the heat and pressure. The recording medium P on which the fusing operation has been finished is discharged to outside by a discharging roller 60.

Hereinafter, the developing devices 10C, 10M, 10Y, and 10K that may be replaceable will be referred to as developing cartridges 10C, 10M, 10Y, and 10K. Each of the developing cartridges 10C, 10M, 10Y, and 10K is the same as the developing cartridge 10 including the nip control unit described above. That is, each of the developing cartridges 10C, 10M, 10Y, and 10K includes the nip separation member 340, the gear 360, and the nip forming member 350 shown in FIGS. 3, 4, 5, 6, 7A, 7B, and 7C.

Figure 17:
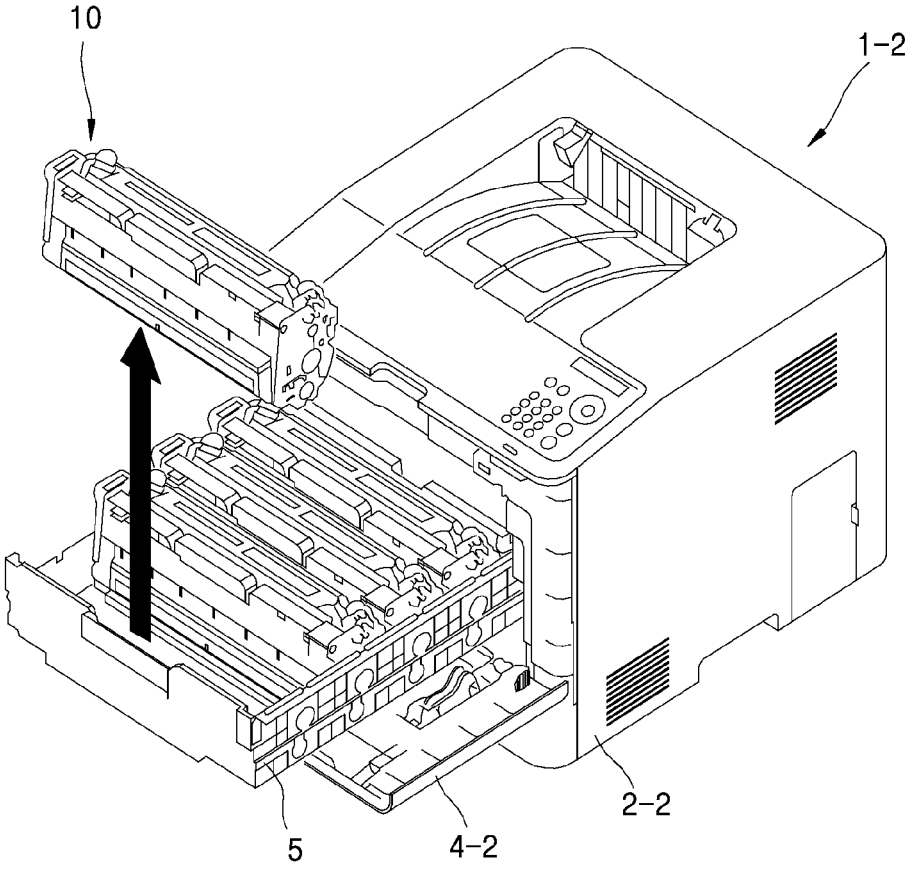
FIG. 17 is a perspective view showing an operation of attaching a developing cartridge to a main body of an image forming apparatus.

The developing cartridges 10C, 10M, 10Y, and 10K may be sequentially installed in a main body 2-2 through an opening 3-2 that is opened by a door 4-2. Also, the developing cartridges 10C, 10M, 10Y, and 10K may be mounted in the main body 2-2 by using a tray method. FIG. 17 is a perspective view showing a method of installing the developing cartridges 100, 10M, 10Y, and 10K in the main body 2-2, according to an exemplary embodiment. Referring to FIG. 17, the main body 2-2 includes a tray 5, on which the developing cartridges 10C, 10M, 10Y, and 10K are mounted, for entering and exiting the main body 2-2. For example, the door 4-2 is opened and the tray 5 is slid out of the main body 2-2 to be withdrawn, and then, the developing cartridges 100, 10M, 10Y, and 10K are mounted on the tray 5. After that, the tray 5 may slide into the main body 2-2 and the door 4-2 is closed.

(First Switching Unit)

Figure 18:
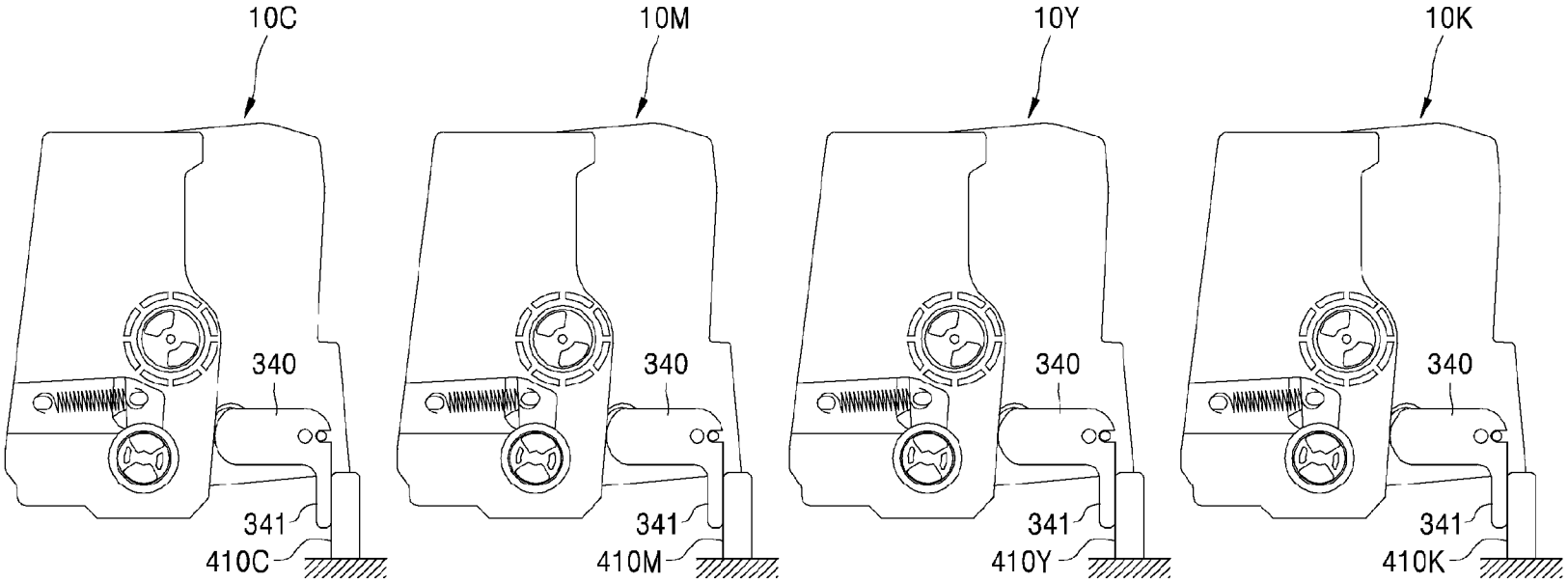
FIGS. 18 and 19 are a side view and a plan view of a first switching unit for releasing a developing nip by operating a nip separation member when a developing cartridge is attached to a main body, according to an exemplary embodiment.
Figure 19:
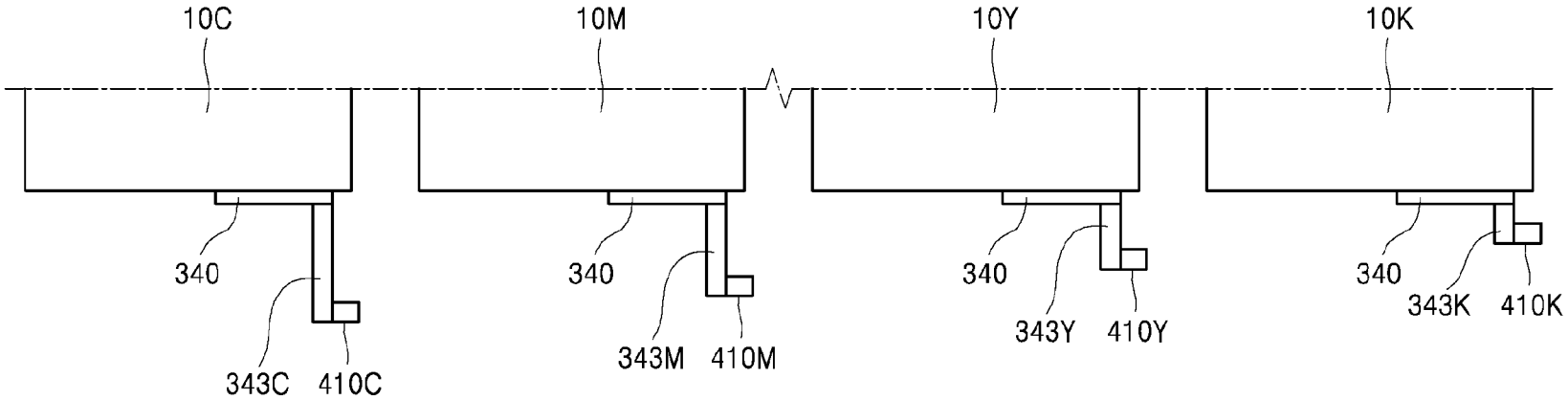

FIGS. 18 and 19 are a side view and a plan view showing a first switching unit that operates the nip separation member 340 to remove the developing nip 15 when the developing cartridges 100, 10M, 10Y, and 10K are installed in the main body 2-2, according to an exemplary embodiment.

Referring to FIGS. 18 and 19, the first switching unit includes switching members 410C, 410M, 410Y, and 410K that are disposed in the main body 2-2. Operations of the switching members 410C, 410M, 410Y, and 410K are the same as those of the switching member 410 shown in FIGS. 8 and 9. However, extension portions 343C, 343M, 343Y, and 343K extending from the manipulation portion 341 in a width direction, that is, a direction perpendicular to the direction in which the developing cartridges 10C, 10M, 10Y, and 10K are arranged, are disposed on the nip separation members 340 in the developing cartridges 10C, 10M, 10Y, and 10K. A length of the extension portion 343K of the developing cartridge 10K that is installed first is the shortest, and a length of the extension portion 343C of the developing cartridge 10C that is installed last is the longest. The switching members 410C, 410M, 410Y, and 410K are located to be stepped sequentially in a width direction, that is, a lengthwise direction of the developing roller 13. According to the above configuration, when the developing cartridges 100, 10M, 10Y, and 10K are sequentially installed in the main body 2-2 in a state where the nip separation member 340 is located at the first location, the extension portions 343C, 343M, 343Y, and 343K interfere respectively with corresponding switching members 410C, 410M, 410Y, and 410K so that the nip separation members 340 are switched from the first location to the second location.

The first switching unit having the above structure may be applied to a case in which the developing cartridges 10C, 10M, 10Y, and 10K mounted on the tray 5 are installed in the main body 2-2. That is, when the developing cartridges 100, 10M, 10Y, and 10K are inserted in the main body 2-2 in a state of being mounted on the tray 5, the extension portions 343C, 343M, 343Y, and 343K of the developing cartridges 10C, 10M, 10Y, and 10K are respectively pushed by the switching members 410C, 410M, 410Y, and 410K disposed in the main body 2-2 and switched from the first location to the second location.

When the nip separation members 340 of the developing cartridges 10C, 10M, 10Y, and 10K are switched from the first location to the second location, the cam gear portions 351 of the nip forming members 350 are also switched from the releasing location to the connecting location.

The developing nip 15 may be removed by the operation of installing the developing cartridges 10C, 10M, 10Y, and 10K in the main body 2-2 and closing the door 4-2. That is, the first switching unit may switch the nip separation members 340 located at the first location to the second location by closing the door 4-2.

Figure 20:
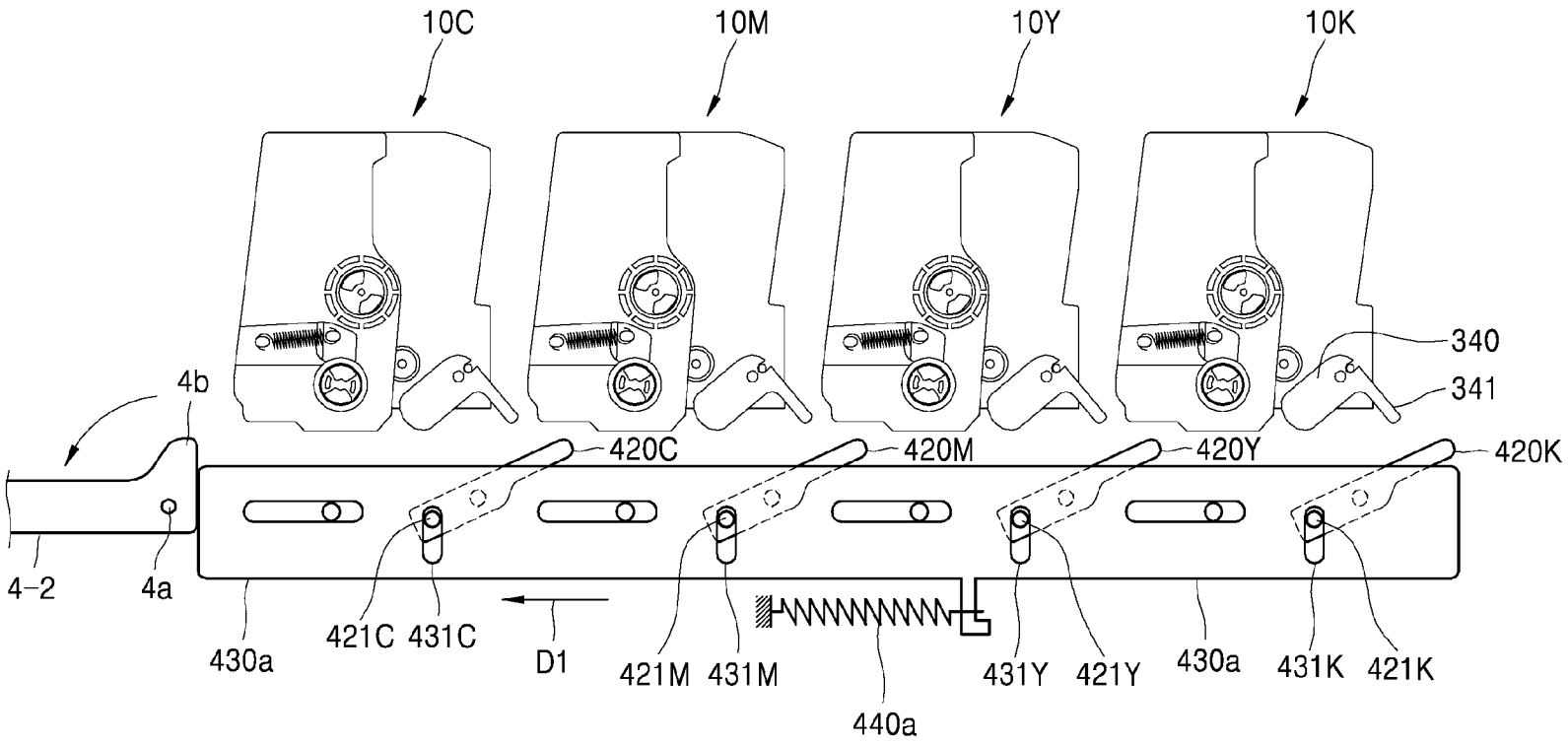
FIGS. 20 and 21 are diagrams of a first switching unit for switching a nip separation member of a developing cartridge from a first position to a second position in association with a closing operation of a door, according to an exemplary embodiment.
Figure 21:
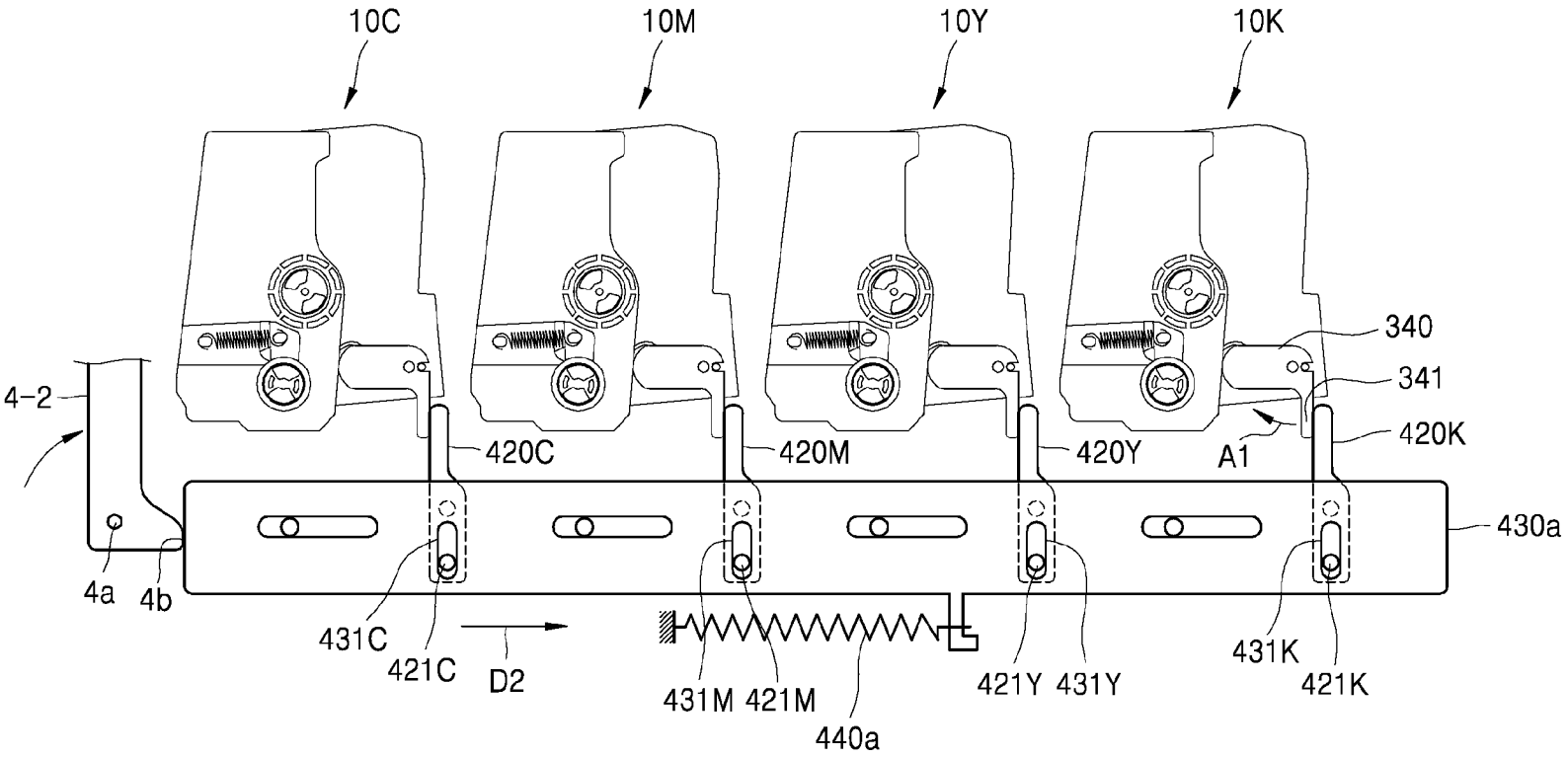

FIGS. 20 and 21 are diagrams of the first switching unit for switching the nip separation members 340 in the developing cartridges 10C, 10M, 10Y, and 10K from the first location to the second location in association with a closing operation of the door 4-2, according to an exemplary embodiment. FIG. 20 shows a state where the nip separation member 340 is located at the first location, and FIG. 21 shows a state where the nip separation member 340 is located at the second location.

Referring to FIGS. 20 and 21, the first switching unit includes switching members 420C, 420M, 420Y, and 420K that move to a retreat location where the switching members 420C, 420M, 420Y, and 420K do not interfere with the nip separation members 340 in the developing cartridges 10C, 10M, 10Y, and 10K and to a switching location for switching the nip separation members 340 in the developing cartridges 10C, 10M, 10Y, and 10K from the first location to the second location, in association with an opening operation and a closing operation of the door 4-2. For example, the switching members 420C, 420M, 420Y, and 420K may be provided in the main body 2-2 to be rotated to the retreat location and the switching location. The door 4-2 and the switching members 420C, 420M, 420Y, and 420K are connected to each other via a connection member 430*a*. The connection member 430*a* is formed on the main body 2-2 to be slidable. The connection member 430*a* includes slots 431C, 431M, 431Y, and 431K, and pins 421C, 421M, 421Y, and 421K formed on the switching members 420C, 420M, 420Y, and 420K are inserted to the slots 431C, 431M, 431Y, and 431K. When the connection member 430*a* slide in a direction D1 shown in FIG. 20, the switching members 420C, 420M, 420Y, and 420K are rotated to the retreat location. When the connection member 430*a* slides in a direction D2 shown in FIG. 21, the switching members 420C, 420M, 420Y, and 420K are rotated to the switching location. The door 4-2 includes a cam portion 4*b* that pushes the connection member 430*a* to the direction D2 when the door 4-2 is closed. A spring 440*a* applies an elastic force to the connection member 430*a* to be slid in a direction of rotating the switching members 420C, 420M, 420Y, and 420K to the retreat location.

When opening the door 4-2, the connection member 430*a* slides in the direction D1 due to the elastic force of the spring 440*a*, and the switching members 420C, 420M, 420Y, and 420K are rotated to the retreat location as shown in FIG. 20. While the developing cartridges 10C, 10M, 10Y, and 10K, in which the nip separation members 340 are located at the first location, are inserted into the main body 2-2, the switching members 420C, 420M, 420Y, and 420K do not interfere with the nip separation members 340. When the developing cartridges 10C, 10M, 10Y, and 10K are completely inserted in the main body 2-2 and the door 4-2 is closed, the connection member 430*a* slides in the direction D2 due to the cam portion 4*b*. Then, the switching members 420C, 420M, 420Y, and 420K are rotated to the switching location to rotate the nip separation members 340 in the first direction A1. For example, the switching members 420C, 420M, 420Y, and 420K rotate the nip separation members 340 to the second location while rotating in contact with the manipulation portions 341. When the door 4-2 is completely closed, the switching members 420C, 420M, 420Y, and 420K are located at the switching location as shown in FIG. 21, and the developing roller 13 is separate from the photosensitive drum 11 due to the nip separation members 340 to remove the developing nip 15.

The first switching unit having the above structure may be applied to a case in which the developing cartridges 10C, 10M, 10Y, and 10K are installed in the main body 2-2 in a state of being mounted on the tray 5. That is, when the developing cartridges 10C, 10M, 10Y, and 10K are inserted in the main body 2-2 in a state of being mounted on the tray 5 and the door 4-2 is closed, the nip separation members 340 in the developing cartridges 10C, 10M, 10Y, and 10K are pushed by the switching members 420C, 420M, 420Y, and 420K provided in the main body 2-2 and then switched from the first location to the second location. The switching members 420C, 420M, 420Y, and 420K may be provided on the tray 5 to rotate to the retreat location and the switching location and the connection member 430*a* may be provided on the tray 5 to be slidable.

While the nip separation members 340 in the developing cartridges 10C, 10M, 10Y, and 10K are switched from the first location to the second location in association with the closing operation of the door 4-2, the nip forming member 350 in each of the developing cartridges 100, 10M, 10Y, and 10K is switched from the releasing location to the connecting location as shown in FIGS. 7A and 7B.

According to the above described structure, the developing nip is removed by the process of installing the developing cartridges 10C, 10M, 10Y, and 10K in the main body 2-2. Therefore, it does not need to check whether to form the developing nip 15 before installing the developing cartridges 10C, 10M, 10Y, and 10K in the main body 2-2 after performing tests before release during the manufacturing processes, and thus, manufacturing costs may be reduced. Also, since the developing nip 15 is not formed, even if the developing cartridges 10C, 10M, 10Y, and 10K is in the installation state in the main body 2-2 for a long time after being released until being sold, the developing roller 13 and the photosensitive drum 11 may not be deformed or damaged.

During the process of switching the nip separation members 340 in the developing cartridges 10C, 10M, 10Y, and 10K from the first location to the second location in association with the installing operation of the developing cartridge 10 in the main body 2-2 or closing the door 4-2, the cam gear portion 351 of the nip forming member 350 in each of the developing cartridges 100, 10M, 10Y, and 10K is switched from the releasing location to the connecting location as shown in FIGS. 7A and 7B. Therefore, when the image forming apparatus 1-2 starts to operate, the cam gear portion 351 in each developing cartridge 100, 10M, 10Y, or 10K is switched from the connecting portion to the second releasing location as shown in FIG. 7C, and accordingly, the nip separation member 340 in each of the developing cartridges 10C, 10M, 10Y, and 10K is switched to the third location to form the developing nip 15.

(Second Switching Unit)

During the operation of the image forming apparatus 1-2, the developing roller 13 may be separate from the photosensitive drum 11 in a case where the developing operation is not necessary. For example, during a time period from a time when an end portion of the toner image has passed through the region where the developing roller 13 and the photosensitive drum 11 face each other to a time when the toner image is transferred to the recording medium P and completely discharged out of the main body 2-2 by the discharging roller 60, the developing roller 13 does not need to contact the photosensitive drum 11. Also, after finishing the printing operation, the developing roller 13 does not need to contact the photosensitive drum 11. In this case, if the developing roller 13 is separate from the photosensitive drum 11 and the developing nip 15 is removed, possibility of deforming or damaging the developing roller 13 and the photosensitive drum 11 may be reduced, and accordingly, images of stabilized image quality may be printed during a lifespan of the developing cartridge 10.

Figure 22:
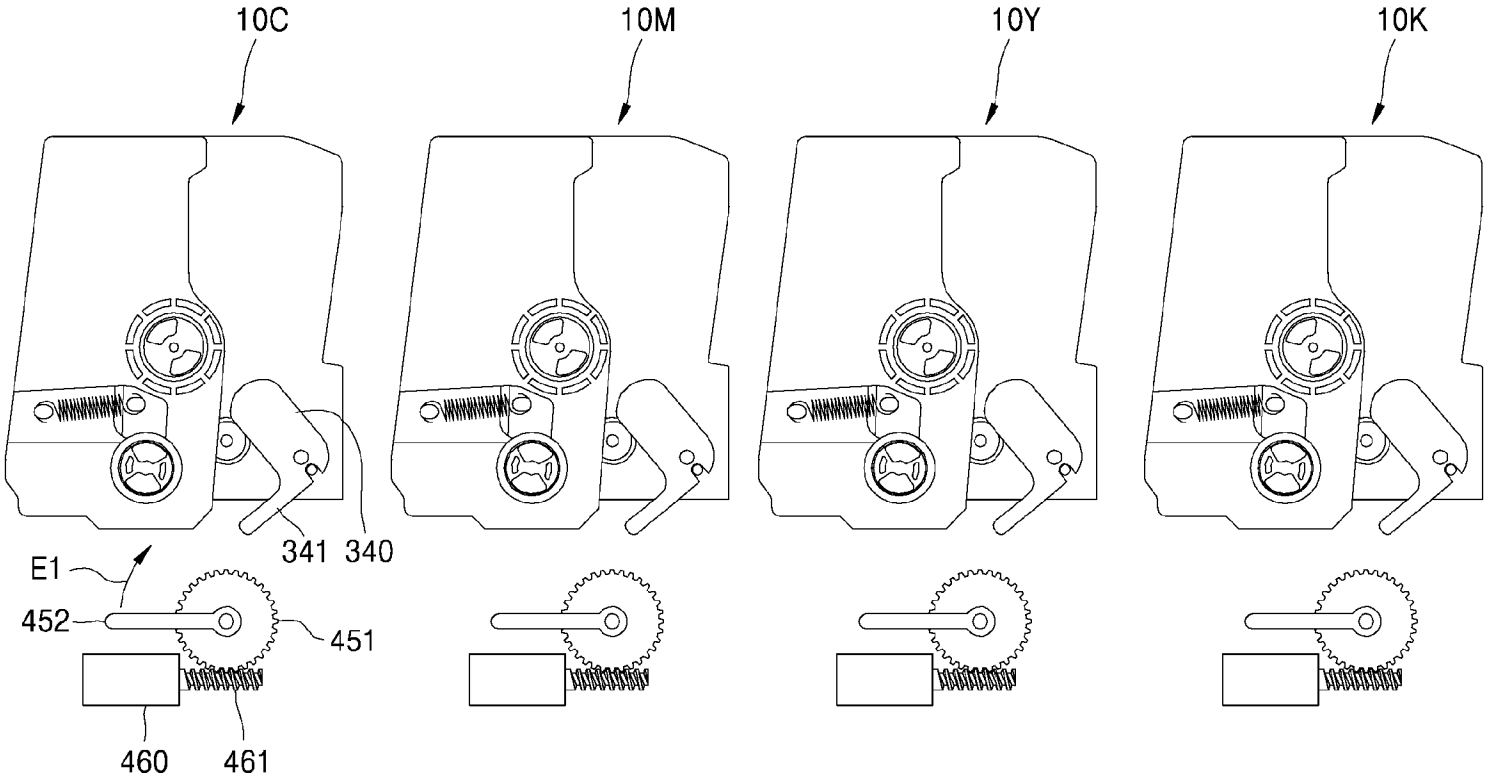
FIGS. 22, 23, and 24 are diagrams of a second switching unit for switching a nip separation member from a third position to a second position, according to an exemplary embodiment.
Figure 23:
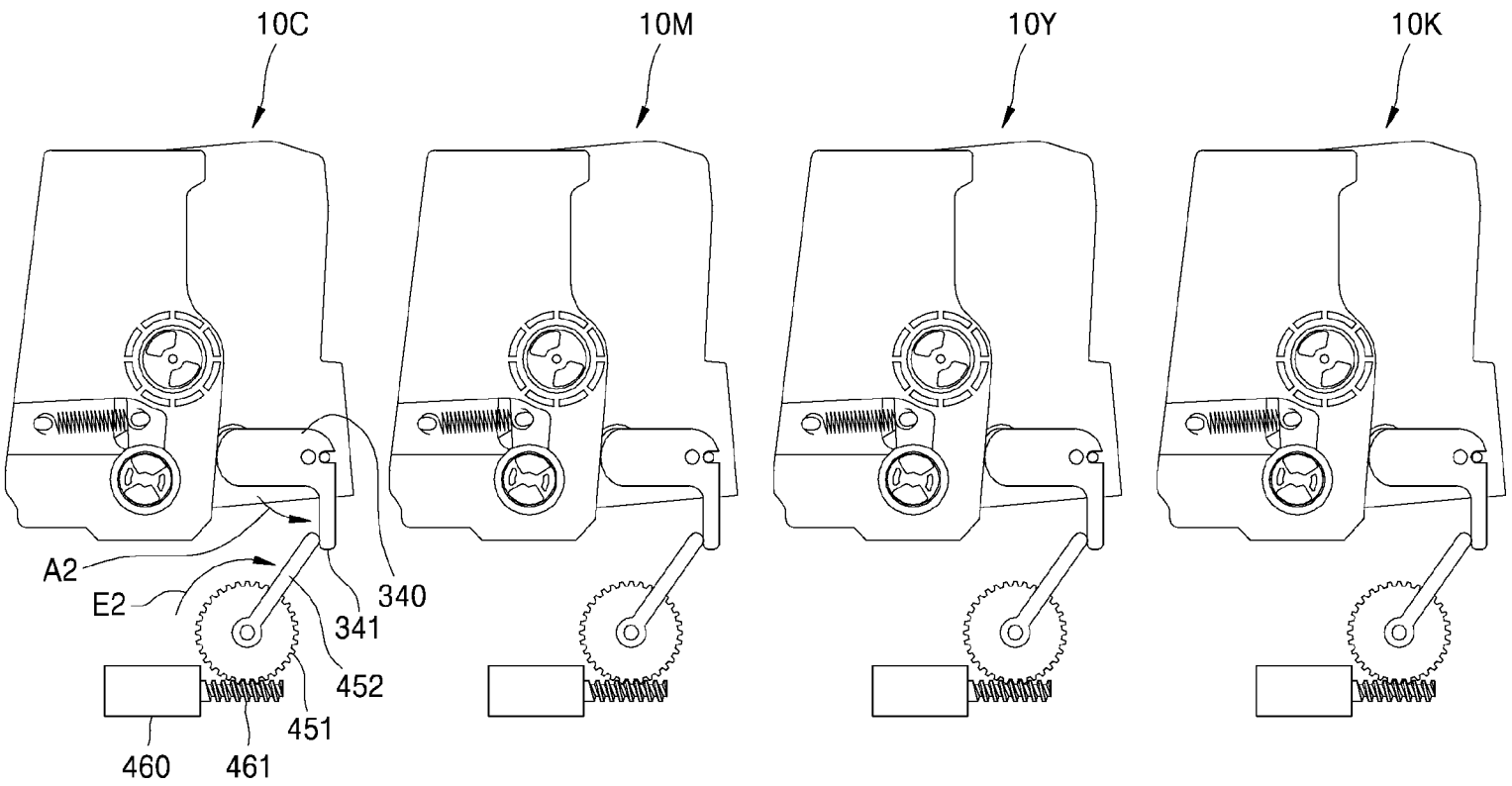
Figure 24:
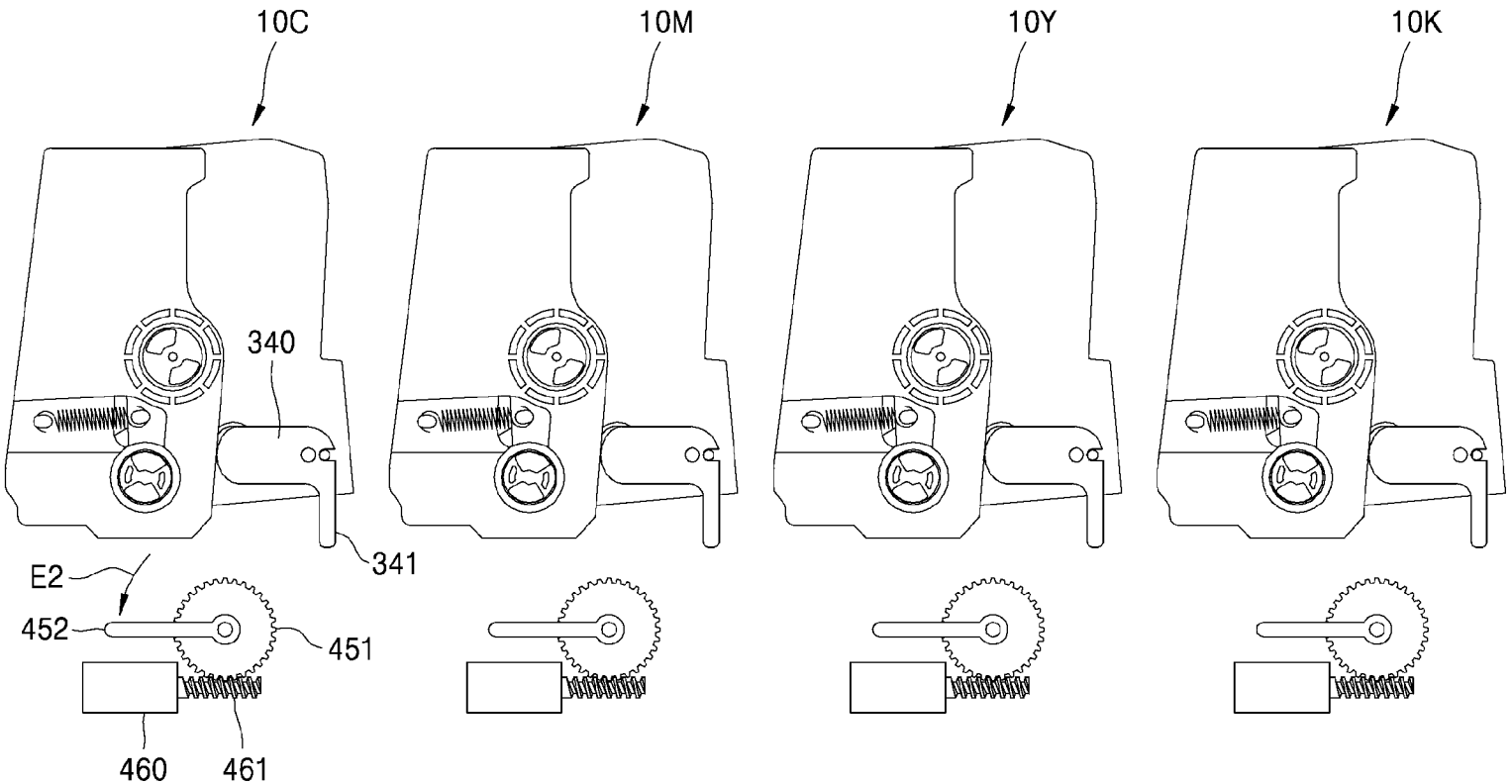

In order to remove the developing nip 15, the nip separation member 340 may be switched from the third location to the second location. FIGS. 22, 23, and 24 are diagrams of a second switching unit for switching the nip separation member 340 from the third location to the second location, according to an exemplary embodiment. Referring to FIGS. 22 to 24, the second switching unit includes a switching lever 452 that is provided on the main body 2-2 to move to a retreat location where the switching lever 452 does not interfere with the nip separation member 340 and an interference location where the nip separation member 340 is rotated. For example, the switching lever 452 may be provided on the main body 2-2 to be rotated to the retreat location and the interference location.

Various structures for rotating the switching lever 452 may be adopted. For example, the switching lever 452 may be rotated in connection with a rotary gear 451 that is rotated by the actuator 460. The switching lever 452 and the rotary gear 451 may be formed integrally with each other to configure the second switching member 450. As an example, the actuator 460 may be connected to the rotary gear 451 via the worm gear 461 provided on a rotary shaft thereof. Although not illustrated in the drawings, the switching lever 452 may be driven by a driving unit (not shown) that drives the developing cartridge 10. In this case, an alternative driving power connecting structure for connecting the driving power alternatively to the driving unit (not shown) and the switching lever 452, for example, a clutch structure, may be disposed between the driving unit (not shown) and the switching lever 452.

Referring to FIG. 22, the switching lever 452 is located at the retreat location where the switching lever 452 does not interfere with the nip separation member 340. In this state, even when the developing cartridges 10C, 10M, 10Y, and 10K are attached to/detached from the main body 2-2, the nip separation member 340 and the switching lever 452 do not interfere with each other. Also, even if the nip separation member 340 is switched from the first location to the second location by the first switching unit during the process of installing the developing cartridges 10C, 10M, 10Y, and 10K in the main body 2-2, or even if the nip separation member 340 is switched from the second location to the third location by the nip forming member 350 in a state where the developing cartridges 10C, 10M, 10Y, and 10K are installed in the main body 2-2, the nip separation member 340 does not interfere with the switching lever 452 located at the retreat location.

In FIG. 22, the nip separation member 340 is located at the third location switched from the second location by the nip forming member 350. The developing nip 15 may be removed when the printing operation is finished, between the successive printing operations (that is, between pages), or after the end portion of the toner image has passed through the developing nip 15. To do this, the actuator 460 rotates the switching lever 452 in a direction E1. Then, the nip separation member 340 is rotated in the second direction A2 by the switching lever 452. For example, the switching lever 452 pushes the manipulation portion 341 of the nip separation member 340 to rotate the nip separation member 340 in the second direction A2.

As shown in FIG. 23, when the switching lever 452 reaches the interference location, the nip separation member 340 is located at the second location and the driving of the actuator 460 is stopped. After that, the actuator 460 rotates the switching lever 452 in the direction E2 that is opposite to the direction E1 to make the switching lever 452 return to the retreat location as shown in FIG. 14.

According to the above configuration, the developing nip 15 may be removed when the operation of the image forming apparatus 1-2 is finished or at necessary times during operating the image forming apparatus 1-2.

The second switching unit having the above structure may be applied to a case where the developing cartridges 10C, 10M, 10Y, and 10K are installed in the main body 2-2 in a state of being mounted on the tray 5. That is, in a state where the developing cartridges 10C, 10M, 10Y, 10K are installed in the main body 2-2 in a state of being mounted on the tray 5, the nip separation member 340 may be switched from the third location to the switching location by using the switching lever 452 during the developing operation is not formed. In this case, the second switching unit may be provided on the tray 5.

When the nip separation member 340 is switched from the third location to the second location by the second switching unit, the cam gear portion 351 is switched from the second releasing location shown in FIG. 7C to the connecting location shown in FIG. 7C. When the developing cartridges 10C, 10M, 10Y, and 10K are detached from the main body 2-2 in the state shown in FIG. 24, the nip separation member 340 does not interfere with the switching lever 452. Also, when the developing roller 13 is rotated when the image forming apparatus 1-2 starts to operate in the state shown in FIG. 24, the nip forming member 350 is rotated because the cam gear portion 351 of the nip forming member 350 is connected to the gear 360. Therefore, the nip separation member 340 is switched from the second location to the third location, and the developing nip 15 is formed again to allow the printing operation.

(Location Detection)

The image forming apparatus 1-2 may further include a detection unit for detecting whether the developing nip 15 is removed. For example, the detection unit may detect the nip separation member 340 located at the second location. The structure of the detection unit is the same as that of FIG. 15, and the image forming apparatus 1-2 may include four detection units corresponding respectively to the developing cartridges 10C, 10M, 10Y, and 10K. According to the above structure, it may be determined whether the developing nip 15 is removed or formed according to whether a detection sensor 470 detects the nip separation member 340.

The nip control unit may be disposed at a side portion of the developing roller 13 in a length direction of the developing roller 13. Also, the nip control unit may be disposed at opposite side portions of the developing roller 13 in the length direction of the developing roller, and in this case, the first and second switching units may be also disposed at the opposite side portions of the developing roller 13 in the length direction of the developing roller 13.

(Developing Cartridge)

The structure of the nip control unit is not limited to the examples shown in FIGS. 3, 4, 5, 6, 7A, 7B, and 7C.

Figure 25:
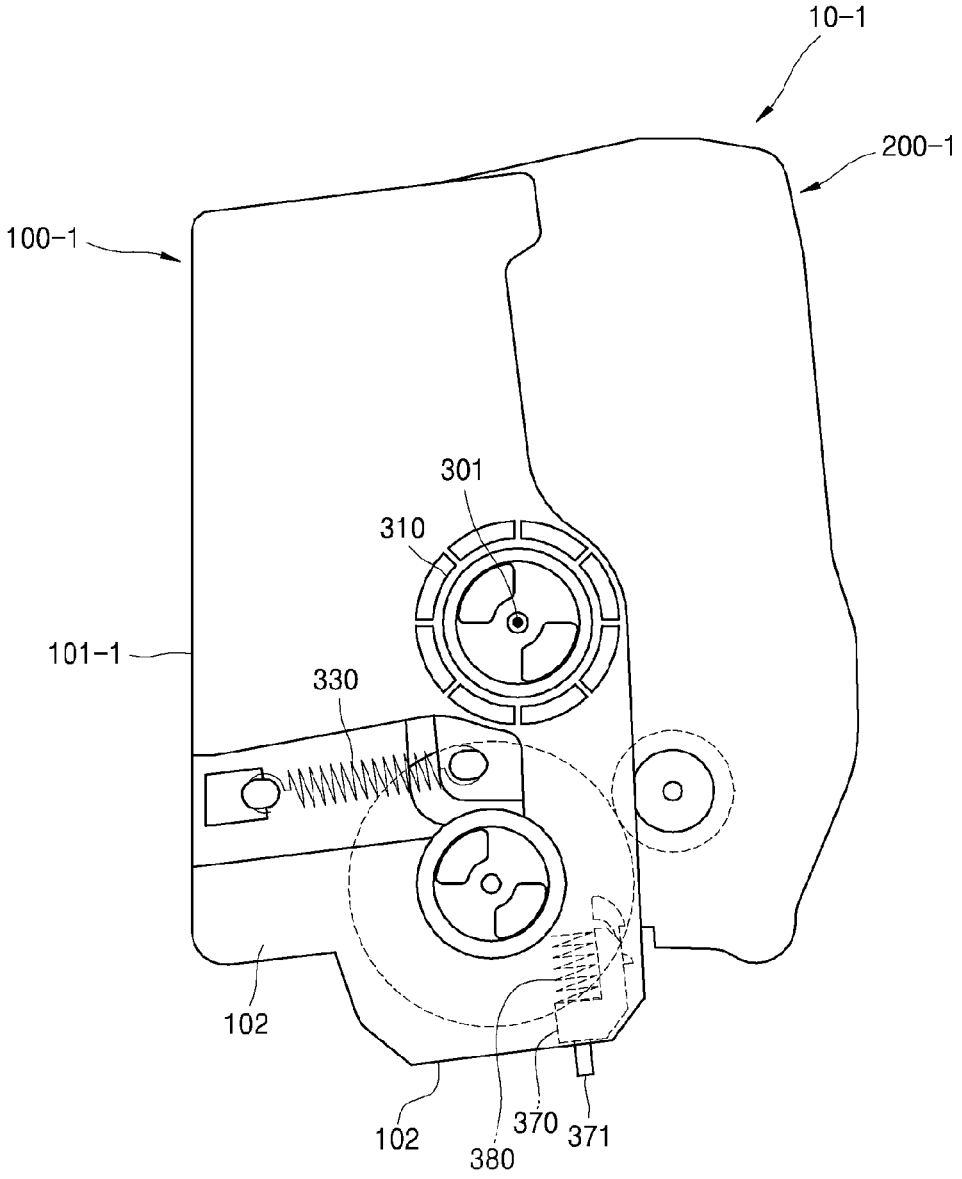
FIG. 25 is a side view of a developing cartridge according to an exemplary embodiment.
Figure 26:
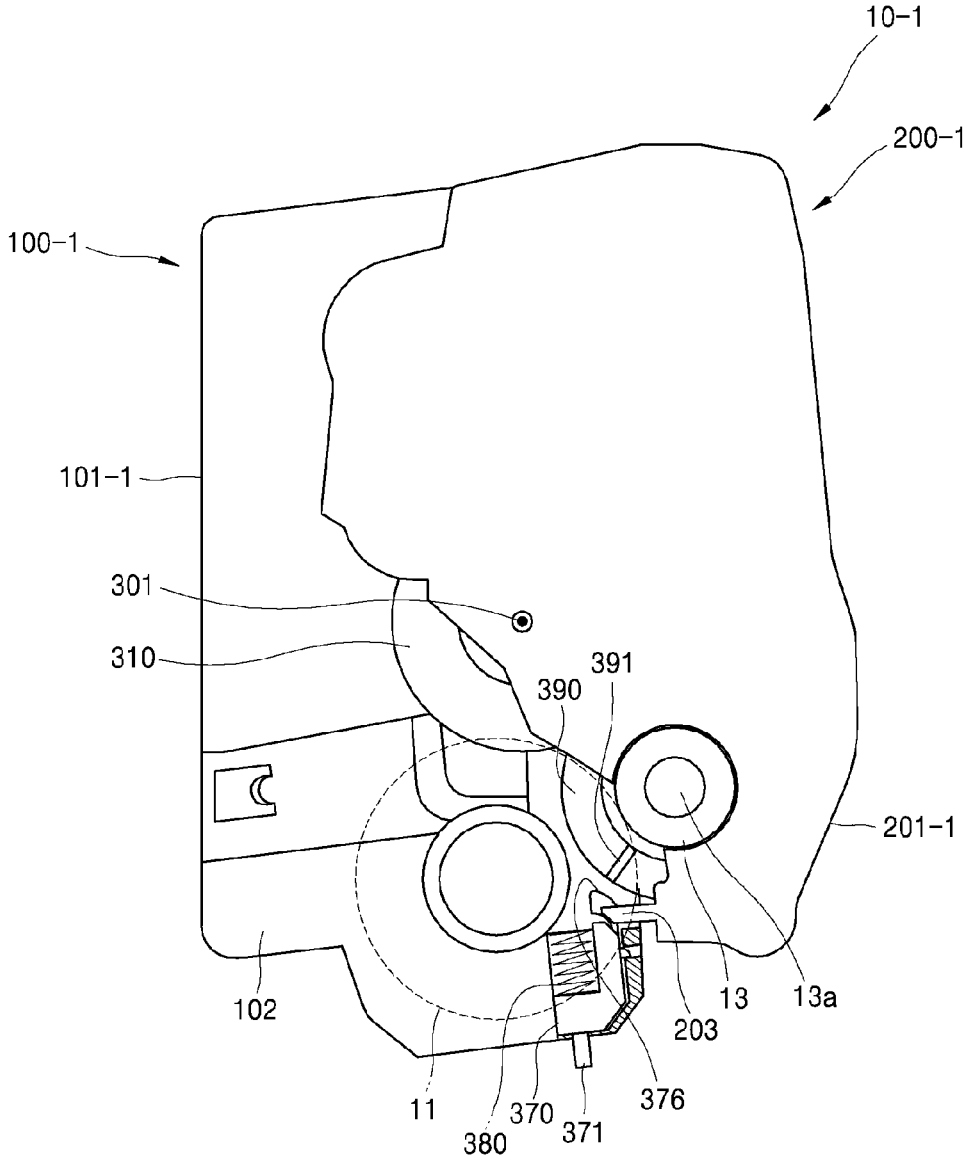
FIG. 26 is a diagram showing an arrangement of a nip control member in the developing cartridge of FIG. 25.
Figure 27:
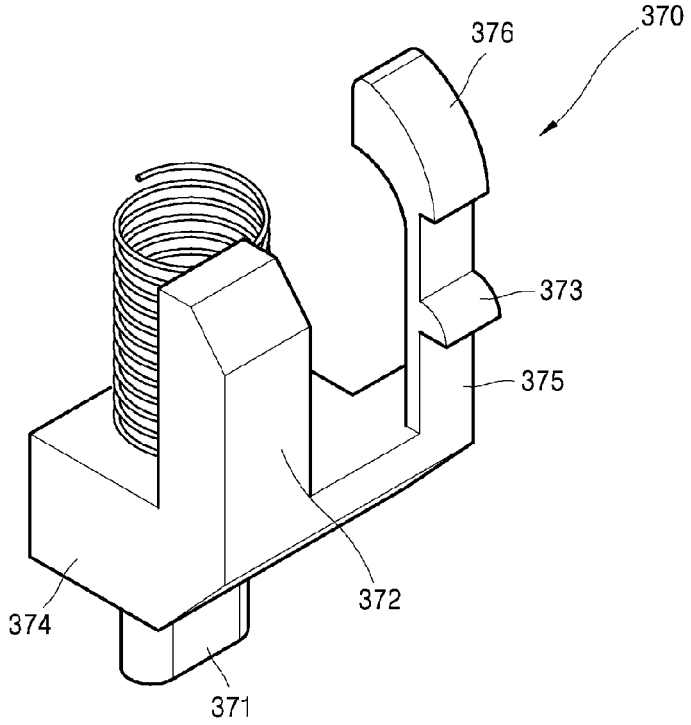
FIG. 27 is a perspective view of a nip control member according to an exemplary embodiment.
Figure 28:
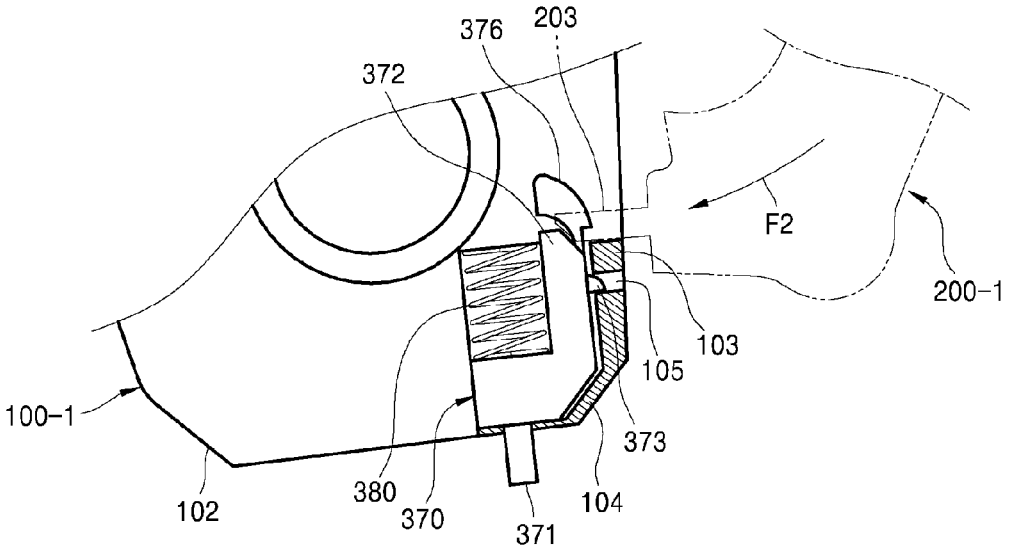
FIG. 28 is a diagram showing a state in which a nip separation portion is located at a nip forming location, according to an exemplary embodiment.
Figure 29:
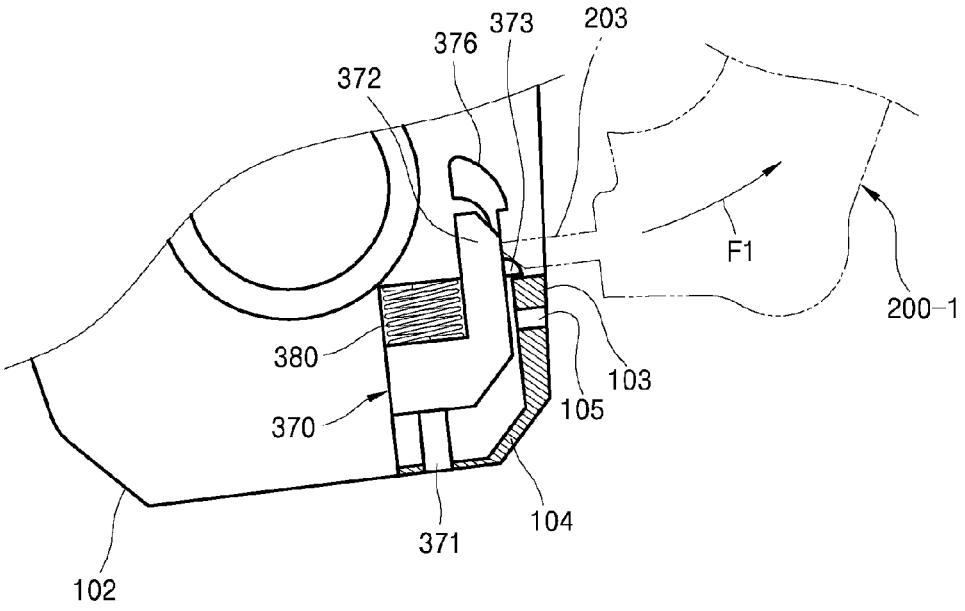
FIG. 29 is a diagram showing a state in which a nip separation portion is located at a nip separating location, according to an exemplary embodiment.

FIG. 25 is a side view of a developing cartridge 10-1. FIG. 26 is a diagram illustrating an example of arranging a nip control member 370 in the developing cartridge 10-1 of FIG. 25. FIG. 27 is a perspective view of the nip control member 370 according to an exemplary embodiment. FIG. 28 is a diagram showing a state where a nip separating portion 372 is located at the nip forming location, and FIG. 29 is a diagram showing a state where the nip separating portion 372 is located at the nip separating location.

The developing cartridge 10-1 of an exemplary embodiment may be applied to the image forming apparatuses 1-1 and 1-2 shown in FIG. 1 and FIG. 16. Hereinafter, a case in which the developing cartridge 10-1 is applied to the image forming apparatus 1-1 will be described below as an example.

FIG. 25 is a side view of the developing cartridge 10-1 according to an exemplary embodiment. Referring to FIG. 25, the developing cartridge 10-1 includes a photosensitive unit 100-1 and a developing unit 200-1. The photosensitive unit 100-1 includes a first housing 101-1, and the photosensitive drum 11 supported by the first housing 101-1. The developing unit 200-1 includes a second housing 200-1, and the developing roller 13 supported by the second housing 200-1. The photosensitive unit 100-1 and the developing unit 200-1 are connected to each other so as to rotate to a developing location (FIG. 25) where the photosensitive drum 11 and the developing roller 13 contact each other to form the developing nip 15, and to a non-developing location (FIG. 30) where the photosensitive drum 11 and the developing roller 13 are separate from each other to remove the developing nip. For example, the photosensitive unit 100-1 and the developing unit 200-1 may be connected to each other to rotate to the developing location and the non-developing location about a hinge shaft 301. In the image forming apparatus 1-1, since the photosensitive drum 11 is related to the location of the transfer roller 30-1, the photosensitive drum 11 is fixed at a location when the developing cartridge 10-1 is installed in the main body 2-1. Therefore, the developing unit 200-1 is coupled to the photosensitive unit 100-1 so as to rotate about the hinge shaft 301. However, one or more exemplary embodiments are not limited thereto, that is, the developing unit 200-1 is fixed at a location in the main body 2-1 and the photosensitive unit 100-1 may be coupled to the developing unit 200-1 so as to rotate about the hinge shaft 301.

The elastic member 330 provides an elastic force to the developing unit 200-1 and the photosensitive unit 100-1 to rotate in a direction of forming the developing nip 15, that is, in a direction toward the developing location. The developing unit 200-1 is rotated about the hinge shaft 301 by the elastic force of the elastic member 330 so that the developing roller 13 contacts the photosensitive drum 11, and accordingly, the developing nip 15 may be formed as shown in FIG. 25. In FIG. 25, a tensile coil spring having opposite end portions that are respectively supported by the photosensitive unit 200-1 and the developing unit 100-1 is shown as an example of the elastic member 330, but the elastic member 300 is not limited thereto. For example, various members such as a torsion coil spring, a plate spring, etc., may be adopted as the elastic member 330.

The hinge shaft 301 may be coaxial with a rotational axis of the coupler 310 that is connected to a driving connection unit (not shown) provided on the main body 2-1 when the developing cartridge 10-1 is installed in the main body 2-1. The developing roller 13, the supply roller 14, and the agitator (not shown) may be power connected to the coupler 310 by the power connection unit (not shown), e.g., a gear. The coupler 320 may be provided on the rotary shaft of the photosensitive drum 11. The coupler 320 may be connected to a driving connection unit (not shown) provided on the main body 2-1 when the developing cartridge 10-1 is installed in the main body 2-1. The photosensitive drum 11 and the charging roller 12 may be connected to the coupler 320 via a power connection unit such as a gear. Although not shown in the drawings, the coupler 320 may be omitted and the photosensitive drum 11 and the charging roller 12 may be connected to the coupler 310. Otherwise, the coupler 310 may be omitted, and the developing roller 13, the supply roller 14, and the agitator (not shown) may be connected to the coupler 320.

The nip control unit may include a nip separating portion switched to the nip forming location and the nip separating location where the developing unit 200-1 are located respectively at the developing location and the non-developing location, a manipulation portion for switching the nip separating portion to the nip forming location and the nip separating location through manual manipulation, and a nip forming unit for witching the nip separating portion from the nip separating location to the nip forming location according to the operations of the photosensitive unit 100-1 and the developing unit 200-1.

The nip control unit may form the developing nip 15 or removing the developing nip by rotating the developing unit 200-1 about the hinge shaft 301. As an example, the nip separating portion and the manipulation portion may be realized by the nip control member 370. The nip control member 370 is provided on the photosensitive unit 100-1 so as to move to the first location for forming the developing nip 15 and the second location for separating the developing nip 15. For example, the nip control member 370 is provided on the side wall 102 of the first housing 101-1 so as to move to the first location and the second location. A returning member 380 applies an elastic force to the nip control member 370 to a direction toward the first location. The returning member 380 may include, for example, a compression coil spring, but is not limited thereto. That is, various types of elastic members such as a plate spring, a torsion coil spring, etc. may be used as the returning member 380.

Referring to FIGS. 26 and 27, the nip control member 370 includes a body 374 supported by the photosensitive unit 100-1 to be moveable to the first location and the second location, a manipulation portion 371 for providing a grip to a user to perform manual manipulation, and a nip separating portion 372 switched to the nip separating location and the nip forming location where the nip separating portion 372 contacts and is separate from the developing unit 200-1 according to the location of the nip control member 370 to remove and form the developing nip 15.

The manipulation portion 371 extends from the body 374. As shown in FIG. 28, the manipulation portion 371 may protrude out of the developing cartridge 10-1 to be exposed when the nip control member 370 is located at the first location (e.g., when the nip separating portion 372 is located at the nip forming location). As such, the user may easily access the nip control member 370 to manually manipulate the nip control member 370 and to switch the nip control member 370 to the second location. The nip separating portion 372 may extend from the body 374 to an opposite direction to the manipulation portion 371. The nip separating portion 372 pushes the developing unit 200-1, for example, the interference portion 203, to be rotated to a direction opposite to the direction in which the elastic force of the elastic member 330 is applied, as the nip control member 370 is moved from the first location (FIG. 28) to the second location (FIG. 29). The interference portion 203 may be provided on, for example, the second housing 201-1.

The nip control unit may further include a lock unit for locking the nip control member 370 at the second location, that is, the nip separating portion 372 at the nip separating location. The lock unit may include a first hook 103 formed on the photosensitive unit 100-1, e.g., the first housing 101-1, and a second hook 373 formed on the nip control member 370 to be hooked by the first hook 103 when the nip control member 370 is located at the second location (e.g., when the nip separating portion 372 is located at the nip separating location). The second hook 373 may be formed on a locking arm 375 that extends from the body 374 in a direction opposite to the manipulation portion 371. The locking arm 375 may be elastically curved. The first housing 101-1 may include a support portion 104 supporting the nip control member 370 located at the first location to maintain the nip control member 370 at the first location. The nip control member 370 is moved from the second location to the first location by the elastic force of the returning member 380, and is supported by the support portion 104 to be maintained at the first location.

As shown in FIG. 28, when the user pushes the manipulation unit 371 in a state where the nip control member 370 is located at the first location in order to move the nip control member 370 toward the second location, the nip separating portion 372 pushes the interference portion 203 of the developing unit 200-1 while moving toward the nip separating location. Then, the developing unit 200-1 rotates about the hinge shaft 301 in the direction opposite to the direction, in which the elastic force of the elastic member 330 is applied, that is, a direction F1 (FIG. 29), and the developing roller 13 is separate from the photosensitive drum 11 and the developing nip 15 is removed. When the nip control member 370 reaches the second location (e.g., when the nip separating portion 372 reaches the nip separating location), the second hook 373 is hooked by the first hook 103 as shown in FIG. 29, and even when the force applied to the manipulation portion 371 is eliminated, the nip control member 370 is maintained at the second location.

The nip control member 370 may be returned from the second location to the first location (e.g., the nip separating portion 372 is returned from the nip separating location to the nip forming location) through the manual manipulation, that is, by releasing the second hook 373 from the first hook 103 in a state where the nip control member 370 is located at the second location. To do this, the photosensitive unit 100-1 may include a manipulation recess 105 so as to push the locking arm 375. When the user pushes the locking arm 375 via the manipulation recess 105 in a state where the nip control member 370 is located at the second location as shown in FIG. 29, the second hook 373 unhooks from the first hook 103 and the locking of the nip control member 370 is released, and then, the nip control member 370 is moved to the first location by the elastic force of the returning member 380. When the contact state between the nip separating portion 372 and the interference unit 203 is terminated, the developing unit 200-1 is rotated about the hinge shaft 301 in a direction F2 (FIG. 28) by the elastic force of the elastic member 330, and accordingly, the developing roller 13 approaches the photosensitive drum 11. When the nip control member 370 reaches the second location, the nip separating portion 372 returns to the nip forming location, and the developing roller 13 contacts the photosensitive drum 11 due to the elastic force of the elastic member 330 to form the developing nip 15.

According to the above configuration, the developing nip 15 may be removed or formed by the manual manipulation.

The nip forming unit forms the developing nip 15 according to the operation of the image forming apparatus 1-1. To do this, the nip forming unit may return the nip control member 370 from the second location to the first location (e.g., returns the nip separating portion 372 from the nip separating location to the nip forming location) according to the operation of the image forming apparatus 1-1.

Referring to FIG. 26, a gear 390 is illustrated. The gear 390 is rotated when the developing cartridge 10-1 is installed in the main body 2-1 and is driven in connection with the driving connection unit (not shown) disposed in the main body 2-1. For example, the gear 390 may be coupled to the rotary shaft 13*a* of the developing roller 13. As such, when the developing roller 13 rotates, the gear 390 also rotates. The gear 390 includes a releasing cam 391.

Referring to FIG. 27, the nip control member 370 includes a releasing portion 376. For example, the releasing portion 376 is disposed on the locking arm 375. The releasing portion 376 may have a shape that may interfere with the releasing cam 391 when the image forming apparatus 1-1 is driven and the gear 390 is rotated in a state where the nip control member 370 is located at the second location.

An example of the nip forming unit may be implemented by using the gear 390 including the releasing cam 391 and the releasing portion 376.

As shown in FIG. 26, when the nip control member 370 is located at the first location, the releasing portion 376 is spaced away from the releasing cam 391. Therefore, in this state, even if the gear 390 is rotated with the developing roller 13, the nip control member 370 is maintained at the first location.

Figure 30:
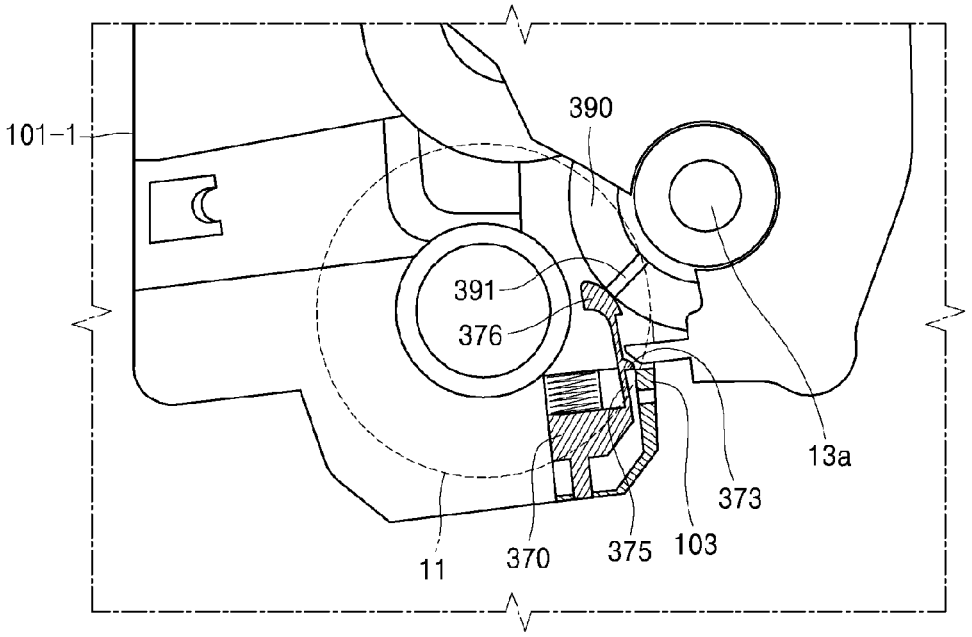
FIG. 30 is a diagram showing an operation of a releasing cam.

FIG. 30 is a diagram illustrating operations of the releasing cam 391. As shown in FIG. 30, when the developing cartridge 10-1 is driven in a state where the nip control member 370 is located at the second location, the gear 390 is rotated. As the gear 390 is rotated, the releasing cam 391 pushes the releasing portion 376 while contacting the releasing portion 376. Then, the locking arm 375 is curved, and the second hook 373 is separate from the first hook 103. When the second hook 373 is completely unhooked from the first hook 103, the nip control member 370 is moved to the first location by the elastic force of the returning member 380. When the contact state between the nip separating portion 372 and the interference portion 203 is terminated, the developing unit 200-1 is rotated about the hinge shaft 301 in the direction F2 (FIG. 28) by the elastic force of the elastic member 330 and the developing roller 13 approaches toward the photosensitive drum 11. When the nip control member 370 reaches the first location, the developing roller 13 is in contact with the photosensitive drum 11 by the elastic force of the elastic member 330 and the developing nip 15 is formed. The nip control member 370 is supported by the support portion 104 to be maintained at the first location.

According to the above described nip control unit, the nip separating portion 372 is switched to the nip forming location and to the nip separating location by switching the nip control member 370 to the first location and the second location, and thus, the developing nip 15 may be formed and removed by the manual manipulation. Also, when the developing cartridge 10-1 is installed in the main body 2-1 and the image forming apparatus 1-1 is driven in a state where the developing nip 15 is removed by locating the nip control member 370 at the second location, the gear 390 is rotated and the nip control member 370 returns to the first location. Therefore, the developing cartridge 10-1 may be installed in the main body 2-1 and packaged in a state where the developing nip 15 is removed, and thus, packaging costs may be reduced and logistics costs may be reduced. Also, when the image forming apparatus 1-1 is driven, the developing nip 15 is formed. Thus, the user who has purchased the image forming apparatus 1-1 does not need to perform processes of separating the developing cartridge 10-1 from the main body 2-1, manipulating the nip control member 370 to form the developing nip 15, and installing the developing cartridge 10-1 in the main body 2-1 again. Therefore, user's convenience may be improved.

(First Switching Unit)

Figure 31:
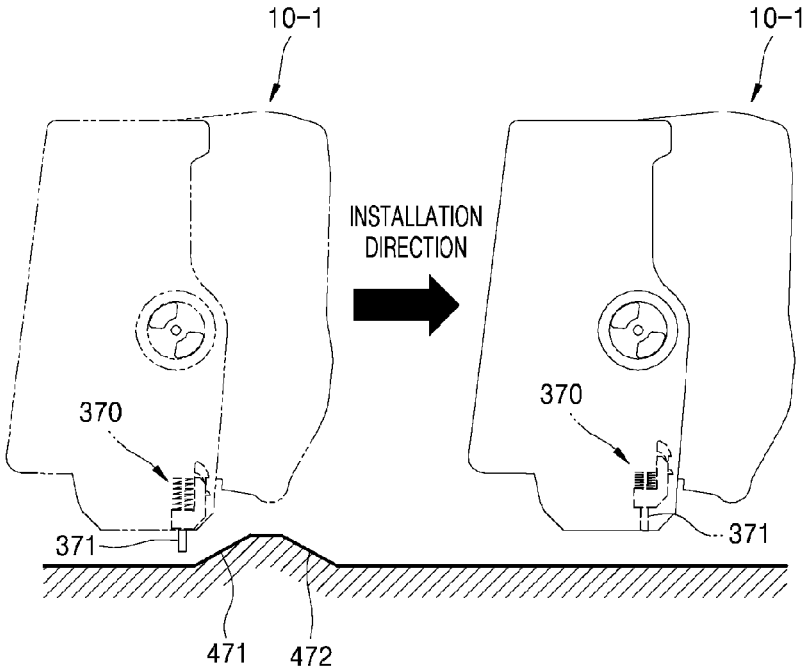
FIG. 31 is a diagram of a first switching unit according to an exemplary embodiment.

The image forming apparatus 1-1 may include a first switching unit for switching the nip control member 370 located at the first location to the second location (e.g., the nip separating portion 372 located at the nip forming location to the nip separating location) when the developing cartridge 10-1 is installed in the main body 2-1. FIG. 31 is a block diagram of the first switching unit according to an exemplary embodiment. Referring to FIG. 31, the first switching unit includes a first inclination portion 471 that is upwardly inclined in a direction of installing the developing cartridge 10-1. The first inclination portion 471 may interfere with the nip control member 370 located at the first location when the developing cartridge 10-1 is installed in the main body 2-1. According to an exemplary embodiment, the first inclination portion 371 interferes with the manipulation portion 371 of the nip control member 370 located at the first location. When the developing cartridge 10-1 is installed in the main body 2-1, the manipulation portion 371 interferes with the first inclination portion 471, the nip control member 370 is pushed by the first inclination portion 471 to a direction opposite to the direction, in which the elastic force of the returning member 380 is applied, and switched to the second location, and the second hook 373 is hooked by the first hook 103 to be maintained at the second location. As such, the nip separation unit 372 may be switched from the nip forming location to the nip separating location in association with the installing operation of the developing cartridge 10-1.

In this state, when the image forming apparatus 1-1 starts to operate, the engagement between the second hook 373 and the first hook 103 is released by the interference between the releasing cam 391 formed on the gear 390 and the releasing portion 376 as described above, and then, the nip control member 370 is switched to the first location by the elastic force of the returning member 380. The nip separating portion 372 is switched from the nip separating location to the nip forming location, and then, the developing nip 15 may be formed.

In a state where the nip control member 370 is located at the first location (e.g., the nip separation unit 372 is located at the nip forming location), the manipulation portion 371 protrudes out of the developing cartridge 10-1. In this state, when the developing cartridge 10-1 is detached from the main body 2-1, the manipulation portion 371 may interfere with the first inclination portion 471. To address the above, the first switching unit may further include a second inclination portion 472 that interferes with the manipulation portion 371 of the nip control member 370 located at the first location when the developing cartridge 10-1 is detached from the main body 2-1. The second inclination portion 372 is located at a downstream portion of the first inclination portion 471 in the installation direction of the developing cartridge, and is inclined upward in a reverse direction of the installation direction. According to the above configuration, when the developing cartridge 10-1 is detached from the main body 2-1 in a state where the nip control member 370 is located at the first location, the manipulation portion 371 is pushed by the second inclination portion 372 so that the nip control member 370 is switched to the second location. Therefore, the developing cartridge 10-1 may be detached in a state where the developing nip 15 is removed.

(Location Detection)

The image forming apparatus 1-1 may further include a detection unit for detecting whether the developing nip 15 is in the removed state. For example, the detection unit may detect the nip control member 370 located at the second location. For example, the structure of the detection unit according to an exemplary embodiment is the same as that illustrated with reference to FIG. 15. That is, the nip separation member 340 of FIG. 15 may be considered as the nip control member 370 in an exemplary embodiment, and the manipulation portion 341 of FIG. 15 may be considered as the manipulation portion 371 of an exemplary embodiment. A detection sensor 470 may detect the manipulation portion 371 of the nip control member 370 located at the nip separating location.

According to the above configuration, whether the developing nip 15 is removed or formed may be determined according to whether the detection sensor 470 detects the nip control member 370.

The nip control unit may be disposed at a side portion of the developing roller 13 in a length direction of the developing unit. Otherwise, the nip control unit may be disposed at opposite side portions of the developing roller 13 in the length direction of the developing roller 13, and in this case, the first switching unit may be disposed at the opposite side portions of the developing roller 13 in the length direction.

In the above exemplary embodiment, it is assumed that the developing cartridge 10-1 and the first switching unit are applied to the image forming apparatus 1-1 shown in FIG. 1, but are not limited thereto, that is, the developing cartridge 10-1 an the first switching unit may be applied to the image forming apparatus 1-2 shown in FIG. 16.

(Image Forming Apparatus)

Figure 32:
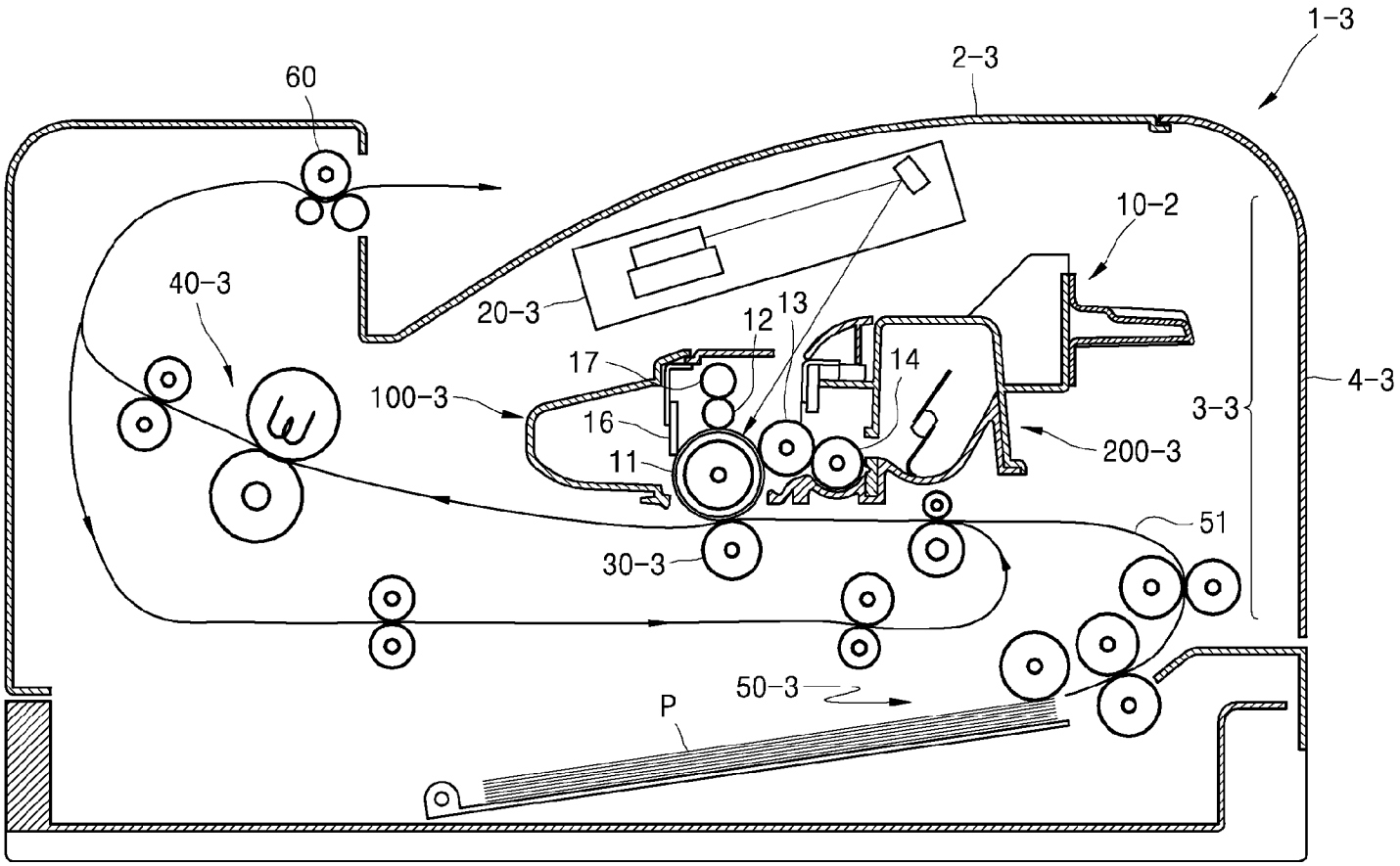
FIG. 32 is a schematic diagram of an image forming apparatus according to an exemplary embodiment.

FIG. 32 is a schematic block diagram of an image forming apparatus 1-3 according to an exemplary embodiment. The image forming apparatus 1-3 of an exemplary embodiment prints mono-color images. Referring to FIG. 32, a main body 2-3 and a developing cartridge 10-2 are illustrated. The main body 2-3 includes an opening 3-3 for providing a path through which the developing cartridge 10-2 is installed and detached. A door 4-3 opens/closes the opening 3-3. The main body 2-3 includes an exposure unit 20-3, a transfer roller 30-3, and a fuser 40-3. Also, the main body 2-3 includes a recording medium conveying unit 50-3 for conveying recording media P, on which images will be formed, loaded thereon. The developing cartridge 10-2 includes a photosensitive unit 100-3 and a developing unit 200-3.

The photosensitive unit 100-3 includes the photosensitive drum 11. The photosensitive drum 11 may include, for example, a conductive metal pipe and a photosensitive layer formed on an outer circumference of the conductive metal pipe. The charging roller 12 is an example of a charger that charges the photosensitive drum 11 to a uniform surface potential. A charging brush, a corona charger, etc. may be adopted instead of the charging roller 12. A cleaning roller 17 removes impurities on the surface of the charging roller 12. A cleaning blade 16 is an example of a cleaning unit for removing toner and impurities remaining on the surface of the photosensitive drum 11 after performing a transfer process that will be described later. Another type of cleaning device such as a rotating brush may be adopted instead of the cleaning blade 16.

The developing unit 200-3 includes the developing roller 13. The developing unit 200-3 supplies toner contained therein to an electrostatic latent image formed on the photosensitive drum 11 to develop the electrostatic latent image into a visible toner image. In an exemplary embodiment, a mono-component contact type developing method is adopted. The developing device 10-1 adopting the mono-component contact type developing method is described above with reference to FIGS. 1 and 2, and thus, detailed descriptions about the structure of the developing cartridge 10-2 are omitted. The toner is attached to the surface of the developing roller 13 due to an electrostatic force and conveyed to the developing nip 15 on which the photosensitive drum 11 and the developing roller 13 face each other. The toner is supplied to the photosensitive drum 11 due to a developing bias voltage applied between the developing roller 13 and the photosensitive drum 11 to develop the electrostatic latent image formed on the surface of the photosensitive drum 11 into a visible toner image.

The exposure unit 20-3 emits light modulated in correspondence with image information to the photosensitive drum 11 to form the electrostatic latent image on the photosensitive drum 11, and an example of the exposure unit 20-3 may include an LSU using a laser diode as a light source and an exposure device using an LED as a light source.

The transfer roller 30-3 is an example of a transfer device for transferring the toner image from the photosensitive drum 11 to the recording medium P. A transfer bias voltage is applied to the transfer roller 30-3 to transfer the toner image onto the recording medium P. A transfer device such as a corona transfer device or a pin scorotron type transfer device may be adopted, instead of the transfer roller 30-3.

The fuser 40-3 applies heat and pressure to the image transferred on the recording medium P to fix the image on the recording medium P. The fuser 40-3 may have the same structure as the fuser 40-1 shown in FIG. 1, but is not limited thereto. When the recording medium P has passed through a fusing nip, the toner image is melted and fixed on the recording medium P due to the heat and pressure.

When receiving a printing command from a host (not shown), a controller (not shown) charges the surface of the photosensitive drum 11 to a uniform potential by using the charging roller 12. The exposure unit 20-3 emits a light beam modulated in correspondence with image information to be printed to the photosensitive drum 11 to form an electrostatic latent image on the photosensitive drum 11. The developing roller 13 supplies toner to the photosensitive drum 11 to develop the electrostatic latent image into a visible toner image. The recording medium conveying unit 50-3 transports the recording medium P to a transfer nip formed by the transfer roller 30-3 and the photosensitive drum 11 through a feeding path 51. The toner image on the photosensitive drum 11 is transferred to the recording medium P by a transfer bias voltage applied to the transfer roller 30-3. When the recording medium P passes through the fuser 40-3, the toner image is fixed on the recording medium P by the heat and pressure. The recording medium P on which the fusing operation has finished is discharged out of the image forming apparatus 1-3 by the discharge roller 60.

(Developing Cartridge)

Figure 33:
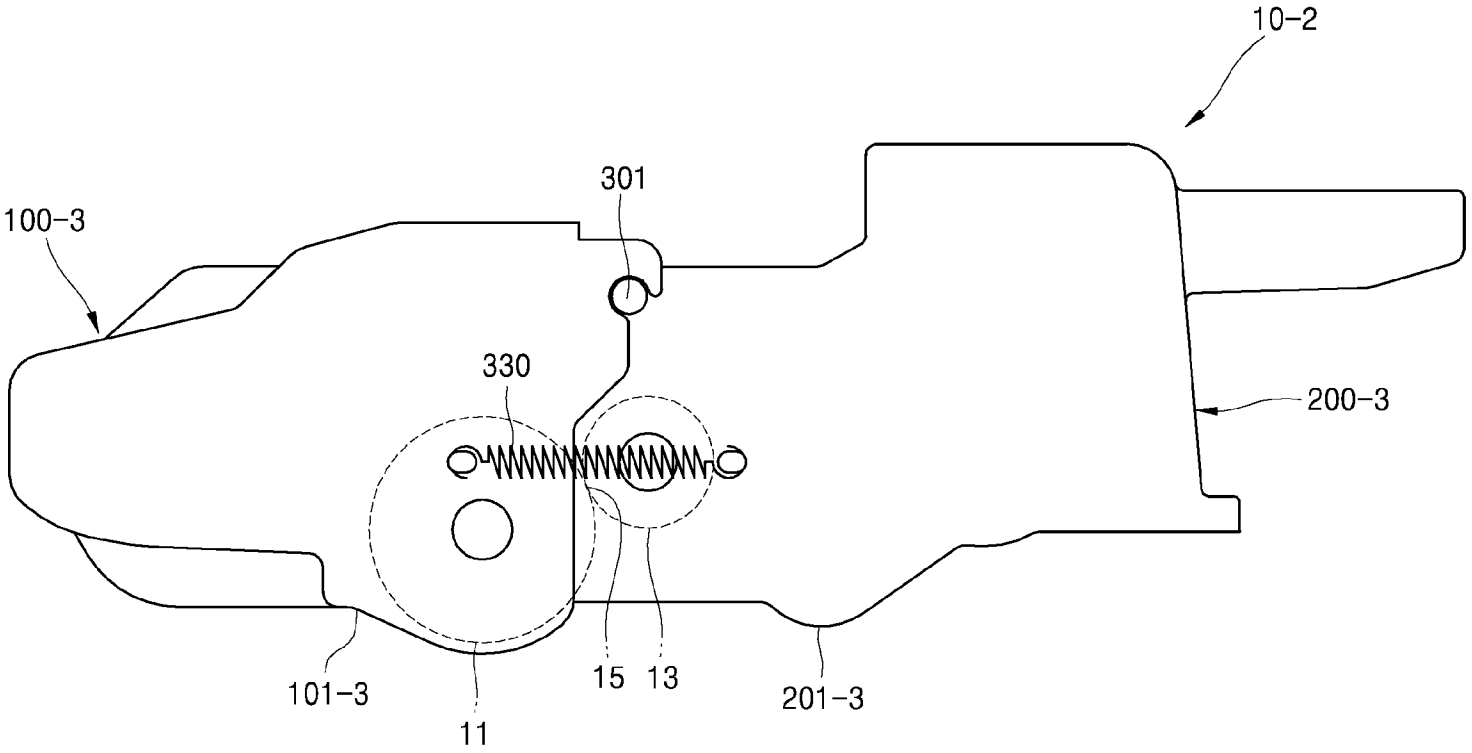
FIG. 33 is a schematic diagram of a developing cartridge according to an exemplary embodiment.

FIG. 33 is a schematic diagram of the developing cartridge 10-2 according to an exemplary embodiment. Referring to FIG. 33, the developing cartridge 10-2 includes the photosensitive unit 100-3 and the developing unit 200-3. The photosensitive unit 100-3 includes a first housing 101-3, and the photosensitive drum 11 supported by the first housing 101-3. The developing unit 200-3 includes a second housing 201-3, and the developing roller 13 supported by the second housing 201-3. The photosensitive unit 100-3 and the developing unit 200-3 are connected to each other to be rotated to a developing location (see FIGS. 35 and 36) on which the photosensitive drum 11 and the developing roller 13 contact each other to form the developing nip 15, and a non-developing location (see FIG. 34) on which the photosensitive drum 11 and the developing roller 13 are separate from each other to remove the developing nip 15. For example, the photosensitive unit 100-3 and the developing unit 200-3 are connected to each other to rotate to the developing location and the non-developing location about the hinge shaft 301. In the image forming apparatus 1-3, since the photosensitive drum 11 is related to a location of the transfer roller 30-3, the photosensitive drum 11 is fixed at a location when the developing cartridge 10-2 is installed in the main body 2-3. Therefore, the developing unit 200-3 is coupled to the photosensitive unit 100-3 to be rotatable about the hinge shaft 301. However, one or more exemplary embodiments are not limited thereto, and the developing unit 200-3 may be fixed at a location in the main body 2-3 and the photosensitive unit 100-3 may be coupled to the developing unit 200-3 to be rotatable about the hinge shaft 301.

Figure 35:
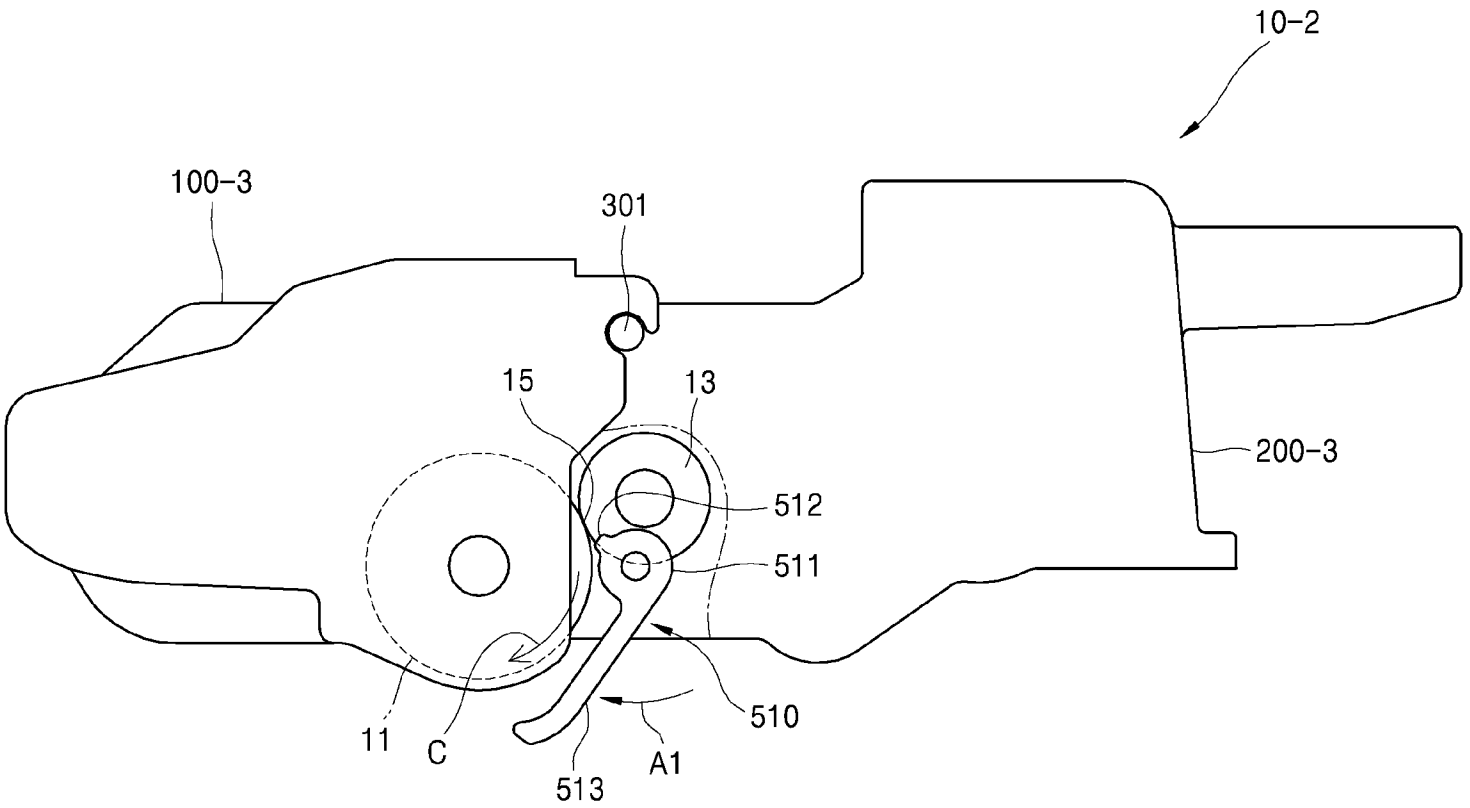
Figure 36:
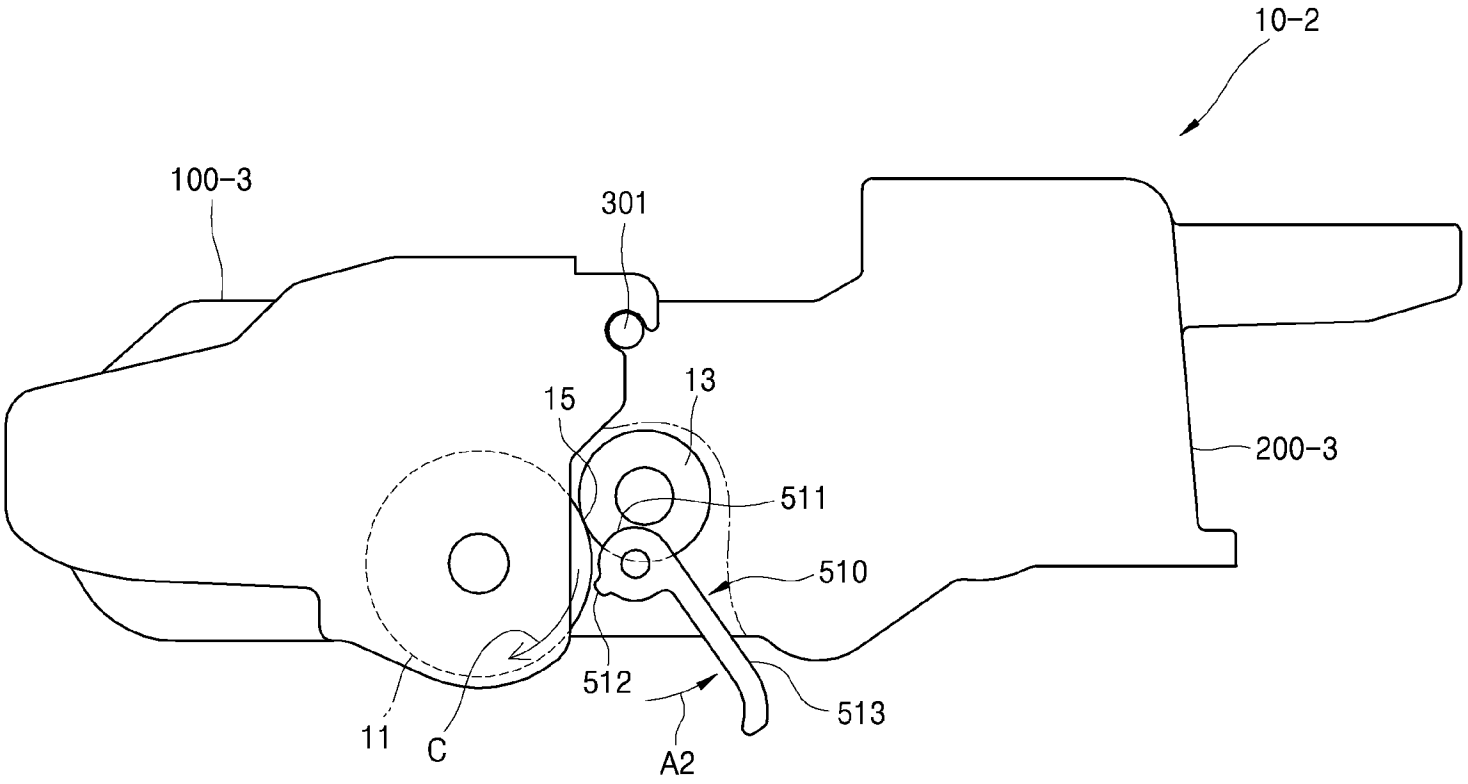
FIG. 36 is a diagram showing a state in which a nip control member is located at a third position, according to an exemplary embodiment.

The elastic member 330 provides the developing unit 200-3 and the photosensitive unit 100-3 with the elastic force in a direction of forming the developing nip 15, that is, to be rotated to the developing location. The developing unit 200-3 is rotated about the hinge shaft 301 by the elastic force of the elastic member 330, and accordingly, the developing roller 13 contacts the photosensitive drum 11. Then, the developing nip 15 may be formed as shown in FIGS. 35 and 36. FIG. 33 illustrates a tensile coil spring having opposite end portions respectively supported by the photosensitive unit 100-3 and the developing unit 200-3 as an example of the elastic member 330, but the elastic member 330 is not limited thereto. For example, various types of members such as a torsion coil spring, a plate spring, etc. may be adopted as the elastic member 330.

Although not illustrated in the drawings, the developing cartridge 10-2 may include a coupler (not shown) connected to a driving connection unit (not shown) formed on the main body 2-3 when the developing cartridge 10-2 is installed in the main body 2-3. The photosensitive drum 11, the charging roller 12, the developing roller 13, the supply roller 14, and the agitator (not shown) may be power connected to the coupler via a power connection unit (not shown). The power connection structure between the developing cartridge 10-2 and the main body 2-3 is not limited thereto. For example, the developing cartridge 10-2 may include a coupler (not shown) for driving the photosensitive drum 11 and the charging roller 12, and a coupler (not shown) for driving the developing roller 13, the supply roller 14, and the agitator (not shown).

The developing cartridge 10-2 includes a nip control unit for forming and removing the developing nip 15. The nip control unit may include a nip separating portion switched to a nip forming location and a nip separating location where the developing unit 200-3 are respectively located at the developing location and the non-developing location, a manipulation portion for switching the nip separation unit to the nip forming location and the nip separating location by a manual manipulation, and a nip forming unit for switching the nip separating portion from the nip separating location to the nip forming location when the photosensitive unit 100-3 and the developing unit 200-3 start to operate.

Figure 34:
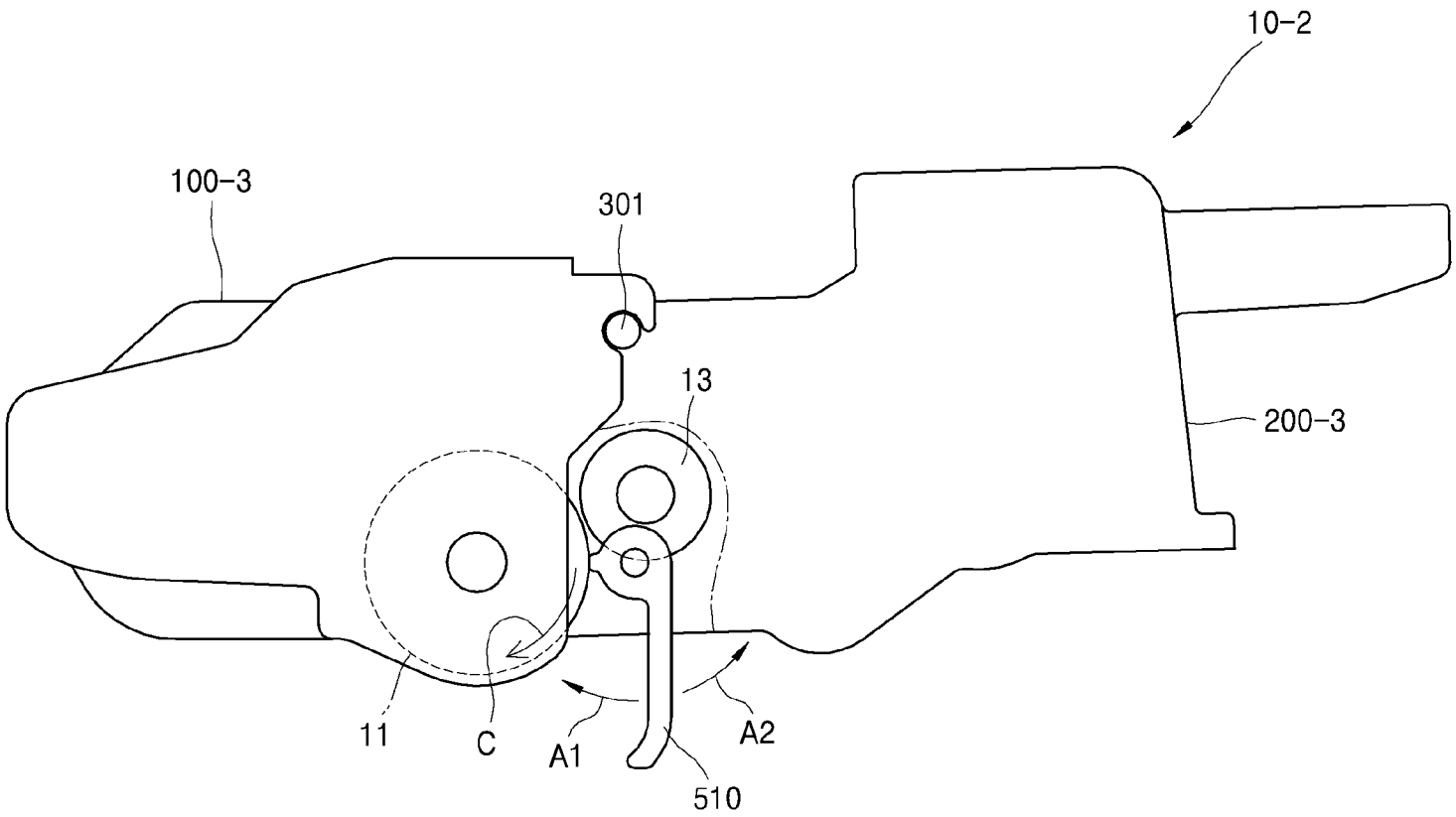
FIGS. 34 and 35 are block diagrams of a nip control unit according to an exemplary embodiment.

FIGS. 34 and 35 are diagrams of the nip control unit according to an exemplary embodiment. Referring to FIGS. 34 and 35, the nip control unit includes a nip control member 510. The nip control member 510 includes a body 511 supported by the developing unit 200-3 to be rotatable, a nip separating portion 512 protruding from the body 511, and a manipulation portion 513 extending from the body 511 to an outer portion of the developing cartridge 10-2.

The nip control member 510 may be switched to the second location (FIG. 34) for separating the developing nip 15, and the first location (FIG. 35) for forming the developing nip 15. For example, the nip control member 510 may be provided on the developing unit 200-3 to be rotatable to the first location and the second location. As the nip control member 510 is switched to the first location and the second location, the nip separating portion 512 may be switched to the first nip forming location where the nip separation unit 512 is separate from the photosensitive drum 11 to form the developing nip 15 and a nip separating location where the nip separation unit 512 is supported by the photosensitive drum 11 to remove the developing nip 15. The manipulation portion 513 provides a grip by which the nip control member 510 is rotated to the first location and to the second location.

Referring to FIG. 34, the nip control member 510 is located at the second location. The nip separating portion 512 is supported by the photosensitive drum 11. The developing unit 200-3 and the photosensitive unit 100-3 are rotated about the hinge shaft 301 in a direction away from each other, and thus, the developing roller 13 and the photosensitive drum 11 are separate from each other. Accordingly, the developing nip 15 is removed.

When the nip control member 510 is rotated in the first direction A1 at the second location, the nip control member 510 is switched to the first location as shown in FIG. 35. In this process, the nip separating portion 512 is switched to the first nip forming location, and separate from the photosensitive drum 11. The developing unit 200-3 and the photosensitive unit 100-3 are rotated about the hinge shaft 301 by the elastic force of the elastic member 330 in a direction of approaching each other, and the developing roller 13 and the photosensitive drum 11 contact each other to form the developing nip 15.

As shown in FIG. 35, when the nip control member 510 located at the first location is rotated in the second direction A2 to be switched to the second location shown in FIG. 34, the nip separating portion 512 is switched to the nip separating location and contacts the photosensitive drum 11, the developing unit 200-3 and the photosensitive unit 100-3 are rotated about the hinge shaft 301 in a direction away from each other, and the developing nip 15 is removed again.

The nip separating portion 512 may be switched to the first nip forming location and the nip separating location to form and remove the developing nip 15 through the manual manipulation by switching the nip control member 510 to the first location and the second location via the manipulation portion 513. The manipulation portion 513 is exposed to outside of the developing cartridges 10-2, and thus, the user may easily access the manipulation portion 513.

The nip forming unit may form the developing nip 15 as the image forming apparatus 1-3 starts to operate. To do this, the nip forming unit may switch the nip control member 510 from the second location to the third location (the nip separating portion 512 from the nip separating location to the second nip forming location) as the image forming apparatus 1-3 operates.

In the state of FIG. 34, that is, in a state where the nip control member 510 is located at the second location, when the developing cartridge 10-2 is installed in the main body 2-3 and the image forming apparatus 1-3 is driven, the photosensitive drum 11 rotates in a processing direction C. The nip separating portion 512 of the nip control member 510 is in contact with the photosensitive drum 11 due to the elastic force of the elastic member 330. In this state, when the photosensitive drum 11 rotates in the processing direction C, the nip control member 510 is rotated in the second direction A2.

FIG. 36 is a diagram showing a state where the nip control member 510 is located at the third location. When the nip control member 510 rotates in the second direction A2, the nip separating portion 512 is switched to the second nip forming location. Then, the contact state between the nip separating portion 512 and the photosensitive drum 11 is terminated, the developing unit 200-3 is rotated about the hinge shaft 301 by the elastic force of the elastic member 330 in a direction approaching the photosensitive unit 100-3, and the developing roller 13 contacts the photosensitive drum 11 to form the developing nip 15.

Therefore, in an exemplary embodiment, the nip forming unit may be implemented by the photosensitive drum 11 that rotates in the processing direction C in contact with the nip separating portion 512 to rotate the nip control member 510 and switch the nip separating portion 512 to the second nip forming location.

According to the above nip control unit, the nip separating portion 512 may be switched to the first nip forming location and the nip separating location by switching the nip control member 510 to the first location and the second location, thereby forming and removing the developing nip 15. Also, when the developing cartridge 10-2 is installed in the main body 2-3 in a state where the nip control member 510 is located at the second location (e.g., the nip separating portion 512 is located at the nip separating location) and the image forming apparatus 1-3 is driven, the photosensitive drum 11 switches the nip control member 510 to the third location while rotating. Accordingly, the nip separating portion 512 is switched from the nip separating location to the second nip forming location, and the developing nip 15 is formed. Therefore, the developing cartridge 10-2 may be installed in the main body 2-3 and packaged in a state where the developing nip 15 is removed, the packaging costs and the logistics costs may be reduced. Also, since the developing nip 15 is formed when the image forming apparatus 1-3 starts to operate, the user who has purchased the image forming apparatus 1-3 does not need to perform processes of detaching the developing cartridge 10-2 from the main body 2-3, manipulating the nip control member 510 to form the developing nip 15, and installing the developing cartridge 10-2 in the main body 2-3 again. Therefore, the user's convenience may be improved.

Figure 37:
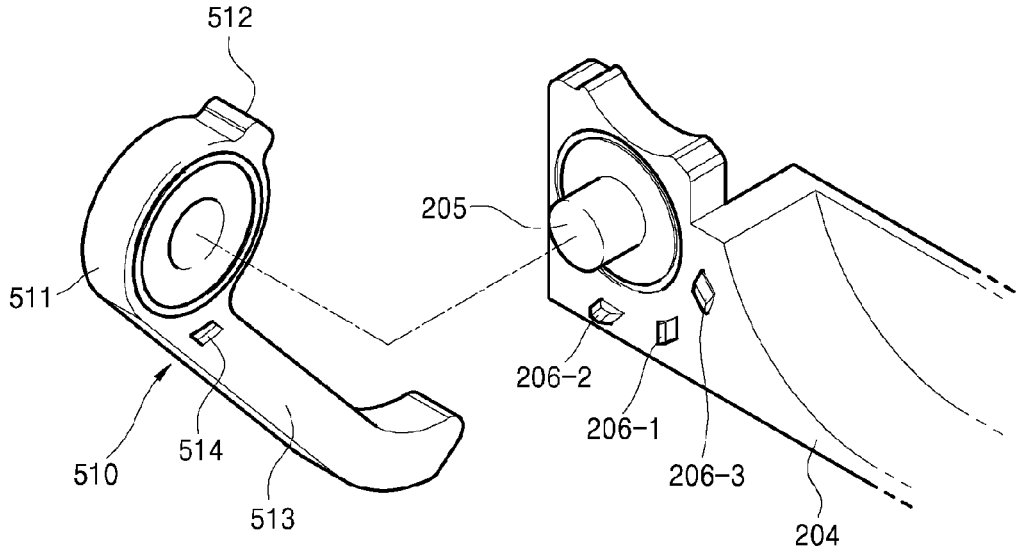
FIG. 37 is a diagram showing an example of a structure for locking a nip control member to a second position, a first position, and a third position, according to an exemplary embodiment.

FIG. 37 is a diagram showing a structure of locking the nip control member 510 at the second location, the first location, and the third location (e.g., locking the nip separating portion 512 at the first nip forming location, the nip separating location, and the second nip forming location), according to an exemplary embodiment. Referring to FIG. 37, the developing unit 200-3 includes a frame 204 supporting the nip control member 510 to be rotatable. The frame 204 includes a rotary shaft 205, and the nip control member 510 is coupled to the rotary shaft 205 to be rotatable. The frame 204 includes a first hook 206-1, a second hook 206-2, and a third hook 206-3 that are arranged in a circumferential direction based on the rotary shaft 205. The first to third hooks 206-1, 206-2, and 206-3 respectively correspond to the second location, the first location, and the third location of the nip control member 510. The nip control member 510 includes a lock portion 514. The lock portion 514 may be formed as, for example, a recess, and the first to third hooks 206-1, 206-2, and 206-3 are formed as protrusions that are inserted in the lock portion 514 of the recess shape. Otherwise, the lock portion 514 may be formed as a protrusion, and the first to third hooks 206-1, 206-2, and 206-3 may be formed as recesses in which the lock portion 514 of the protrusion shape may be inserted.

According to the above configuration, the nip control member 510 may be locked at the second location, the first location, and the third location. Coupling between the lock portion 514 and the first to third hooks 206-1, 206-2, and 206-3 is sufficiently strong for the user to feel a so-called 'clicking sensation' when the nip control member 510 is rotated respectively to the second location, the first location, and the third location.

(First Switching Unit)

Figure 38:
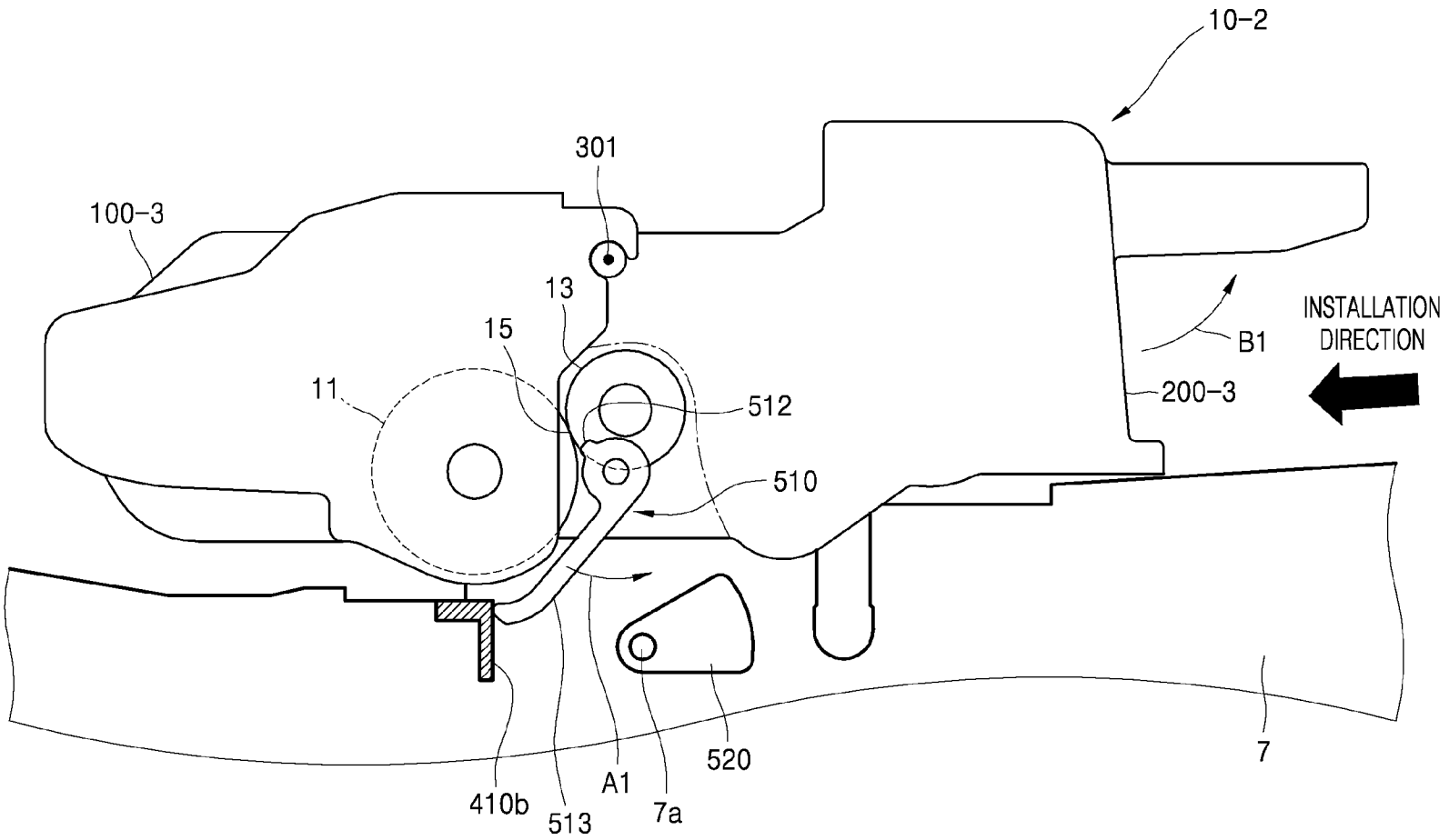
FIGS. 38 and 39 are diagrams of a first switching unit operating a nip control member to release a developing nip when a developing cartridge is attached to a main body, according to an exemplary embodiment.
Figure 39:
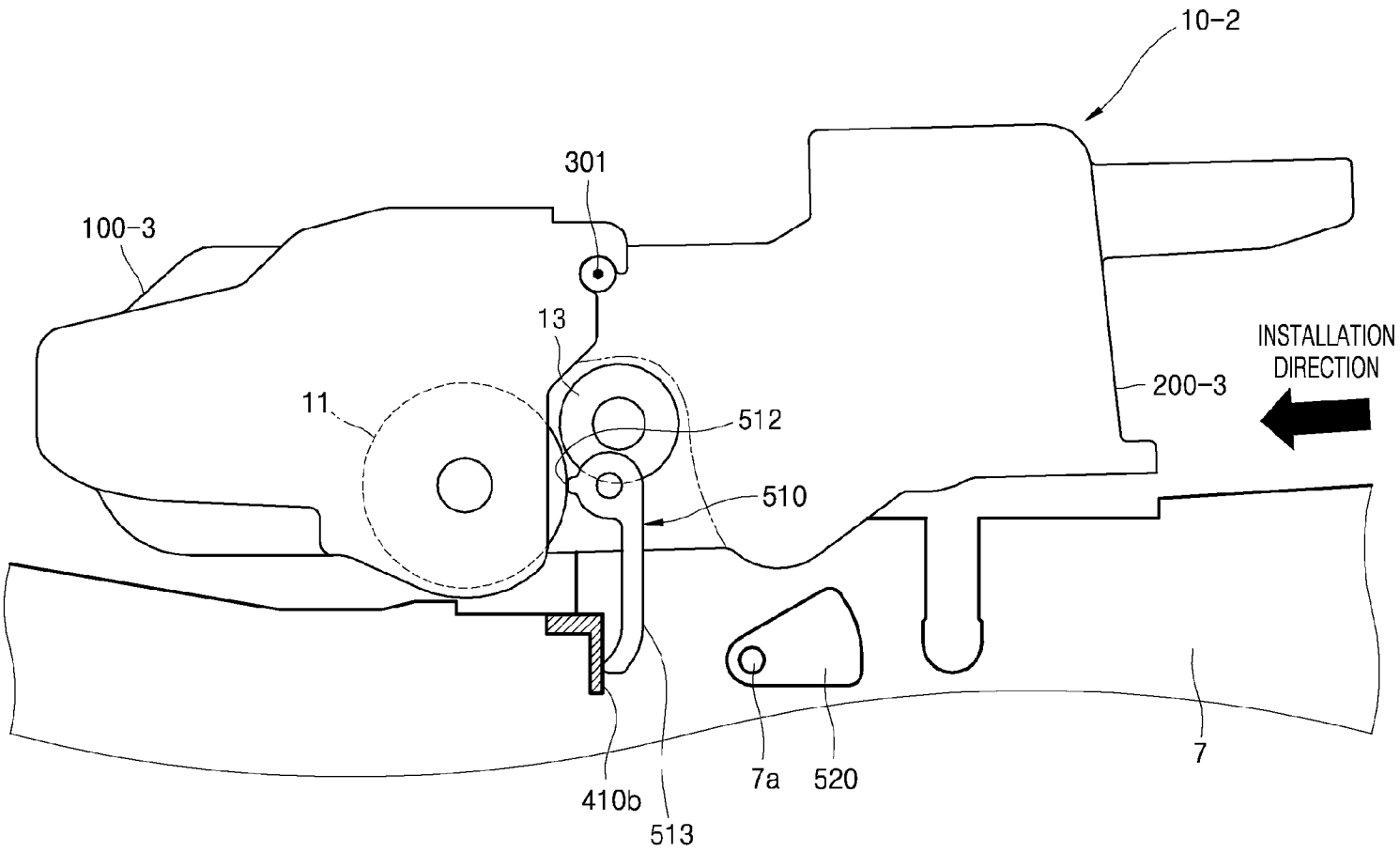

The developing nip 15 may be removed while the developing cartridge 10-2, in which the developing nip 15 is formed, is installed in the main body 2-3. For example, the developing nip 15 may be removed by switching the nip separating portion 512 located at the first nip forming location to the nip separating location when the developing cartridge 10-2 is installed in the main body 2-3. FIGS. 38 and 39 are diagrams of a first switching unit that removes the developing nip 15 by operating the nip control member 510 when the developing cartridge 10-2 is installed in the main body 2-3, according to an exemplary embodiment.

Referring to FIG. 38, the first switching unit includes a switching member 410*b* disposed on the main body 2-3. The switching member 410*b* may be formed, for example, on the frame 7 of the main body 2-3. When the developing cartridge 10-2 is installed, the nip control member 510 located at the first location interferes with the switching member 410*b*. For example, the manipulation portion 513 of the nip control member 510 interferes with the switching member 410*b*. Since the switching member 410*b* is fixed at a location, the nip control member 510 is pushed by the switching member 410*b* to be rotated in the first direction A1 as the developing cartridge 10-2 is inserted in the main body 2-3 in the installation direction shown in FIG. 38. Accordingly, the nip separation unit 512 contacts the photosensitive drum 11, and the developing unit 200-3 rotates about the hinge shaft 301 in a direction B1 so that the developing roller 13 starts to separate from the photosensitive drum 11.

As shown in FIG. 39, when the installation of the developing cartridge 10-2 in the main body 2-3 is finished, the nip control member 510 reaches the second location. The nip separating portion 512 reaches the nip separating location, and the developing roller 13 is completely separate from the photosensitive drum 11 and the developing nip 15 is removed.

According to the above configuration, the developing nip 15 is removed by the process of installing the developing cartridge 10-2 in the main body 2-3. Therefore, there is no need to check whether the developing nip 15 is formed before installing the developing cartridge 10-2 in the main body 2-3 after performing tests before release during the manufacturing processes, and thus, manufacturing costs may be reduced. Also, since the developing nip 15 is in the removed state, even when the developing cartridge 10-2 has been installed in the main body 2-3 for a long time until the image forming apparatus is sold after being released to market, the developing roller 13 and the photosensitive drum 11 may not be deformed or damaged.

Figure 40:
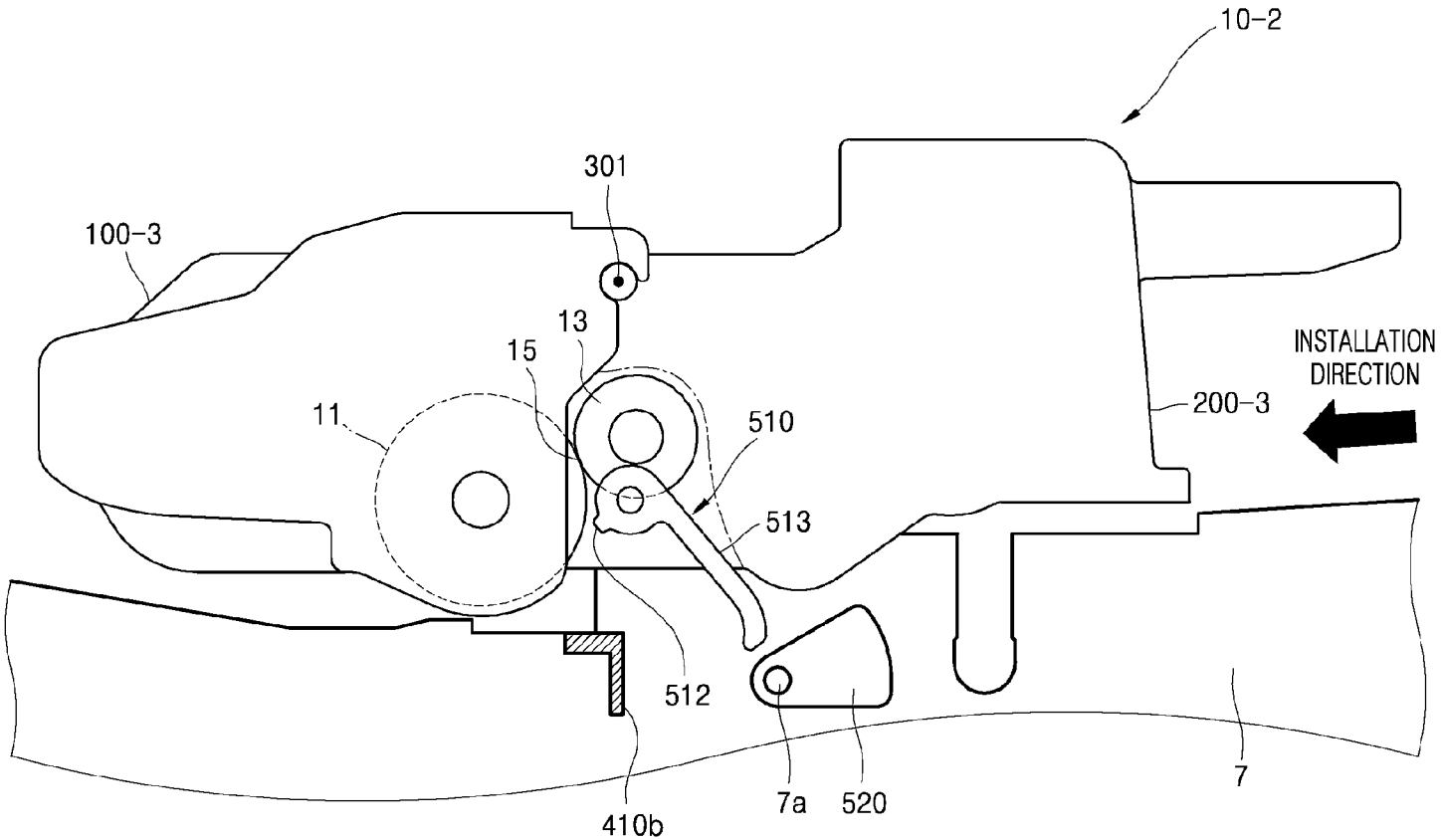
FIGS. 40 and 41 are diagrams of a second switching unit that switches a nip control member from a third position to a second position, according to an exemplary embodiment.

When the image forming apparatus 1-3 starts to operate in the above state, the nip control member 510 is rotated in the first direction A1 due to the rotation of the photosensitive drum 11 in the processing direction C, and thus, the nip control member 510 is switched to the third location as shown in FIG. 40. As such, the developing roller 13 and the photosensitive drum 11 contact each other and the developing nip 15 is formed. Therefore, even if the developing cartridge 10-2 is installed in the main body 2-3 in a state where the developing nip 15 is not formed, the printing operation may be performed.

(Second Switching Unit)

Even when the image forming apparatus 1-3 is operating, the developing roller 13 may be separate from the photosensitive drum 11 when there is no need to perform the developing operation. For example, during a time period from a time when an end portion of the toner image has passed through the region where the developing roller 13 and the photosensitive drum 11 face each other to a time when the toner image is transferred to the recording medium P and the recording medium P is discharged out of the main body 2-3 by the discharging roller 60, the developing roller 13 does not need to contact the photosensitive drum 11. Also, the developing roller 13 does not need to contact the photosensitive drum 11 when the printing operation is finished. In this case, if the developing nip 15 is removed by separating the developing roller 13 from the photosensitive drum 11, the deformation or damage to the developing roller 13 and the photosensitive drum 11 may be reduced, and accordingly, images of high image quality may be printed stably during the lifespan of the developing cartridge 10-2.

Figure 41:
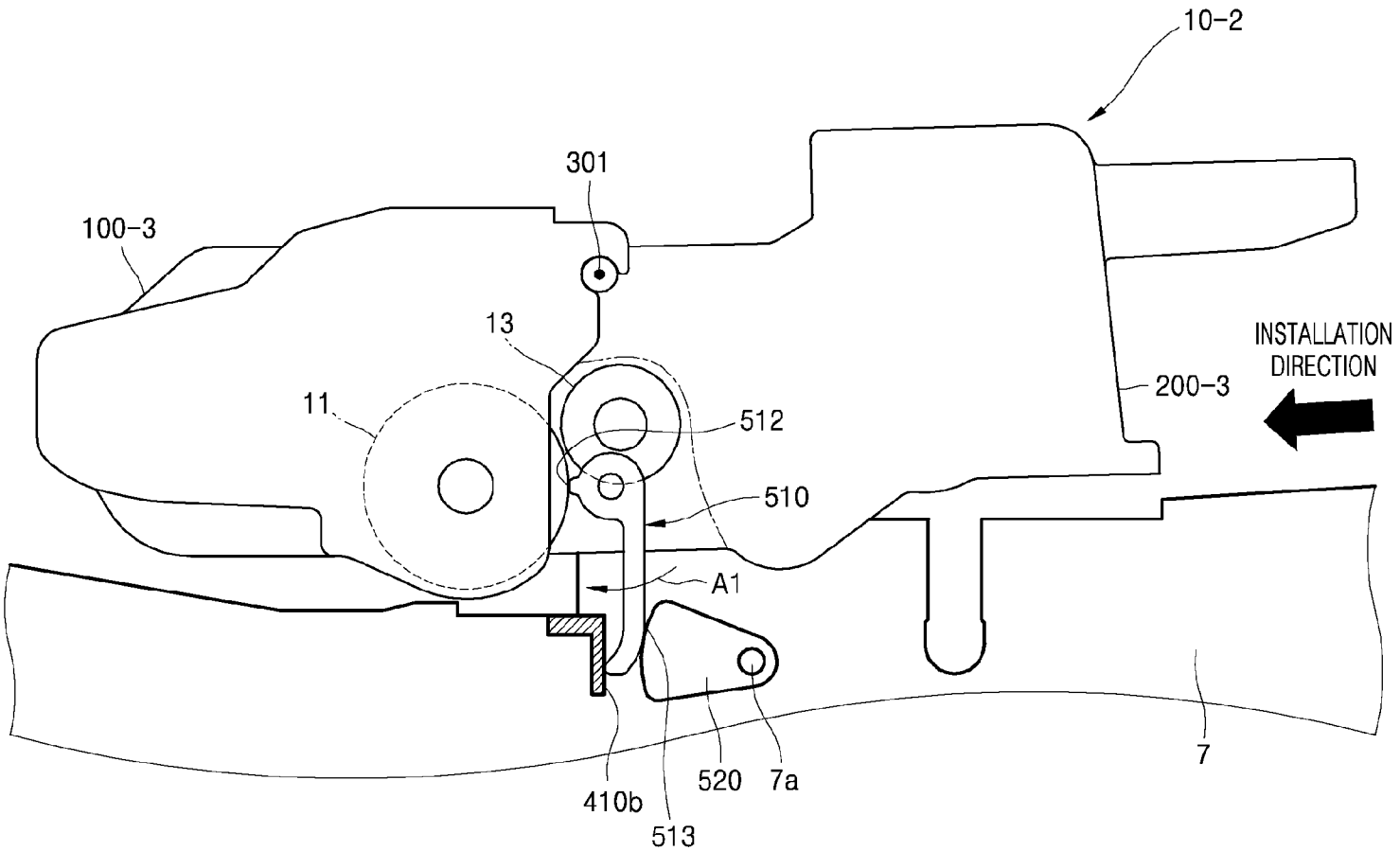

In order to remove the developing nip 15, the nip separating portion 512 may be switched from the second nip forming location to the nip separating location. The above operation may be achieved by switching the nip control member 510 from the third location to the second location. FIG. 41 is a diagram of the second switching unit for switching the nip separating portion 512 from the second nip forming location to the nip separating location, according to an exemplary embodiment. Referring to FIGS. 38, 39, 40, and 41, the second switching unit includes a switching lever 520 provided in the main body 2-3 to be moveable to a retreat location where the switching lever 520 does not interfere with the nip control member 510 and to an interference location where the switching lever 520 rotates the nip control member 510. The switching lever 520 may be provided on the frame 7 to rotate about a rotary shaft 7*a* to the retreat location to the interference location. The switching lever 520 may rotate the nip control member 510 from the third location to the second location by interfering with the manipulation portion 513 while rotating from the retreat location to the interference location.

Various structures for rotating the switching lever 520 may be adopted. For example, the switching lever 520 may be rotated in connection with the rotary gear 451 that is rotated by the actuator 460 as described above with reference to FIG. 12. The switching lever 520 and the rotary gear 451 may be formed integrally with each other. For example, the actuator 460 may be connected to the rotary gear 451 by the worm gear 461 formed on the rotary shaft thereof. Although not illustrated in the drawings, the switching lever 520 may be driven by a driving unit (not shown) that drives the developing cartridge 10-2. In this case, an alternative power connection structure, for example, a clutch structure, may be interposed between the driving unit (not shown) and the switching lever 520.

Referring to FIGS. 38, 39, and 40, the switching lever 520 is located at the retreat location where the switching lever 520 does not interfere with the nip control member 510. On the retreat location, the nip control member 510 and the switching lever 520 do not interfere with each other even when the developing cartridge 10-2 is attached to/detached from the main body 2-3 in a state where the nip control member 510 is located at the second location (FIG. 38) or the first location (FIG. 39). Also, even when the nip control member 510 is switched from the first location to the second location by the first switching unit during the process of installing the developing cartridge 10-2 in the main body 2-3 or even when the nip control member 510 is switched from the second location to the third location by the rotation of the photosensitive drum 11 in a state where the developing cartridge 10-2 is installed in the main body 2-3, the switching lever 520 located at the retreat location does not interfere with the nip control member 510.

In FIG. 40, the nip control member 510 is located at the third location due to the rotation of the photosensitive drum 11. The nip separating portion 512 is located at the second nip forming location. The developing nip 15 may be removed when the printing operation has finished, between the printing operations (e.g., between pages), or after the end portion of the toner image has passed through the developing nip 15. To do this, the actuator 460 rotates the switching lever 520 in a counter-clockwise direction in FIG. 40. Then, the switching lever 520 contacts the manipulation portion 513 of the nip control member 510, and then pushes the manipulation portion 513 to rotate the nip control member 510 in the first direction A1.

As shown in FIG. 41, when the switching lever 520 reaches the interference location, the nip control member 510 is located at the second location (e.g., the nip separation unit 512 is located at the nip separating location), and the driving of the actuator 460 is terminated. After that, the actuator 460 rotates the switching lever 520 in the counter-clockwise direction to return the switching lever 520 to the retreat location as shown in FIG. 39.

According to the above configuration, the developing nip 15 may be removed at necessary times during operation of the image forming apparatus 1-3 and when the operation of the image forming apparatus 1-3 is finished.

When the image forming apparatus 1-3 starts to operate and the photosensitive drum 11 rotates in the state shown in FIG. 41, the nip control member 510 is rotated in the second direction A2 to be switched to the third location. Therefore, the nip separation unit 512 is switched from the nip separating location to the second nip forming location, and the developing nip 15 is formed again to perform the printing operation.

(Location Detection)

The image forming apparatus 1-3 may further include a detection unit for detecting whether the developing nip 15 is removed. For example, the detection unit may detect the nip control member 510 located at the second location. The structure of the detection unit is the same as that shown in FIG. 15. That is, the nip separation member 340 of FIG. 15 may be considered as the nip control member 510 and the manipulation portion 341 of FIG. 15 may be considered as the manipulation portion 513. The detection sensor 470 may detect the manipulation portion 513 of the nip control member 510 located at the separating location.

According to the above configuration, whether the developing nip 15 is removed or formed may be determined according to whether the nip control member 510 is detected by the detection sensor 470.

The nip control unit may be disposed at a side portion of the developing roller 13 in a length direction of the developing roller 13. Also, the nip control unit may be disposed at opposite side portions of the developing roller 13 in the length direction of the developing roller 13, and in this case, the first and second switching units may be disposed at the opposite side portions of the developing roller 13 in the length direction.

It should be understood that exemplary embodiments described herein should be considered in a descriptive sense only and not for purposes of limitation. Descriptions of features or aspects within each exemplary embodiment should typically be considered as available for other similar features or aspects in other exemplary embodiments.

While one or more exemplary embodiments have been described with reference to the figures, it will be understood by those of ordinary skill in the art that various changes in form and details may be made therein without departing from the spirit and scope as defined by the following claims.

What is claimed is:

1. A developing cartridge comprising:

a photosensitive unit comprising a photosensitive drum;

a developing unit comprising a developing roller, and being connected to the photosensitive unit to rotate to a developing location, where the photosensitive drum and the developing roller contact each other to form a developing nip, and to rotate to a non-developing location, where the developing roller and the photosensitive drum are separate from each other to remove the developing nip;

an elastic member configured to apply an elastic force to the developing unit and the photosensitive unit in a direction of rotating toward the developing location; and a nip control unit comprising a nip separating portion switched to a nip forming location where the developing unit is located at the developing location and to a nip separating location where the developing unit is located at the non-developing location, a manipulation portion configured to switch the nip separating portion to the nip forming location and to the nip separating location by a manual manipulation, and a nip forming unit configured to switch the nip separating portion from the nip separating location to the nip forming location as the photosensitive unit and the developing unit start to operate.

2. The developing cartridge of claim 1, wherein the manipulation portion is exposed outside of the developing cartridge when the nip separation portion is located on the nip forming location.

3. The developing cartridge of claim 2, wherein the nip forming unit switches the nip separating portion from the nip separating location to the nip forming location as the developing roller rotates.

4. The developing cartridge of claim 3, wherein the nip separating portion interferes with the photosensitive unit when switched from the nip forming location to the nip separating location so that the developing unit rotates with respect to the photosensitive unit in a direction opposite to the direction in which the elastic force is applied.

5. The developing cartridge of claim 4, wherein:

the nip forming location comprises a first nip forming location and a second nip forming location, the manipulation portion switches the nip separating portion to the first nip forming location, a the second nip forming location, and the nip separating location, and the nip forming unit switches the nip separating portion from the nip separating location to the second nip forming location.

6. The developing cartridge of claim 5, further comprising a nip separation member comprising the nip separating portion and the manipulation portion, and being provided on the developing unit to be switched to the first nip forming location, the second nip forming location, and the nip separating location, wherein the nip forming unit comprises:

a gear to rotate with the developing roller; and a nip forming member comprising a cam gear portion to engage with the gear at the nip separating location and to separate from the gear at the first nip forming location and the second nip forming location, and the nip forming member being connected to the nip separation member.

7. The developing cartridge of claim 6, wherein:

the nip separation member and the nip forming member are provided in the developing unit to rotate about a rotary shaft, the nip forming member comprising a protrusion and the nip separation member comprising an insertion portion into which the protrusion is inserted, and the nip separation member and the nip forming member are rotated with each other by using the protrusion of the nip forming member and the insertion portion of the nip separation member into which the protrusion is inserted.

8. The developing cartridge of claim 3, wherein the nip separating portion interferes with the developing unit while switching from the nip forming location to the nip separation location to rotate the developing unit with respect to the photosensitive unit in an opposite direction to a direction in which the elastic force is applied.

9. The developing cartridge of claim 8, further comprising:

a nip control member comprising the nip separating portion and the manipulation portion and the nip control member being provided on the photosensitive unit to move to the nip forming location and the nip separating location;

a lock unit configured to lock the nip control member at the nip separating location; and a return spring configured to apply an elastic force to the nip control member in a direction of locating at the nip forming location, wherein the nip forming unit comprises:

a gear to rotate with the developing roller and the gear comprising a releasing cam; and a releasing portion configured to interfere with the releasing cam when the gear rotates in a state where the nip control member is located at the nip separating location to unlock the nip control member.

10. The developing cartridge of claim 9, wherein the lock unit comprises a first hook arranged on the photosensitive unit and a second hook arranged on the nip control member to be hooked by the first hook when the nip control member is located at the nip separating location.

11. The developing cartridge of claim 10, wherein the second hook and the nip separation unit are arranged at an elastic arm extending from a body of the nip control member, and the releasing cam interferes with the nip separating portion to push the elastic arm so that the second hook unhooks from the first hook.

12. The developing cartridge of claim 11, wherein the photosensitive unit comprises a manual manipulation recess configured to push the elastic arm so that the second hook unhooks from the first hook when the nip control member is located at the nip separating location.

13. The developing cartridge of claim 2, wherein the nip separating portion interferes with the photosensitive drum while switching from the nip forming location to the nip separating location so that the developing unit rotates with respect to the photosensitive unit in an opposite direction to the direction in which the elastic force is applied.

14. The developing cartridge of claim 13, wherein the nip forming unit switches the nip separating portion from the nip separating location to the nip forming location as the photosensitive drum rotates.

15. The developing cartridge of claim 14, wherein:

the nip forming location comprises a first nip forming location and a second nip forming location, the manipulation portion switches the nip separating portion to the first and second nip forming locations and the nip separating location, and the nip forming unit switches the nip separating portion from the nip separating location to the second nip forming location.

16. The developing cartridge of claim 15, further comprising a nip control member comprising the manipulation portion and the nip separating portion, and the nip control member being provided on the developing unit to rotate to the nip separating location and to the nip forming location.

17. An image forming apparatus comprising:

a main body; and the developing cartridge of claim 1, attachable to the main body and detachable from the main body.

18. The image forming apparatus of claim 17, further comprising a first switching unit arranged in the main body and configured to interfere with the manipulation portion while the developing cartridge is installed in the main body to switch the nip separating portion from the nip forming location to the nip separating location.

19. The image forming apparatus of claim 17, further comprising:

a door configured to open and close an opening formed in the main body in order to attach the developing cartridge to the main body and detach the developing cartridge from the main body; and a first switching unit formed in the main body and configured to interfere with the manipulation portion in association with a closing operation of the door in order to switch the nip separating portion from the nip forming location to the nip separating location.

20. The image forming apparatus of claim 17, wherein:

the nip forming location comprises a first nip forming location and a second nip forming location, the nip forming unit switches the nip separating portion from the nip separating location to the second nip forming location, and the main body comprises a switching unit configured to switch the nip separating portion from the second nip forming location to the nip separating location.

21. The image forming apparatus of claim 17, wherein the main body comprises a detection unit configured to detect a location of the nip separating portion.

22. A developing cartridge comprising:

a photosensitive unit comprising a photosensitive drum;

a developing unit comprising a developing roller, where the photosensitive drum and the developing roller contact each other to form a developing nip, and separate from each other to remove the developing nip;

an elastic member configured to apply an elastic force to the developing unit and the photosensitive unit in a direction of rotating toward contacting each other; and a nip control unit comprising:

a nip separation member including a nip separating portion and a manipulation portion configured to move the nip separating portion to a nip forming location to form the developing nip and to a nip separating location to remove the developing nip by a manual manipulation, and a nip forming unit configured to move the nip separating portion from the nip separating location to the nip forming location as the photosensitive unit and the developing unit start to operate, wherein the nip forming unit comprises:

a gear to rotate with the developing roller; and a nip forming member comprising a cam gear portion to engage with the gear at the nip separating location and to separate from the gear at the nip forming location, wherein the nip forming member is connected to the nip separation member.

23. An image forming apparatus comprising:

a main body; and the developing cartridge of claim 22, attachable to the main body and detachable from the main body.

24. A developing cartridge comprising:

a photosensitive unit comprising a photosensitive drum;

a developing unit comprising a developing roller, where the photosensitive drum and the developing roller contact each other to form a developing nip, and separate from each other to remove the developing nip;

an elastic member configured to apply an elastic force to the developing unit and the photosensitive unit in a direction of rotating toward contacting each other; and a nip control unit comprising:

a nip control member including a body supported by the developing unit to be rotatable, nip separating portion protruding from the body, and a manipulation portion extending from the body to an outer portion of the development cartridge, wherein the nip control member is manually rotatable to a first nip forming location to form the developing nip and is manually rotatable to a nip separating location to remove the developing nip, and wherein the nip control unit is configured to rotate the nip control member from the nip separating location to a second nip forming location when the photosensitive unit and the developing unit start to operate.

25. An image forming apparatus comprising:

a main body; and the developing cartridge of claim 24, attachable to the main body and detachable from the main body.

* * * * *